US008416078B2

(12) United States Patent
Sayegh et al.

(10) Patent No.: US 8,416,078 B2
(45) Date of Patent: Apr. 9, 2013

(54) ARTICLE SURVEILLANCE SYSTEM

(75) Inventors: Adel O. Sayegh, Rancho Cucamonga, CA (US); Edgardo Redublo, Chino Hills, CA (US); John Clothier, Chino, CA (US); Steve Gutierrez, Fontana, CA (US); Radim Hotovec, Ostraya-Muglinov (CZ); Vladimir Hotovec, Ostrava-Muglinov (CZ); Stanislav Vcelka, Ostrava-Muglinov (CZ); Milan Kuchar, Ostrava-Muglinov (CZ); Radim Ptacek, Ostrava-Muglinov (CZ)

(73) Assignee: Universal Surveillance Corporation, Rancho Cucmonga, CA (US)

( * ) Notice: Subject to any disclaimer, the term of this patent is extended or adjusted under 35 U.S.C. 154(b) by 0 days.

(21) Appl. No.: 12/816,353

(22) Filed: Jun. 15, 2010

(65) Prior Publication Data

US 2011/0304458 A1 Dec. 15, 2011

Related U.S. Application Data

(60) Provisional application No. 61/186,985, filed on Jun. 15, 2009.

(51) Int. Cl.
*G08B 13/14* (2006.01)

(52) U.S. Cl. ..... 340/568.8; 340/568.1; 340/571

(58) Field of Classification Search ..... 340/568.8, 340/572.1, 572.2, 572.6, 572.7, 568.1, 571
See application file for complete search history.

(56) References Cited

U.S. PATENT DOCUMENTS

| | | | | |
|---|---|---|---|---|
| 5,083,111 | A * | 1/1992 | Drucker et al. | 340/572.1 |
| 5,353,011 | A * | 10/1994 | Wheeler et al. | 340/572.4 |
| 5,414,299 | A * | 5/1995 | Wang et al. | 257/702 |
| 2007/0046470 | A1 * | 3/2007 | Pempsell et al. | 340/572.1 |
| 2010/0253588 | A1 * | 10/2010 | Lee | 343/878 |
| 2011/0234463 | A1 * | 9/2011 | Lankes et al. | 343/728 |

* cited by examiner

*Primary Examiner* — Toan N Pham
(74) *Attorney, Agent, or Firm* — Milord A. Keshishian

(57) ABSTRACT

An electronic article surveillance (EAS) system comprising a combined plurality of surveillance systems that operate independent of and autonomous from each other and are physically located within pedestal systems having at least a first EAS system for detecting a magnetic EAS tag (which are immune to foil lined bags and other Faraday Shields) and magnetic detachers, a second EAS system for detecting Faraday shields, a third EAS for detecting acousto-magnetic EAS tags, and an anti-EAS jamming alarm mechanism. The EAS system of the present invention further includes a counter that counts the number of individuals entering into and exiting out of a secured area, and validate if an alarm is legitimate.

63 Claims, 32 Drawing Sheets

System operating, no tag

System operating with tag

System 1 operating with another System 2, no tag

System 1 operating with another System 2, tag on System 1

System operating with tag and jammer

ARTICLE SURVEILLANCE SYSTEM

CROSS-REFERENCE TO RELATED APPLICATIONS

This Application claims the benefit of priority of U.S. Utility Provisional Patent Application No. 61/186,985, filed Jun. 15, 2009, the entire disclosure of which is expressly incorporated by reference herein.

BACKGROUND OF THE INVENTION (1) Field of the Invention

This invention relates to article surveillance systems and, more particularly, to an electronic article surveillance (EAS) system having multiple article surveillance and detection systems combined.

(2) Description of Related Art

In general, several types of EAS systems exist that operate on different physics and technology principles, each of which offer various advantages and disadvantages. Non-limiting, non-exhaustive list of examples of known individual EAS systems include electromagnetic EAS systems, Radio Frequency (RF) EAS systems, and acousto-magnetic EAS systems. Regrettably, most savvy shoplifters are keenly aware of the disadvantages of each individual system, exploiting individual system weaknesses to circumvent and overcome the overall surveillance capabilities. For example, it is well known that most systems can be circumvented by placing an article with an attached EAS tag in a bag lined with aluminum foil, with the bag (also known as booster bag) acting as Faraday shield or cage to isolate the EAS tag from the antennas system of EAS systems, rendering the EAS tag useless. Other well-known methods of circumventing EAS systems include jamming transmission signals from an EAS system transmitter.

Accordingly, in light of the current state of the art and the drawbacks to current individual EAS systems exemplarily listed above, a need exists for an EAS system that includes and combines multiple individual electronic article surveillance systems, resulting in a robust surveillance system that overcomes the weakness of each individual system if implemented separately, synergically improving the overall surveillance capability.

BRIEF SUMMARY OF THE INVENTION

An optional exemplary aspect of the present invention provides an electronic article surveillance (EAS) system, comprising:

- a combined plurality of independent surveillance systems physically located within pedestal systems, comprising:
- a first EAS system configured as a magnetic EAS system that detects magnetic material, including magnetic EAS tags and magnetic detachers;
- a second EAS system configured as an anti-Faraday shielding EAS system that detects Faraday shields;
- a third EAS system configured as an acousto-magnetic EAS systems that detects an acousto-magnetic EAS tag; and
- an anti-jamming detection system.

Another optional exemplary aspect of the present invention provides an electronic article surveillance (EAS) system, wherein:

- the pedestal systems is comprised of a plurality of pedestals, with:

- a first pedestal of the plurality of pedestals accommodating at least one of a transmitting and receiving antennas of at least one of the respective first, second, and third EAS systems; and
- a second pedestal of the plurality of pedestals accommodating at least one of the receiving and transmitting antennas of at least another of the respective first, second, and third EAS systems.

Yet another optional exemplary aspect of the present invention provides an electronic article surveillance (EAS) system, wherein:

- the pedestal systems is comprised of at least one transceiver pedestal.

Still another optional exemplary aspect of the present invention provides an electronic article surveillance (EAS) system, wherein:

- the magnetic EAS system includes a plurality of electromagnetic systems.

A further optional exemplary aspect of the present invention provides an electronic article surveillance (EAS) system, wherein:

- the plurality of electromagnetic systems include a plurality of magnetic sensors.

Yet a further optional exemplary aspect of the present invention provides an electronic article surveillance (EAS) system, wherein:

- the plurality of magnetic sensors are comprised of a core having ferromagnetic material with high magnetic permeability, and a conductor wound around the core.

Still a further optional exemplary aspect of the present invention provides an electronic article surveillance (EAS) system, wherein:

- a first magnetic sensor of the plurality of magnetic sensors is coupled with a second magnetic sensor of the plurality of magnetic sensors to form a first electromagnetic system;
- a third magnetic sensor of the plurality of magnetic sensors is coupled with a fourth magnetic sensor of the plurality of magnetic sensors to form a second electromagnetic system;
- with a first and second electromagnetic systems functioning independently.

Another optional exemplary aspect of the present invention provides an electronic article surveillance (EAS) system, wherein:

- the first magnetic sensor generating a first signal and the second magnetic sensor generating a second signal that is equal but opposite to the first signal for suppression and prevention of false alarm when one of an EAS magnetic tag and a detacher is detected substantially equally distanced from both the first and second magnetic sensors;
- the third magnetic sensor generating a third signal and the fourth magnetic sensor generating a fourth signal that is equal but opposite to the third signal for suppression and prevention of false alarm when one of an EAS magnetic tag and a detacher is detected substantially equally distanced from both the third and fourth magnetic sensors;
- with the first electromagnetic system generating a first surveillance zone and the second electromagnetic system generating a second surveillance zone that is different from the first surveillance zone, with an area of the first surveillance zone and the second surveillance zone overlapping to fully cover a complete surveillance zone of the EAS system.

Yet another optional exemplary aspect of the present invention provides an electronic article surveillance (EAS) system, wherein:

a wire is wound about the core along an entire longitudinal axial length of the core.

Still another optional exemplary aspect of the present invention provides an electronic article surveillance (EAS) system, wherein:

the anti-Faraday shielding EAS system is comprised of a first anti-Faraday shielding EAS system having a first inductor coil;

a second anti-Faraday shielding EAS system having a second inductor coil; with the first anti-Faraday shielding EAS system coupled with the second anti-Faraday shielding EAS system.

A further optional exemplary aspect of the present invention provides an electronic article surveillance (EAS) system, wherein:

the first inductor coil has a first air-core with a first width, a first axial length, and a first axial center, with the first inductor coil wound around the first air-core along an entire first longitudinally axis of the first air-core;

the second inductor coil has a second air-core with a second width, a second axial length, and a second axial center, with the second inductor coil wound around the second air-core along an entire second longitudinally axis of the second air-core; and the first air-core is located above the second air-core, with the first axial center aligned parallel the second axial center.

Yet a further optional exemplary aspect of the present invention provides an electronic article surveillance (EAS) system, wherein:

a first straight section of a first winding of the acousto-magnetic EAS system is passed through the first axial center, and a second straight section of a second winding of the acousto-magnetic EAS system is passed through the second axial center.

Still a further optional exemplary aspect of the present invention provides an electronic article surveillance (EAS) system, wherein:

the acousto-magnetic EAS system includes a first upper coil and a second lower coil, with a bottom of the first upper coil overlapping a top section of the second lower coil; the corners of the first upper coil and the second lower coil have a substantially rectangular curved corners.

Another optional exemplary aspect of the present invention provides an electronic article surveillance (EAS) system, wherein:

the magnetic EAS system includes:

a first amplifier with a first amplification gain for amplifying an incoming antenna signal and outputting an amplified signal, a low-pass filter for filtration of noise of the amplified signal and generation of a filtered signal;

a differential amplifier for determining a rate of change in the filtered signal for discriminating between an occurrence and noise, and generating a differential signal if rate of change is fast;

a second amplifier with a second amplification gain for amplifying the differential signal and outputting a second amplified signal;

a microprocessor for processing the second amplified signal, and based on a sensitivity threshold level, determines if an alarm is to be generated.

Yet another optional exemplary aspect of the present invention provides an electronic article surveillance (EAS) system, wherein:

differential amplifier includes a differential input stage that is comprised of a first timer that generates a first time $\tau_1$ and a second timer that generates a second time $\tau_2$, with $\tau_1 >> \tau_2$;

the first timer is comprised of a first set of RC circuit and the second timer comprised of a second set of RC timer.

Still another optional exemplary aspect of the present invention provides an electronic article surveillance (EAS) system, wherein:

the microcomputer converts the second amplified signals from analog into digitized input signals using an A/D converter;

the digitized input signals are sampled, read, and stored as sampled averages, and determined if there is an increasing trend in average value of the sampled averages within a set time T, and if there is an increasing trend and the sampled averages are greater than a sensitivity threshold, the microcomputer generates an alarm.

A further optional exemplary aspect of the present invention provides an electronic article surveillance (EAS) system, wherein:

the anti-Faraday shielding EAS system includes an anti-Faraday shielding EAS signal processing circuit that is comprised of:

a signal generator for generating a carrier signal at a predetermined frequency set by a frequency selector;

a first amplifier with a first amplification gain for amplifying the generated carrier signal and outputting an amplified signal to an antenna for transmission of signal;

a receiving antenna for receiving the transmitted signal from the transmitting antenna;

a second amplifier with a second amplification gain for amplifying the received signal and outputting a second amplified signal;

a low-pass filter for filtration of noise of the second amplified signal and generation of a filtered signal;

an amplitude demodulator for demodulating the filtered signal to generate a demodulated signal;

a differential amplifier for determining a rate of change in the demodulated signal for discriminating between an occurrence and noise, and generating a differential signal if rate of change is fast;

a third amplifier with a third amplification gain for amplifying the differential signal and outputting a third amplified signal;

a microprocessor for processing the third amplified signal, and based on a sensitivity threshold level, determines if an alarm is to be generated.

Still a further optional exemplary aspect of the present invention provides an electronic article surveillance (EAS) system, wherein:

the microcomputer converts the third amplified signals from analog into digitized input signals using an A/D converter;

the digitized input signals are read and sampled, and stored as sampled averages;

the microprocessor compares the received stored sample averages with a predetermined signature signal to determine if an alarm is to be generated.

Another optional exemplary aspect of the present invention provides an electronic article surveillance (EAS) system, wherein:

the acousto-magnetic EAS system includes:

an antenna comprising a first coil and a second coil;

a transceiver module coupled with the first and the second coils for generating and transmitting a respective first signal and a second signal in a first mode of operation, defining a surveillance zone for an EAS tag;

the first and the second signals having respective first and second signal phase characteristics that are maintained during normal operations, with no substantial changes in respective signal phases;

the transceiver module in a second mode of operation receives signals from the surveillance zone from the first and second coils; and a microprocessor for processing the received signals from the transceiver module and generating an alarm based on a predetermined condition.

Yet another optional exemplary aspect of the present invention provides an electronic article surveillance (EAS) system, wherein:

the first coil and the second coil partially overlap and are positioned within a common plane.

Still another optional exemplary aspect of the present invention provides an electronic article surveillance (EAS) system, wherein:

the generated first and second signals are respective first and second magnetic fields that are substantially in phase, only.

A further optional exemplary aspect of the present invention provides an electronic article surveillance (EAS) system, wherein:

the generated first and second signals are respective first and second magnetic fields that are substantially out of phase, only.

Yet a further optional exemplary aspect of the present invention provides an electronic article surveillance (EAS) system, wherein:

the generated first and second signals are respective first and second magnetic fields with phase characteristics that are maintained during normal operations and have one of substantially in phase and substantially out of phase characteristics only, with no substantial signal phase variations during operation.

Still a further optional exemplary aspect of the present invention provides an electronic article surveillance (EAS) system, wherein:

the transceiver module is comprised of a transceiver circuit coupled with the first and second coils of the antenna.

Another optional exemplary aspect of the present invention provides an electronic article surveillance (EAS) system, comprising:

a plurality of independent surveillance systems physically located within pedestal systems, comprising:

a first EAS system; and a second EAS system that is independent of and autonomous from the first EAS system.

Yet another optional exemplary aspect of the present invention provides an electronic article surveillance (EAS) system, wherein:

the first EAS system operates at a first frequency; and the second EAS system functions at a second frequency, which is different from that of the first frequency.

Another optional exemplary aspect of the present invention provides an electronic article surveillance (EAS) system, wherein:

the first EAS system is comprised of:

a magnetic EAS system for detection of magnetic material, including magnets, magnetic objects, a magnetic EAS tag, and magnetic detacher; and an anti-Faraday shielding EAS system that functions independent of and autonomous from the magnetic EAS system for detection of Faraday shields.

Yet another optional exemplary aspect of the present invention provides an electronic article surveillance (EAS) system, wherein:

the second EAS system is comprised of an acousto-magnetic EAS system that includes:

a plurality of antennas;

a control unit coupled with the plurality of antennas for generating and transmitting signals, defining a surveillance zone for an EAS tag; and for receiving signals from the surveillance zone;

with the transmitted signals having signal phase characteristics that are maintained during normal operations, with no substantial changes in respective signal phases; and with the control unit processing the received signals from the surveillance zone and generating an alarm based on a predetermined condition, and without effecting generation and transmission of signals that define the surveillance zone.

A further optional exemplary aspect of the present invention provides an electronic article surveillance (EAS) system, wherein:

an antenna of the plurality of antennas is comprised of a first coil and a second coil.

Still a further optional exemplary aspect of the present invention provides an electronic article surveillance (EAS) system, wherein:

the first coil and the second coil partially overlap and are positioned within a common plane.

Another optional exemplary aspect of the present invention provides an electronic article surveillance (EAS) system, wherein:

the transmitted signals are magnetic fields that are substantially in phase, only.

Yet another optional exemplary aspect of the present invention provides an electronic article surveillance (EAS) system, wherein:

the transmitted signals are magnetic fields that are substantially out of phase, only.

Still another optional exemplary aspect of the present invention provides an electronic article surveillance (EAS) system, wherein:

the transmitted signals magnetic fields with phase characteristics that are maintained during normal operations and have one of substantially in phase and substantially out of phase characteristics only, with no substantial signal phase variations during operation.

A further optional exemplary aspect of the present invention provides an electronic article surveillance (EAS) system, wherein:

the control unit includes a transceiver module that is comprised of a transceiver circuit coupled with the plurality of antennas.

Yet a further optional exemplary aspect of the present invention provides an electronic article surveillance (EAS) system, wherein:

the plurality of antennas are a plurality of transceiver antennas, with a transceiver antenna of the plurality of transceiver antennas comprised of a first coil and a second coil.

Still a further optional exemplary aspect of the present invention provides an electronic article surveillance (EAS) system, wherein:

the plurality of antennas are comprised of a plurality of transmitter antennas and a plurality of receiver antennas, with an antennas of plurality of transmitter and receiver antennas comprised of a first coil and a second coil.

Another optional exemplary aspect of the present invention provides an electronic article surveillance (EAS) system, wherein:

the received signals are fetched by a multiplexer from the plurality of receiver antennas, with a received signal from a receiver antenna individually processed by a microprocessor of the control unit.

Yet another optional exemplary aspect of the present invention provides an electronic article surveillance (EAS) system, wherein:

an acousto-magnetic EAS system includes:

an antenna;

a control unit coupled with the antenna for generating and transmitting a signal, defining a surveillance zone for an EAS tag; and for receiving signals from the surveillance zone;

with the transmitted signal has a signal phase characteristic that is maintained during normal operations, with no substantial changes in respective signal phase; and with the control unit processing the received signals from the surveillance zone and generating an alarm based on a predetermined condition, and without effecting generation and transmission of signal that defines the surveillance zone.

Still another optional exemplary aspect of the present invention provides an electronic article surveillance (EAS) system, wherein:

the antenna is comprised of a single coil.

A further optional exemplary aspect of the present invention provides an electronic article surveillance (EAS) system, wherein:

the transmitted signal is a magnetic field with a substantially constant phase.

Yet a further optional exemplary aspect of the present invention provides an electronic article surveillance (EAS) system, wherein:

the control unit includes a transceiver module that is comprised of a transceiver circuit coupled with the antenna.

Still a further optional exemplary aspect of the present invention provides an electronic article surveillance (EAS) system, wherein:

the antenna is a plurality of transceiver antennas, with a transceiver antenna of the plurality of transceiver antennas comprised of a coil.

Another optional exemplary aspect of the present invention provides an electronic article surveillance (EAS) system, wherein:

the plurality of antennas are comprised of a plurality of transmitter antennas and a plurality of receiver antennas, with an antennas of plurality of transmitter and receiver antennas comprised of a coil.

Yet another optional exemplary aspect of the present invention provides an electronic article surveillance (EAS) system, wherein:

the received signals are fetched by a multiplexer from the plurality of receiver antennas, with a received signal from a receiver antenna individually processed by a microprocessor of the control unit.

Still another optional exemplary aspect of the present invention provides an electronic article surveillance (EAS) system, wherein:

the first EAS system is comprised of a magnetic EAS system for detection of magnetic material, including magnetic objects, and a magnetic EAS tag; and the second EAS system is comprised of an anti-Faraday shielding EAS system that functions independent of and autonomous from the magnetic EAS system for detection of Faraday shields.

A further optional exemplary aspect of the present invention provides an electronic article surveillance (EAS) system, wherein:

the magnetic EAS system includes a plurality of electromagnetic systems.

Yet a further optional exemplary aspect of the present invention provides an electronic article surveillance (EAS) system, wherein:

the plurality of electromagnetic systems include a plurality of magnetic sensors.

Still a further optional exemplary aspect of the present invention provides an electronic article surveillance (EAS) system, wherein:

the plurality of magnetic sensors are comprised of a core having ferromagnetic material with high magnetic permeability, and a conductor wound around the core.

Another optional exemplary aspect of the present invention provides an electronic article surveillance (EAS) system, wherein:

a first magnetic sensor of the plurality of magnetic sensors is coupled with a second magnetic sensor of the plurality of magnetic sensors to form a first electromagnetic system;

a third magnetic sensor of the plurality of magnetic sensors is coupled with a fourth magnetic sensor of the plurality of magnetic sensors to form a second electromagnetic system;

with a first and second electromagnetic systems functioning independently.

Yet another optional exemplary aspect of the present invention provides an electronic article surveillance (EAS) system, wherein:

the first magnetic sensor generating a first signal and the second magnetic sensor generating a second signal that is equal but opposite to the first signal for suppression and prevention of false alarm when one of an EAS magnetic tag and a magnetic detacher is detected substantially equally distanced from both the first and second magnetic sensors;

the third magnetic sensor generating a third signal and the fourth magnetic sensor generating a fourth signal that is equal but opposite to the third signal for suppression and prevention of false alarm when one of an EAS magnetic tag and a magnetic detacher is detected substantially equally distanced from both the third and fourth magnetic sensors;

with the first electromagnetic system generating a first surveillance zone and the second electromagnetic system generating a second surveillance zone that is different from the first surveillance zone, with an area of the first surveillance zone and the second surveillance zone overlapping to fully cover a complete surveillance zone of the EAS system.

Still another optional exemplary aspect of the present invention provides an electronic article surveillance (EAS) system, wherein:

a wire is wound about the core along an entire longitudinal axial length of the core.

A further optional exemplary aspect of the present invention provides an electronic article surveillance (EAS) system, wherein:

the anti-Faraday shielding EAS system is comprised of a first anti-Faraday shielding EAS system having a first inductor coil;

a second anti-Faraday shielding EAS system having a second inductor coil; with the first anti-Faraday shielding EAS system coupled with the second anti-Faraday shielding EAS system.

Still a further optional exemplary aspect of the present invention provides an electronic article surveillance (EAS) system, wherein:

the first inductor coil has a first air-core with a first width, a first axial length, and a first axial center, with the first inductor coil wound around the first air-core along an entire first longitudinally axis of the first air-core;

the second inductor coil has a second air-core with a second width, a second axial length, and a second axial center, with the second inductor coil wound around the second air-core along an entire second longitudinally axis of the second air-core; and the first air-core is located above the second air-core, with the first axial center aligned parallel the second axial center.

Another optional exemplary aspect of the present invention provides an electronic article surveillance (EAS) system, wherein:

the anti-Faraday shielding EAS system is comprised of a single inductor coil.

Yet another optional exemplary aspect of the present invention provides an electronic article surveillance (EAS) system, wherein:

the inductor coil has an air-core with a width, an axial length, and an axial center, with the inductor coil wound around the air-core along an entire longitudinally axis of the first air-core.

Still another optional exemplary aspect of the present invention provides an electronic article surveillance (EAS) system, wherein:

the first EAS system is comprised of only one of a magnetic EAS system for detection of magnetic material, including magnetic objects, and a magnetic EAS tag and an anti-Faraday shielding EAS system that detects of Faraday shields; and the second EAS system is comprised of one or more acousto-magnetic EAS systems that detect an acousto-magnetic EAS tag.

A further optional exemplary aspect of the present invention provides an electronic article surveillance (EAS) system, wherein:

the acousto-magnetic EAS system includes:

an antennas comprised of a single coil;

a control unit coupled with the antenna for generating and transmitting a signal, defining a surveillance zone for an EAS tag; and for receiving signals from the surveillance zone;

with the transmitted signal has a signal phase characteristic that is maintained during normal operations, with no substantial changes in the signal phase; and with the control unit processing the received signals from the surveillance zone and generating an alarm based on a predetermined condition, and without effecting generation and transmission of signal that defines the surveillance zone.

Another optional exemplary aspect of the present invention provides an electronic article surveillance (EAS) system, wherein:

the acousto-magnetic EAS system includes:

an antenna comprising a first coil and a second coil;

a transceiver module coupled with the first and the second coils for generating and transmitting a respective first signal and a second signal in a first mode of operation, defining a surveillance zone for an EAS tag;

the first and the second signals having respective first and second signal phase characteristics that are maintained during normal operations, with no substantial changes in respective signal phases;

the transceiver module in a second mode of operation receives signals from the surveillance zone from the first and second coils; and a microprocessor for processing the received signals from the transceiver module and generating an alarm based on a predetermined condition.

Yet another optional exemplary aspect of the present invention provides an electronic article surveillance (EAS) system, wherein:

the second EAS system is comprised of an acousto-magnetic EAS system that includes:

a plurality of antennas that are comprised of one or more transmitter antenna loops and a first and a second receiver antenna loops;

the first receiver antenna loop and the second receiver antenna loop partially overlap and are positioned within a common plane;

a control unit coupled with the one or more transmitter antenna loops for generating and transmitting signals, defining a surveillance zone for an EAS tag; and for receiving a first and a second receiver signals from the surveillance zone;

with the transmitted signals having signal phase characteristics that are maintained during normal operations, with no substantial changes in respective signal phases; and with the control unit processing the first and the second receiver signals from the surveillance zone and generating an alarm based on a predetermined condition, and without effecting generation and transmission of signals that define the surveillance zone;

the control unit includes:

a processor that has a first and a second analog to digital (A/D) converters that convert the first and the second received signals from the respective first and second receiver antenna loops into first and second digital signals;

a first and second samplers that simultaneously sample the respective first and the second digital signals twice at two different predetermined times;

a computing mechanism that manipulates both the first and the second sampled digital signals from the first and second receiver antenna loops and compares the resulting manipulations with a predetermined criteria.

A further optional exemplary aspect of the present invention provides an electronic article surveillance (EAS) system, further including:

a count mechanism for counting entities moving into and out of a secured area.

Another optional exemplary aspect of the present invention provides an electronic article surveillance (EAS) system, wherein:

the count mechanism is comprised of one or more infrared gates.

Yet another optional exemplary aspect of the present invention provides an electronic article surveillance (EAS) system, wherein:

the count mechanism is comprised of a digital video recorder.

A further optional exemplary aspect of the present invention provides an electronic article surveillance (EAS) system, wherein:

the count mechanism is used for validation of legitimate alarm, and determination of a false alarm.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIG. 1A-2 is an exemplary illustration of another embodiment of an EAS system in accordance with the present invention;

FIG. 1A-2 is an exemplary illustration of yet another embodiment of an EAS system in accordance with the present invention;

FIG. 1A-3 is an exemplary illustration of a further embodiment of an EAS system in accordance with the present invention;

FIG. 1A-4 is an exemplary illustration of still a further embodiment of an EAS system in accordance with the present invention;

FIG. 1A-5 is an exemplary illustration of yet another embodiment of an EAS system in accordance with the present invention;

FIG. 2A-1 is an exemplary illustration of antennas of an electromagnetic EAS system in accordance with the present invention;

FIG. 2A-2 is an exemplary illustration of an EAS tag;

FIG. 2A-3 is an exemplary illustration of a magnetic EAS tag in accordance with the present invention;

FIG. 3A-1 is an exemplary illustration of antennas of an anti-Faraday shielding EAS system in accordance with the present invention;

FIG. 3A-2 is an exemplary illustration of another embodiment of an antenna of an anti-Faraday shielding EAS system in accordance with the present invention;

FIG. 4A-1 is an exemplary illustration of antennas of an acousto-magnetic EAS system in accordance with the present invention;

FIG. 4A-2 is an exemplary illustration of another embodiment of an antenna of an acousto-magnetic EAS system in accordance with the present invention;

FIGS. 4E-1 and 4E-2 are exemplary illustrations of the various preferred antenna configurations for an acousto-magnetic system that may be used in conjunction the signal processing illustrated in FIG. 4D in accordance with the present invention;

FIGS. 4E-3 and 4E-4 are exemplary illustrations of the various antenna configurations that may be used in conjunction with the signal processing illustrated in FIG. 4D in accordance with the present invention;

FIGS. 4F-1 and 4F-2 are exemplary schematic flowchart diagrams for the processing of antenna signals from an acousto-magnetic EAS system by a microprocessor in accordance with the present invention;

DETAILED DESCRIPTION OF THE INVENTION

Figures 1, 1A:
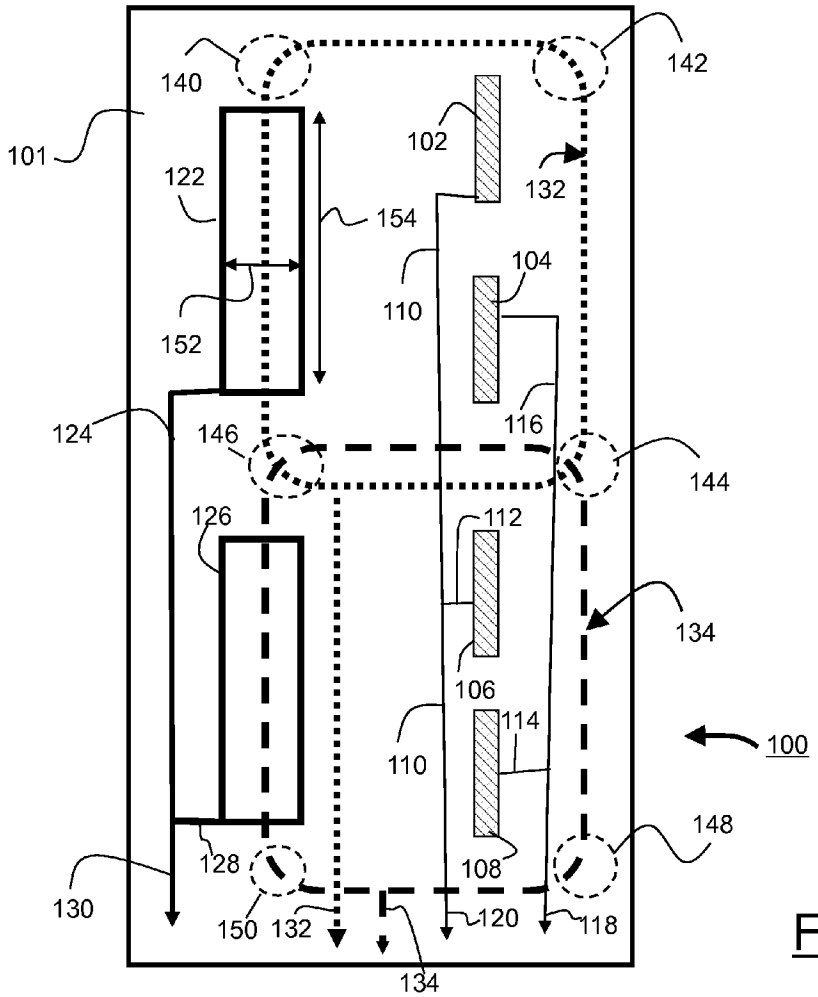
FIG. 1A-1 is an exemplary illustration of an EAS system in accordance with the present invention.

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart may represent both method function(s), operation(s), or act(s) and one or more elements for performing the method function(s), operation(s), or act(s). In addition, depending upon the implementation, the corresponding one or more elements may be configured in hardware, software, firmware, or combinations thereof.

Most EAS systems include a transmitter antenna (usually one of two pedestals of an entry/exit gate) that continuously (or in pulses) transmits a signal at a specific frequency, which is picked up by an adjacent receiver antenna (usually the other of the two pedestals of an entry/exit gate). Further, most EAS systems include a tag 281 (FIG. 2A-2) that is usually attached to an article. EAS tags 281 include electronics 283 and 289 that are tuned to respond to the specific frequency signal emitted by the transmitter antenna of the EAS systems. The EAS tag 281 may be construed as a triggering unit that senses and generates surveillance signals to trigger an alarm. The non-limiting examples of EAS tags 281 may include a magnetically sensitive device, a Radio Frequency (RF) sensitive device, or others. A non-limiting example of a magnetic sensitive device is a signal detector in the form of a ferrite coil, and a non-limiting example of the surveillance signal may be a magnetic signal that is detected by the ferrite coil. Ferrite coils are well-known, and can have various types of coil configurations.

When an article with the attached EAS tag 281 is passed in between the transmitter and receiver pedestals (brought within the surveillance zone of the EAS system), the EAS tag 281 responds to the specific frequency signal emitted by the transmitter antenna. The EAS tag 281 then transmits an EAS tag signal, which is picked up by the adjacent receiver antenna to activate an appropriate response (e.g., trigger an alarm).

The timing of the transmission by the EAS tag may vary, depending on the EAS system. As a non-limiting example, the acousto-magnetic EAS systems operate by transmission of pulsed rather than continuous signals. When the EAS tag of an EAS acousto-magnetic system is brought within the surveillance zone of an acousto-magnetic system, the EAS tag responds to the RF pulses from the transmitter, and emits a specific frequency signal only in between the signal pulses from the EAS acousto-magnetic systems transmitter. This radiation of signal from the EAS tag is detected by the EAS acousto-magnetic receiver, and analyzed by a computer for appropriate signal characteristics (e.g., signal frequency, amplitude, repetition rate, etc.) to determine a corresponding set of actions (e.g., trigger an alarm).

The present invention provides an article surveillance system that includes and combines multiple individual electronic article surveillance systems within a shared space of a pedestal system, despite their differences in fundamental physics, technology, and operational principles. The resulting synergy from the combined systems provides a robust surveillance system that overcomes the weakness of each individual system if implemented separately, improving the overall surveillance capability. FIG. 1A-1 as an exemplary schematic (or "representative") illustration of an electronic article surveillance system in accordance with one embodiment of the present invention. As illustrated, the electronic article surveillance (EAS) system 100 of the present invention is comprised of a combined plurality of independent surveillance systems that are physically located within a pedestal system 101. The pedestal system 101 may be comprised of one or a plurality of individual pedestals, and be construed as a "transmitting" pedestal, a "receiving" pedestal, or a "transceiver" pedestal.

Figures 1, 1A, 2:
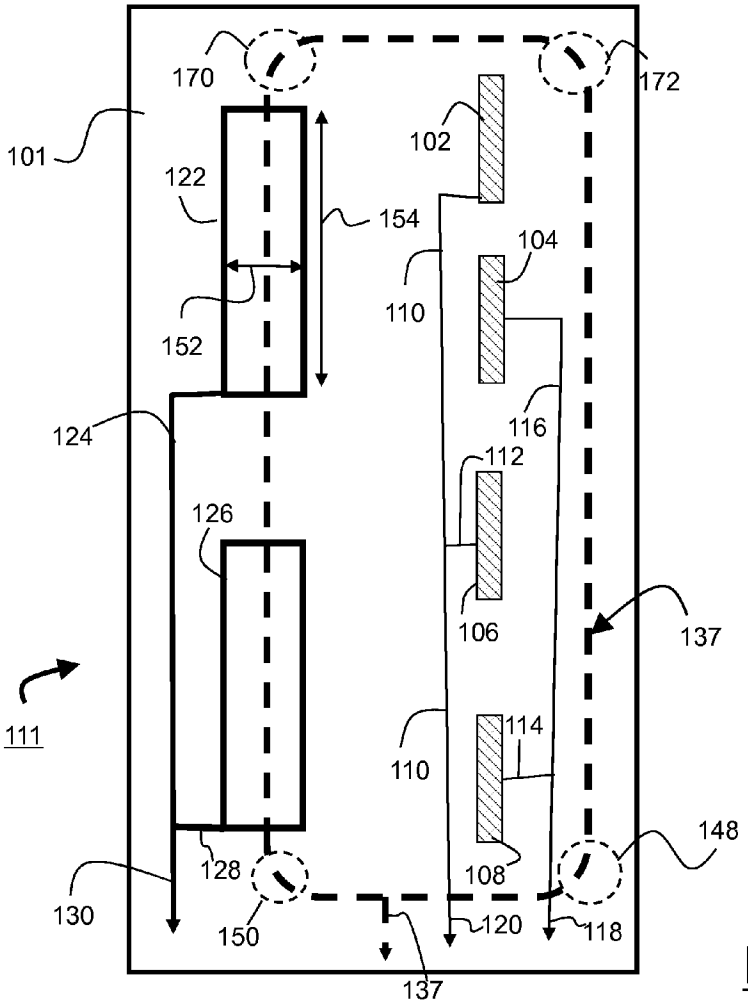
Figures 1, 1A, 2, 3:
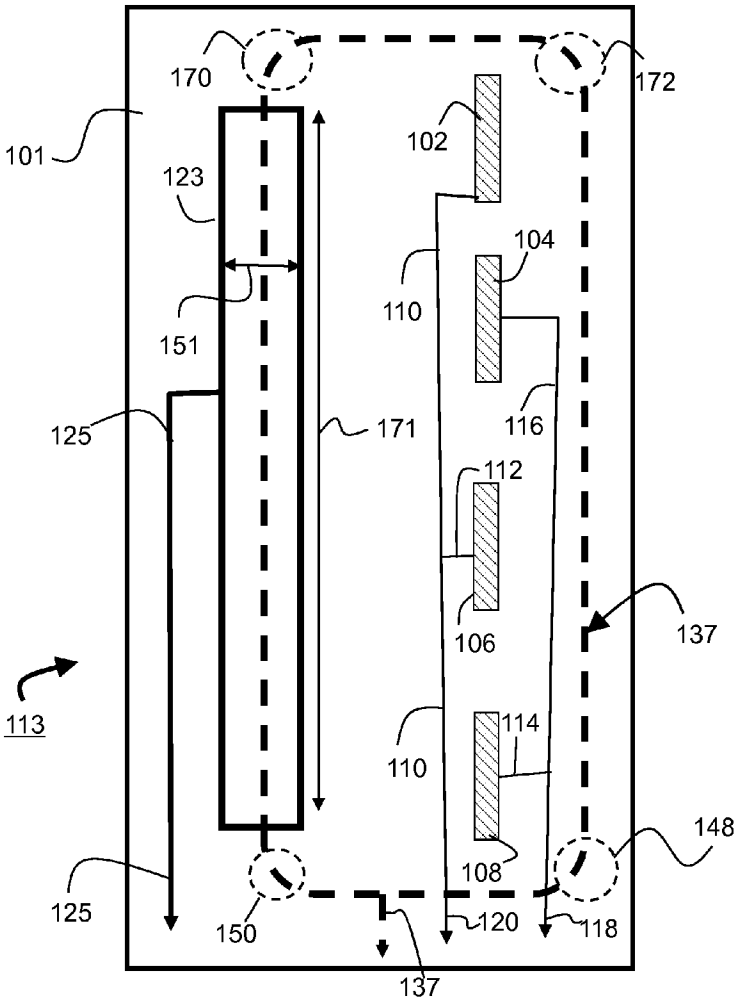
Figures 1, 1A, 2, 3, 4:
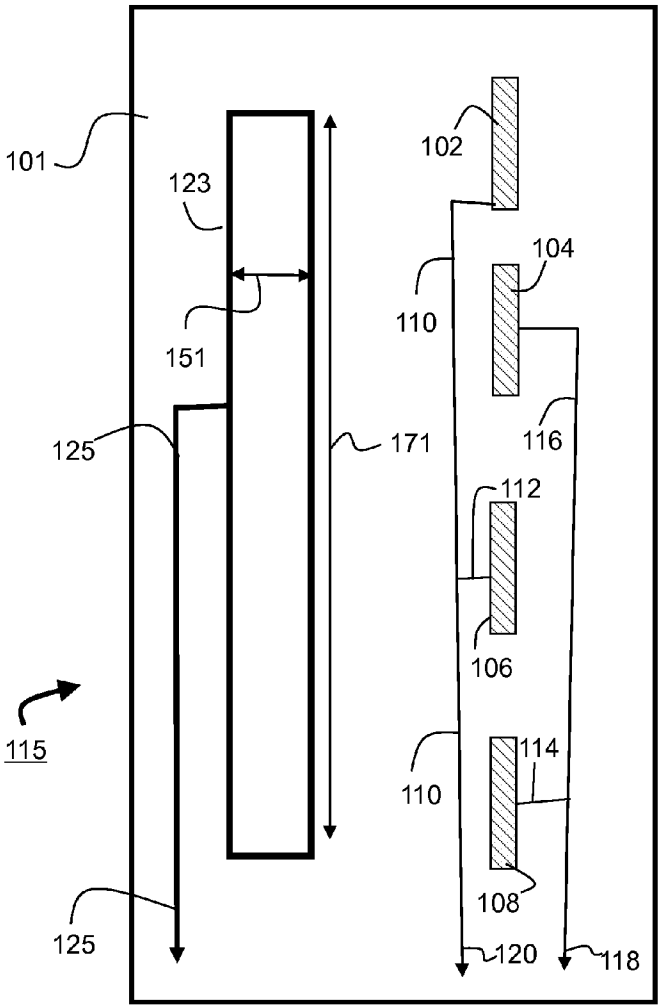
Figures 1, 1A, 2, 3, 4, 5:
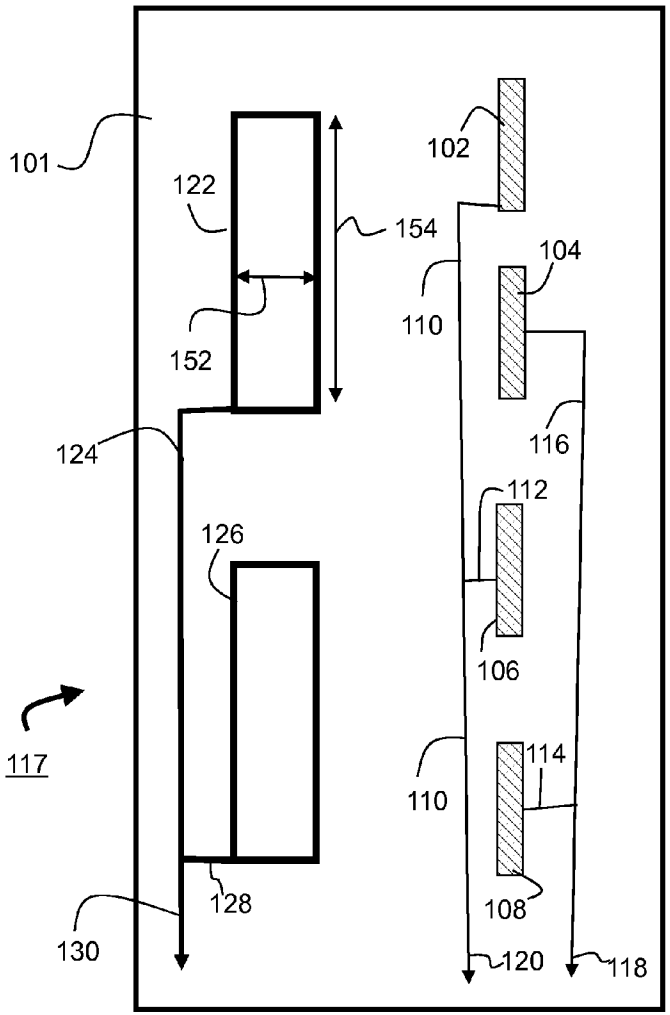
Figure 1B:
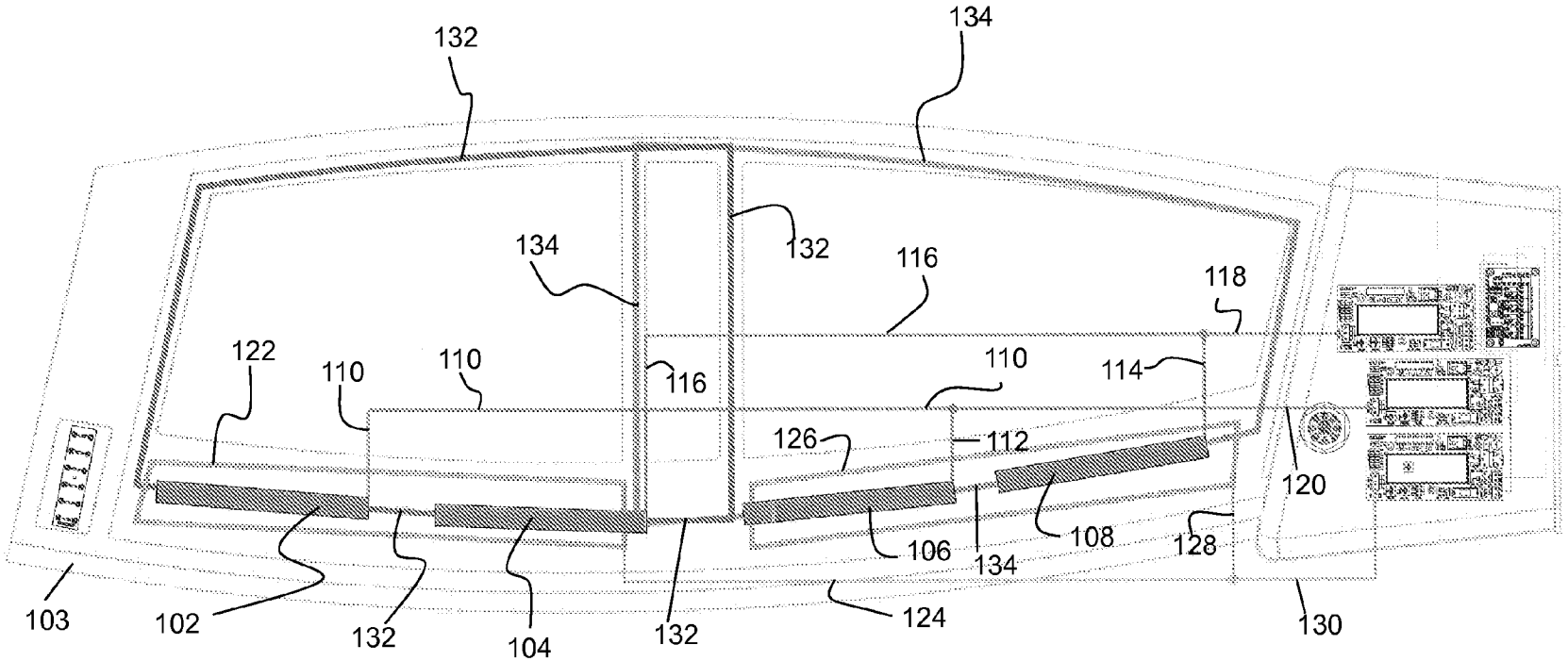
FIGS. 1B, 1C, and 1D are exemplary illustration of the EAS system of FIG. 1A-1, with FIG. 1B illustrating a front side of a representative "receiver" pedestal, FIG. 1C illustrating a front side of a representative "transmitter" pedestal, and FIG. 1D illustrating a rear side of the representative "transmitter" and "receiver" pedestals in accordance with the present invention.
Figure 1C:
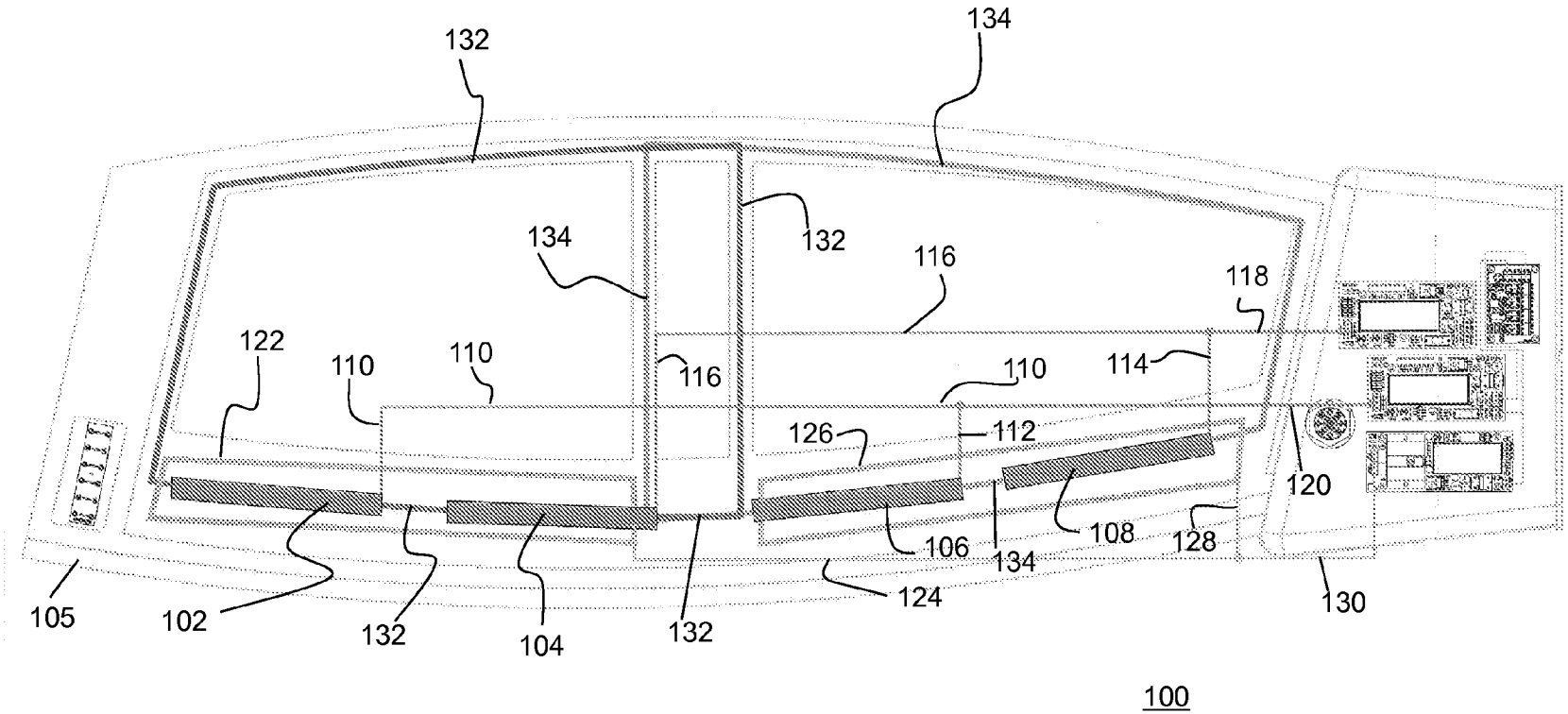
Figure 1D:
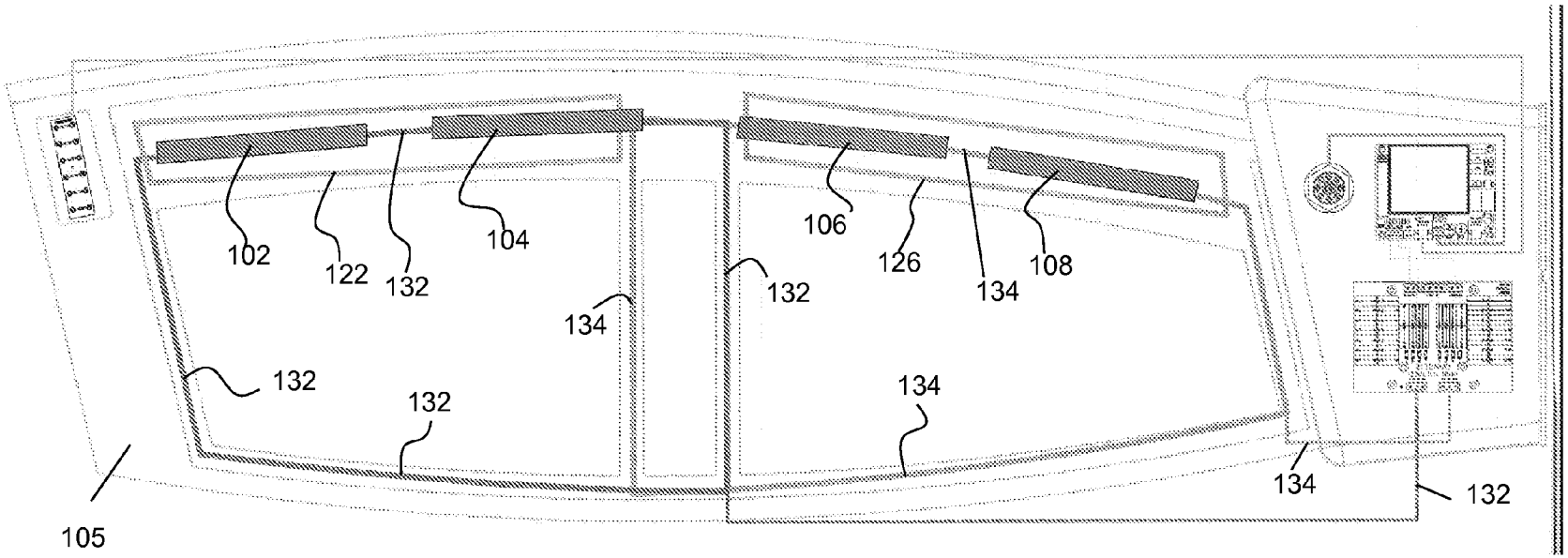

FIGS. 1B, 1C, and 1D are exemplary illustration of the EAS system 100 of the present invention shown in FIG. 1A-1, with FIG. 1B illustrating a front side of a "receiver" pedestal 103, FIG. 1C illustrating a front side of a "transmitter" pedestal 105, and FIG. 1D illustrating a rear side of the "transmitter" and "receiver" pedestals 103 and 105. Accordingly, the pedestal systems 101 in FIG. 1A-1 may be configured as a "transmitting" pedestal 105 (FIG. 1C) with respective transmitting antennas for the various systems connected to transmitting electronic boards within the pedestal 105 to transmit signals to their respective counter-part receiving antennas that are connected to receiving electronic boards within a "receiving" pedestal 103 (FIG. 1B).

As detailed below, given that the electronic article surveillance (EAS) system 100 of the present invention combines a plurality of independent surveillance systems, the mere classification of a pedestal as a "transmitting" pedestal or a "receiving" pedestal is not sufficient. For example, as further detailed below, the electronic article surveillance (EAS) system 100 within the pedestal system 101 includes a magnetic EAS system 200 (FIG. 2A) that detects a magnetic EAS tag 285 (FIG. 2A-3), a magnetic detachers, or other magnets within its surveillance zone. It should be noted that a non-limiting example of a magnetic detacher is a permanent magnet that may be used for detaching EAS acousto-magnetic (AM) hard tags, for deactivating AM sticker labels, and so on. As detailed below, smart magnet detector configuration of the magnetic EAS system 200 of present invention suppresses the detection of commonly used magnets. This system is passive with antennas that function only as receiving antennas, which may be included in both a "transmitting" pedestal 105 and a "receiving" pedestal 103. As another example (and detailed below), the electronic article surveillance (EAS) system 100 within the pedestal system 101 also includes an anti-Farrady shielding EAS system 300 (FIGS. 3A-1 and 3A-2) that detects Faraday shields in the form of a "booster bag." In this exemplary instance, the system 300 includes a transmitting antennas within the "transmitting" pedestal 105 and receiving antennas within the "receiving" pedestal 103. As a final example, and also as detailed below, the electronic article surveillance (EAS) system 100 within the pedestal system 101 also includes an acousto-magnetic EAS system 400 (FIGS. 4A-1 and 4A-2) that also transmits and receives signals. That is, the system 400 may include a transmitting antennas within the "transmitting" pedestal 105 and receiving antennas within the "receiving" pedestal 103. However, in the case of the EAS system 400, the system may also be configured into a single "transceiver" pedestal where the EAS system 400 can operate in a first mode to transmit signals as well as in a second mode of operation to receive signals within a single "transceiver" pedestal. Accordingly, throughout the disclosure the terms "transmitter pedestal," "receiver pedestal," or "transceiver pedestal" should be construed in light of the context of the particular EAS system discussed.

Referring to FIG. 1A-1 and as stated above, the electronic article surveillance (EAS) system 100 of the present invention has combined several fully independent and autonomous, individual EAS systems with differences in fundamental physics, technology, and operational principles into a pedestal system 101, while maintaining the individual differences in the fundamental physics, technology, and operational principles for each EAS system. Stated in another way, the electronic article surveillance (EAS) system 100 of the present invention provides all the advantages afforded by each individual EAS system, providing a robust surveillance system that overcomes the weaknesses of each system if implemented separately to thereby synergistically improve the overall surveillance capability.

As further illustrated in FIG. 1A-1, all the antennas (as transmitter, receiver, or transceiver antennas) for all systems are physically located inside the pedestal system 101, and all operate independently and autonomously in accordance with their respective fundamental physics, technology, and operational principles. The electronic article surveillance (EAS) system 100 of the present invention has minimized (to a negligible amount) the flux interferences between the antenna systems due to their physical close proximity with one another. That is, the physical disposition in terms of, for example, shape, size, location, orientation, number and orientation of windings, and etc. of each individual antenna for each individual system within the pedestal system 101 is mutually arranged to minimize flux interferences, while maintaining their respective independent and autonomous operational principles. Accordingly, the mutual arrangement, orientation, and actual physical positioning of the various EAS antennas within a shared space of a pedestal will vary commensurate with the antenna and pedestal configuration to achieve minimal flux interference while maintaining independent and autonomous operational principles of each individual EAS system. As a non-limiting example, the EAS antennas of the EAS system 100 will have different configurations and mutual positions if a smaller, but oval shaped pedestal is used instead of that which is illustrated in FIGS. 1A-1, 1B, 1C and 1D to attain negligible flux interference, while maintaining independent and autonomous operational principles of each individual EAS system.

Figures 1, 2A:
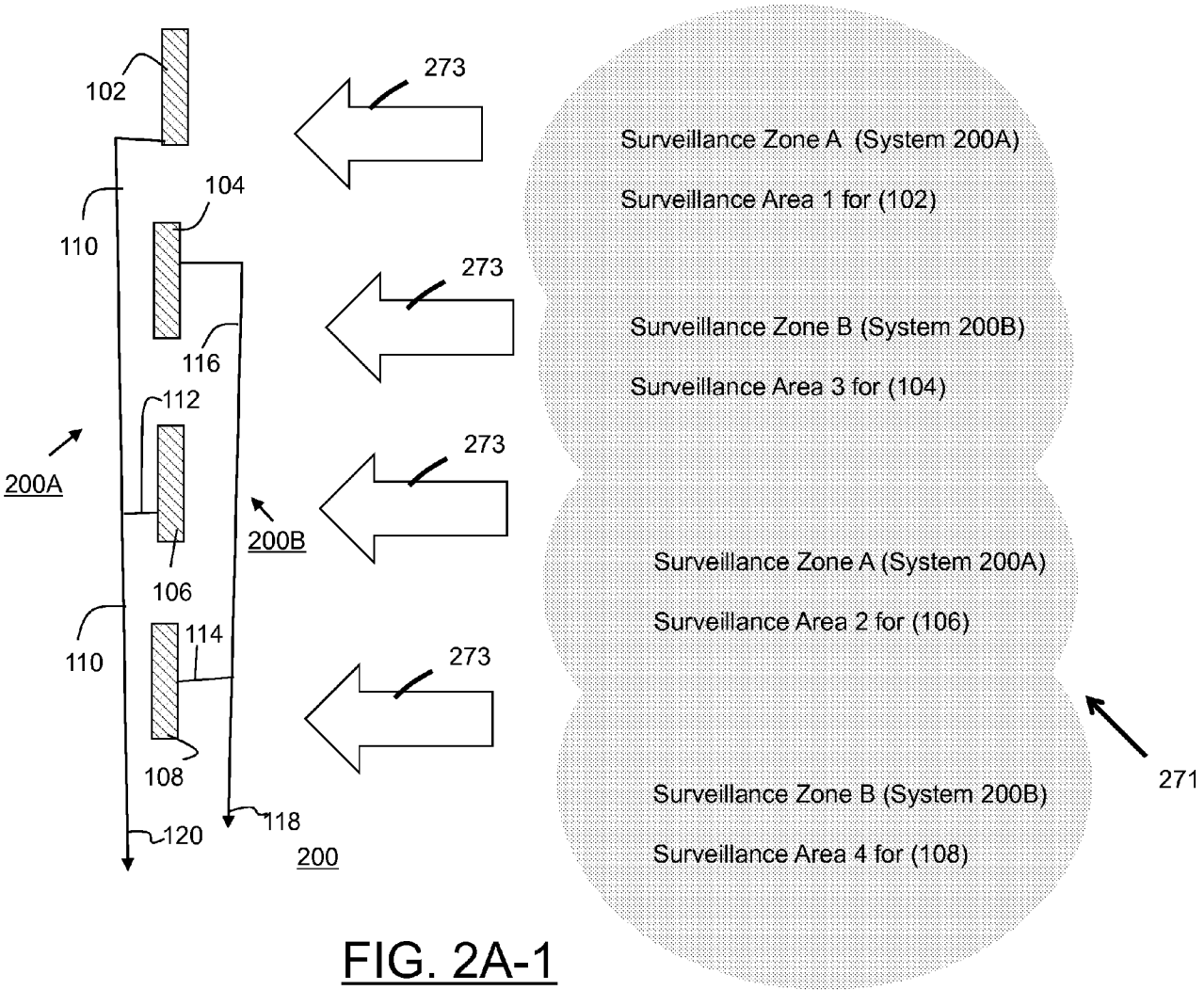
Figures 2, 2A:
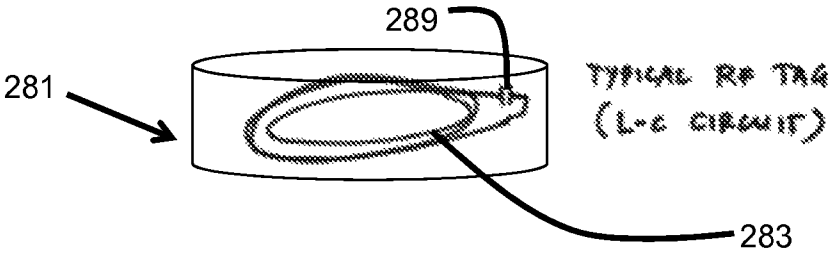
Figures 2, 2A, 3:
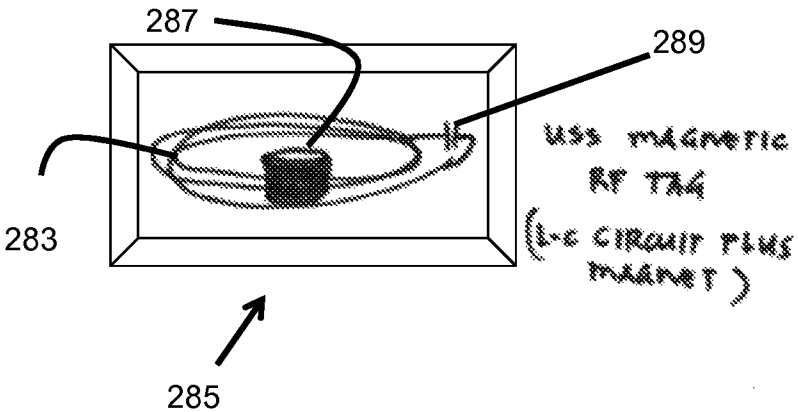

The electronic article surveillance (EAS) system 100 within the pedestal system 101 includes a magnetic EAS system 200 (FIG. 2A) that detects a magnetic EAS tag 285 (FIGS. 2A-3), or other magnets such as a magnetic detacher within its surveillance zone. The magnetic detacher is powerful magnet that has a suitable magnetic strength that enables the release and removal of an EAS tag from an article to which the tag is attached. The arrangement of system 200 enables detection of an article with a magnetic EAS tag 285 attached, even if a Faraday cage (e.g., a "booster bag") is used in an attempt to shield the magnetic EAS tag. As illustrated in FIGS. 2A-3, the present invention provides the magnetic EAS tags 285 that contain magnetic element 287 inside a plastic body, enabling the detection thereof by the magnetic EAS system 200.

As has been stated above, in general, an EAS tag 281 is device that can create a disturbance in the electrical field of an EAS system, which, in turn, will cause the EAS system to alarm. Most conventional EAS systems are sensitive only to disturbance of the electric field caused by a tuned circuit within the EAS tag 281 that disrupts their electric field. This disturbance is processed by the EAS system to trigger an alarm depending on the requirements for the alarm. The present invention adds a system sensitive to a magnet 287 to produce a new system that is sensitive to both electric and magnetic fields.

In particular, as illustrated in FIGS. 2A-3 the present invention provides an inductor-capacitor (L-C) 283 and 289 tag 285 made up of a length of conductor wire coiled into several loops 283 and terminated with a shunt capacitor 289. The frequency of this coil-capacitor combination 283-289 is set so that the magnetic EAS tag 285 of the present invention is resonant with the EAS system. The present invention further provides a magnet 287 placed in the middle of the coil 283, which will create a shift in the resonant frequency of the magnetic EAS tag 285. This shift from resonance is corrected by modifying the L-C 283-289 properties so to set the magnetic EAS tag 285 of the present invention to resonance. The adjustments of the resonance of the L-C circuit 283-289 enables the ability to embed the magnet 287 at the center of the coil 283 and continue to have the L-C 283-289 tuned to the resonant frequency of the EAS system to thereby avoid false alarm. The magnetic EAS tag 285 of the present invention will function like an ordinary EAS tag 281 but will also be immune to the "Electric Field" shielding effects of foil-lined or other Faraday Shields due to the embedded magnet 287 within the magnetic EAS tag 285 of the present invention.

Further included in the electronic article surveillance (EAS) system 100 is an anti-Faraday shielding EAS system 300 (FIGS. 3A-1 and 3A-2) that detects Faraday shields used by shoplifters. Accordingly, if a magnetic EAS tag is not used, but instead a non-magnetic EAS tag (e.g., RF EAS tag) is used inside a booster bag to shield its effects, the anti-Faraday shielding system 300 will detect the shielding material and notify store personnel.

In addition to the above systems, electronic article surveillance (EAS) system 100 of the present invention also includes an acousto-magnetic EAS system 400 (FIGS. 4A-1 and 4A-2) that detects an acousto-magnetic EAS tag (not shown). The present invention further provides a signal jammer prevention routine that prevents jamming of transceiver signals. It should be noted that all systems are overlapped to fit within a reasonably wide pedestal system 101.

As stated above, the electronic article surveillance (EAS) system 100 of the present invention includes within the pedestal system 101 the magnetic EAS system 200, which has a plurality of electromagnetic systems. As illustrated in FIGS. 1A-1 and 2A, the magnetic EAS system 200 is comprised of a plurality of electromagnetic systems 200A and 200B that include a plurality of magnetic sensors, with the plurality of magnetic sensors comprised of a core having ferromagnetic material with high magnetic permeability, and a conductor wound around the core. The first electromagnetic system 200A and the second electromagnetic system 200B are fully independent of and autonomous from one another, and have independent surveillance zones that overlap to eliminate potential detection-holes or "blind-spot," the reasons for which are detailed below.

In general, the first electromagnetic system 200A provides for a first surveillance zone "A" and the second electromagnetic system 200B provides for a second surveillance zone "B" that is different from the first surveillance zone "A," with an area of the first surveillance zone "A" and the second surveillance zone "B" overlapping to fully cover any possible "blind-spots" for a complete surveillance zone of the electronic article surveillance (EAS) system 100 of the present invention.

More specifically, a first magnetic sensor 102 of the plurality of magnetic sensors is coupled with a second magnetic sensor 106 of the plurality of magnetic sensors to form the first electromagnetic system 200A that provides the first surveillance zone "A," and a third magnetic sensor 104 of the plurality of magnetic sensors is coupled with a fourth magnetic sensor 108 of the plurality of magnetic sensors to form the second electromagnetic system 200B that provides the second surveillance zone "B."

The position (or physical location) of the first and second electromagnetic systems 200A and 200B of the electromagnetic EAS system 200 in relation to the other EAS systems within the pedestal 101 may be varied without having an effect on other systems because system 200 is a passive system. That is, the electromagnetic EAS system 200A and 200B only receive "or pick-up" magnetic tag signals from their respective surveillance zones "A" and "B." Further, for simplicity of calculations and best results in terms of ensuing overlapping surveillance zones with minimal or zero detection "holes" or blind spots, it is generally preferred (but, without limitation) that the exemplary magnetic sensor 102, 106, 104, and 108 of both electromagnetic systems 200A and 200B have their axial-centers aligned longitudinally, with their respective ends equally distanced from one another in the illustrated vertical orientation.

As illustrated in FIG. 2A, for the electromagnetic EAS system 200A that provides for detection from the surveillance zone "A," the first magnetic sensor 102 generates a first detection signal based on its surveillance area 1 and the second magnetic sensor 106 generates a second detection signal (based on its surveillance area 2) that is equal but opposite in polarity (out of phase) to the first signal. The opposite polarity first and second detection signals are for suppression and prevention of false alarms when an EAS magnetic tag 285 is detected substantially equidistant from both the respective first and second magnetic sensors 102 and 106. This scheme prevents false alarm (detailed further below), but generates blind spots or detection holes (detailed below) between the overlapping surveillance areas 1 and 2 of the surveillance zone "A."

As further illustrated in FIG. 2A, the third magnetic sensor 104 of the electromagnetic EAS system 200B generates a third detection signal based on its surveillance area 3 and the fourth magnetic sensor 108 generates a fourth detection signal based on its surveillance area 4, the combination of which constitute the surveillance zone "B" of the electromagnetic EAS system 200B. The fourth detection signal is equal but opposite in polarity to the third detection signal for suppression and prevention of false alarm when the EAS magnetic tag 285 is detected substantially equidistant from both the respective third and fourth magnetic sensors 104 and 108. However, this scheme also generates blind spots (detailed below) between the overlapping surveillance areas 3 and 4 of the surveillance zone "B."

In general, equal but opposite polarity signals (or out of phase signals) may be generated by numerous well-known methods, a few non-limiting examples of which may include different winding orientation of the conductor around the core (e.g., with one wound clockwise, and another counterclockwise) or different winding connection schemes of the conductor(s) around the core(s) that result in equal but opposite polarity signals. Accordingly, for example, the magnetic sensor 102 of the electromagnetic system 200A may have a winding that is wound clockwise, and the magnetic sensor 106 of the same system 200A may have a winding that is wound counterclockwise to generate equal but opposite polarity electrical signals. As another specific non-limiting example, both magnetic sensors 102 and 106 may have conductor(s) wound in the same direction, but with conductor end connections that result in output signals with equal but opposite polarity electrical signals. The conductors are wound about the cores along a substantial longitudinal axial length of the cores. It should be noted that the individual components that constitute each magnetic sensor may vary in their respective aspects so long as the resulting electrical component (the final magnetic sensor) are electrically equal (e.g., provide substantially identical electrical output signals, e.g., equal voltage) with a correction for the phase of the output signal. That is, core, conductor, and the number of turns of the conductor wound around the core may vary in every aspect (e.g., core length, permeability, conductor type, winding direction, etc.) for each magnetic sensor so long as the resulting electrical components are electrically equal, with correction for the phase signal of each magnetic sensor.

Referring back to FIG. 2A and as stated above, the present invention uses a pair of magnetic sensors that generate electrical detection signals with equal but opposite phases that cancel one another when detecting an object having a distance that is substantially equal to both magnetic sensor pairs, preventing false alarm. For example, if a single magnetic sensor is used (e.g., using only the magnetic sensor 102 and no others), then this single magnetic sensor 102 will detect any article to which a magnetic EAS tag 285 or other magnetic material is coupled, within and outside its surveillance area and trigger an alarm. For example, a magnetically tagged article may be moved within a store by a store personal (e.g., an article of clothing with the attached tag 285 moved around at the back of the store), outside the surveillance zone of the pedestal system 101. In this exemplary instance, the hypothetical single magnetic sensor 102 will detect the movement of the tagged article and trigger a false alarm. Therefore, to overcome the problems of using a single magnetic sensor that will detect magnetic objects and trigger an alarm regardless of location of the tagged objects, the present inventions uses a pair of magnetic sensors that generate detection signals with equal but opposite polarity. The generated equal but opposite polarity signals cancel one another when detecting an object having a distance that is substantially equal to both magnetic sensor pairs, preventing false alarm.

An object that is far from the pedestal system 101 will generally have a substantially equal distance from each of the individual magnetic sensors within the system 200A or 200B. Accordingly, a much longer distance D1 between a magnetic EAS tag 285 and the first magnetic sensor 102 and a much longer distance D2 between the same EAS tag 285 and the second magnetic sensor 106 will substantially be equal ($D1 \neq D2$), given the much shorter distance (close proximity) of both the respective first and the second magnetic sensor pairs 102 and 106. Such detection will not trigger the alarm because the signal generated by the pair (102 and 106) would be of equal, but opposite phase, canceling one another. Accordingly, this overcomes the problems of using a single magnetic sensor, which will detect magnetic objects and trigger false alarm regardless of whether the objects are within the surveillance zone or not. However, as also described above, generation of equal but opposite detection signals generates detection holes within the surveillance zones.

When a magnetic EAS tag 285 is within the surveillance zone (near any of the magnetic sensor pair), but still equally distanced away from both pair of magnetic sensors (e.g., 102 and 106), the same cancellation of detection signals (e.g., generated by 102 and 106) will occur within the surveillance zone, generating a "blind spot" within the surveillance zone itself with no activation of an alarm. To obviate the problem associated with the "blind spot," the present invention uses two electromagnetic systems 200A and 200B with overlapping surveillance zones. In other words, the first surveillance zone "A" overlaps the second surveillance zone "B" to cover potential blind spots of the surveillance areas 3 and 4 of the zone "B," and the second surveillance zone "B" overlaps the first surveillance zone "A" to cover potential blind spots of the surveillance areas 1 and 2 of the zone "A."

As stated above, for simplicity of calculations and best results in terms of ensuing overlapping surveillance zones with the least amount of detection "holes" or blind spots, it is generally preferred that the exemplary magnetic sensors 102, 106, 104, and 108 of both electromagnetic systems 200A and 200B be equally distanced from one another, preferably with their axial-centers aligned longitudinally in the illustrated vertical orientation. This results in the exemplary collective surveillance zone 271 from within which a magnetic signal 273 from a magnetic EAS tag may be detected or "picked-up" by the respective electromagnetic systems 200A and 200B, with no detection "holes" or blind-spots in between surveillance areas and zones, and no false alarm when the magnetic tags are moved around outside the surveillance zone.

Figures 2, 3A:
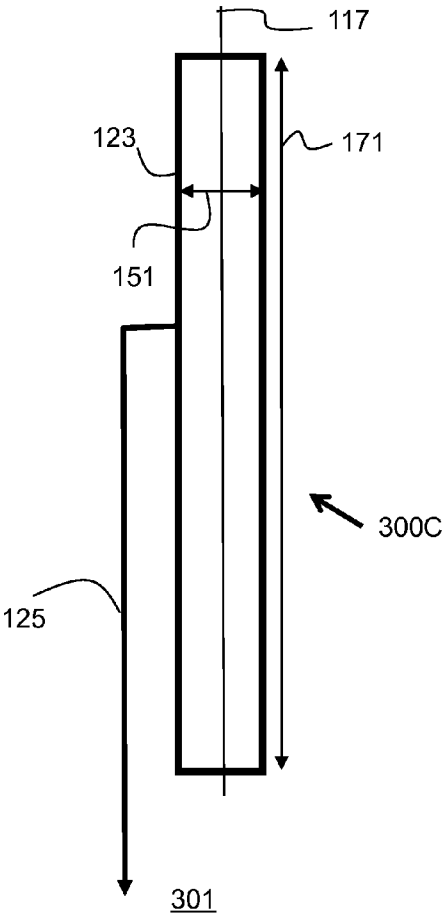
Figures 1, 3A:
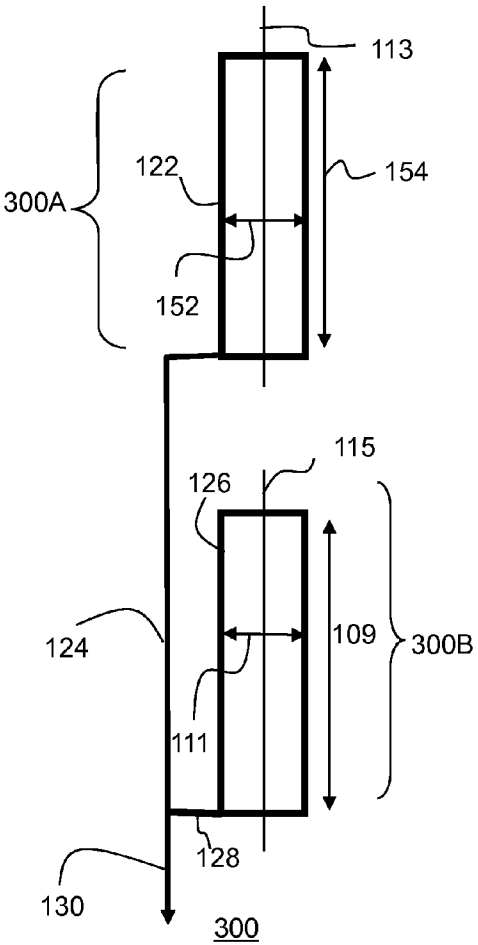

Referring back to FIG. 1A-1 and further to FIG. 3A-1, the electronic article surveillance (EAS) system 100 of the present invention further includes an anti-Faraday shielding EAS system 300 (FIG. 3A-1) that detects Faraday shields in a form of a "booster bag" used by shoplifters. Accordingly, if a magnetic EAS tag or a non-magnetic EAS tag (e.g., a RF EAS tag) is used and placed inside a booster bag to shield its effects, the anti-Faraday shielding system 300 will detect the shielding material, preventing shoplifting.

Figures 2, 4A:
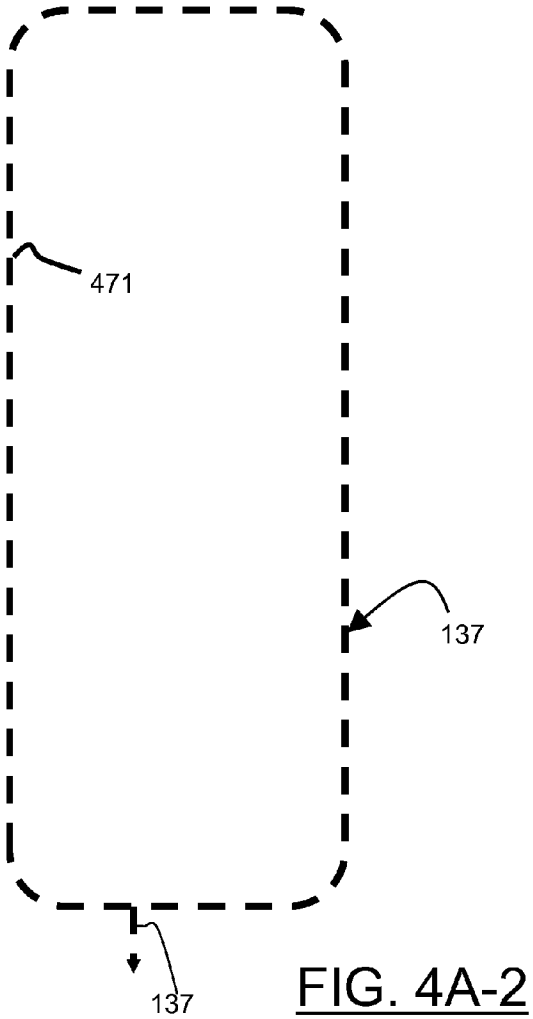
Figures 1, 4A:
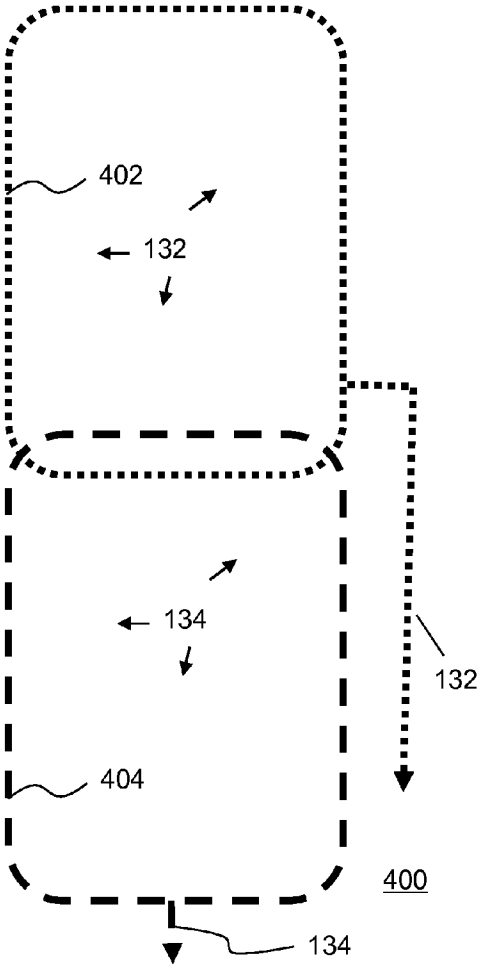

The anti-Faraday shielding EAS system 300 is comprised of a first anti-Faraday shielding EAS system 300A having a first inductor coil 122 and a second anti-Faraday shielding EAS system 300B having a second inductor coil 126, with the first anti-Faraday EAS shielding system 300A coupled with the second anti-Faraday shielding EAS system 300B. The first inductor coil 122 has a first air-core with a first width 152, a first axial length 154, and a first axial center 113, with the first inductor coil 122 wound around the first air-core along an entire first longitudinally axis of the first air-core. The second inductor coil 126 has a second air-core with a second width 111, a second axial length 109, and a second axial center 115, with the second inductor coil 126 wound around the second air-core along an entire second longitudinally axis of the second core. It should be noted that in this instance, both windings 122 and 126 are in the same direction. As further illustrated, the first air-core is located above the second air-core, with the first axial center 113 aligned parallel (and within the same plane) as the second axial center 115. As best illustrated in FIGS. 1A-1 and 4A-1, a first straight section 402 of a first winding 132 of the acousto-magnetic EAS system 400 is passed through the first axial center 113, and a second straight section 404 of a second winding 134 of the acousto-magnetic EAS system 400 is passed through the second axial center 115. This arrangement minimizes flux interference between anti-Farrady shielding EAS system 300 and the acouso-magnetic EAS system 400.

It should be noted that the anti-Faraday shielding EAS system 300 may comprise of a single, elongated inductor core, which can function as an isolated or independent unit. However, given its proximity to the antennas 132 and 134 of the acousto-magnetic EAS system 400, the anti-Faraday shielding EAS system 300 is split into the first and second anti-Faraday shielding EAS system 300A and 300B to minimize flux interferences. Further, in order to tune the antennas of all the system to a resonant frequency to neutralize flux interferences, the position and orientation of the first and the second anti-Faraday shielding EAS system 300A and 300B are arranged along the straight sections 402 and 404 of the acousto-magnetic EAS system 400. This obviates difficulty in calculating and tuning of the antennas by avoiding the curved sections 140, 142, 144, 146, 148, and 150 of the antennas 132 and 134. Further, the position, location, and orientation of the first and second anti-Faraday shielding EAS system 300A and 300B along the straight sections 402 and 404 of the acousto-magnetic EAS system 400 enables the switching of the antennas 132 and 134 from an "8" to an "O" configuration or vice versa during installation (prior to operation of the system 400), with negligible flux interferences. Finally, placement of the first and the second anti-Faraday shielding EAS system 300A and 300B as illustrated will cover the entire length of the pedestal system 100, providing a longer surveillance zone (the entire length of an individual that passes through the surveillance zone).

As best illustrated in FIGS. 1A-1 and 4A-1 and described above, the EAS system 100 further includes the acousto-magnetic EAS system 400 that includes an antenna having a first upper coil (or loop) 132 and a second lower coil (or loop) 134, with a bottom of the first upper coil 132 overlapping a top section of the second lower coil 134. The corners 140, 142, 144, 146, 148, and 150 of the first upper coil 132 and the second lower coil 134 are rounded, forming a substantially rectangular configuration with curved corners.

It should be noted that the use of two coils 132 and 134 and their overlapping scheme is important if prior to installation and operation, the system 400 is configured to output signals that are out of phase with respect to one another during the operation of the system 400. In addition, the use of two coils and their overlap also provides the ability to configure system 400 (prior to installation and operation) to output signals that are only in phase during operation of the system 400, but without having to reconfigure the physical location of the rest of the antennas for the other EAS systems within the shared space of the pedestal. That is, although only a single coil (FIG. 1A-2) may be used to generate output signals that are in-phase during the operation of the system 400, the use of the two coils 132 and 134 and their overlapping scheme enables configuration of the entire EAS system 100 within a pedestal system 101 once, while providing the option to an installer who implements the EAS system 100 to determine if the system 400 is to output out of phase signals only, or, alternatively, output only in phase signals during its operation without modifying any other aspect of the other EAS systems.

Therefore, the first and the second coils 132 and 134 can be configured to generate and transmit a respective first signal and a second signal in a first mode of operation, defining a surveillance zone for an EAS tag. The first and the second signals may have a respective first and second signal phase characteristics that are maintained during normal operations, with no substantial changes in respective signal phases. In other words, they are either in phase only, or alternatively, they are configured to transmit signals that are out of phase, only.

FIGS. 1A-2 to 1A-5 are exemplary schematic (or "representative") illustration of electronic article surveillance system in accordance with other embodiments of the present invention. FIGS. 1A-2 to 1A-5 are exemplary illustrations of respective EAS systems 111, 113, 115, and 117 that include similar corresponding or equivalent components, interconnections, and or cooperative relationships as the EAS system 100 that is shown in FIG. 1A-1, and described above. Therefore, for the sake of brevity, clarity, convenience, and to avoid duplication, the general description of FIGS. 1A-2 to 1A-5 will not repeat every corresponding or equivalent component and or interconnections that has already been described above in relation to EAS system 100 that is shown in FIG. 1A-1.

FIG. 1A-2 is an exemplary illustration of an EAS system 111 that includes an acousto-magnetic EAS system having an antenna that is comprised of a single coil 137 (also in FIG. 4A-2). A control unit (detailed below) is coupled with the antenna 137 for generating and transmitting a signal to define a surveillance zone for an EAS tag, and for receiving signals from the surveillance zone. The transmitted signal has a signal phase characteristic (e.g., in-phase) that is maintained during normal operations, with no substantial changes in the signal phase. The control unit processes the received signals from the surveillance zone and generates an alarm based on a predetermined condition, and without effecting generation and transmission of signals that defines the surveillance zone.

FIG. 1A-3 is an exemplary illustration of an EAS system 113 that is similar to that of FIG. 1A-2 with the difference that EAS system 113 uses a single, elongated inductor core 123 as its anti-Farrady shield EAS system 300. That is, if a single antenna coil 137 is used for the acousto-magnetic EAS system 400 to output an in-phase signal, the anti-Faraday shielding EAS system 300 need not be split into two to minimize flux interferences. Instead, only a single anti-Faraday shielding EAS system 300C (FIG. 3A-2) may be used and further, in order to tune the antennas of all the system to a resonant frequency to neutralize flux interferences, the position and orientation of the anti-Faraday shielding EAS system 300C may also be arranged along the straight sections 471 (FIG.

4A-2) of the acousto-magnetic EAS system antenna 137. This obviates difficulty in calculating and tuning of the antennas by avoiding the curved sections 150, 118, 170 and 172 of the antennas 137. Finally, placement of the first and the second anti-Faraday shielding EAS system 300C as illustrated will cover the entire length of the pedestal system 113, providing a longer surveillance zone (the entire length of an individual that passes through the surveillance zone). As best illustrated in FIGS. 1A-3 and 3A-2, the inductor coil 125 has an air-core 123 with a width 151, an axial length 171, and an axial center 117, with the inductor coil 125 wound around the air-core 123 along an entire longitudinal axis of the air-core 123, with the straight section 471 of the antenna 173 passed through the axial center 117 of the air-core 123.

FIG. 1A-4 and FIG. 1A-5 are exemplary illustrations of respective EAS systems 115 and 117 that only include anti-Faraday shield EAS system 300 and an electromagnetic EAS system 200, with FIG. 1A-4 using one anti-Farrady shield EAS systems 300C (FIG. 3A-2), and FIG. 1A-5 using two anti-Faraday shield EAS systems 300A and 300B (FIG. 3A-1).

As stated above, FIGS. 1B, 1C, and 1D are exemplary illustration of the EAS system 100 of the present invention that is installed in a different shape pedestal system 101, with FIG. 1B illustrating a front side of a receiver pedestal 103, FIG. 1C illustrating a front side of a transmitter pedestal 105, and FIG. 1D illustrating a rear side of the transmitter and receiver pedestals 103 and 105. As illustrated in FIGS. 1B, 1C, and 1D, the electromagnets of the electromagnetic EAS system 200 and the straight sections 402 and 404 of the acousto-magnetic EAS system 400 are aligned along the first and second axial centers 113 and 115 of the inductor cores 122 and 126 of the anti-Faraday shielding EAS system 300 to minimize flux interferences. Accordingly, the illustrated different EAS system antennas are configured to have mutual positions commensurate with the available shared space within a pedestal to achieve the minimal flux interference, while maintaining independent and autonomous operational principles of each individual EAS system.

Tuning of the EAS system 100 for the least signal noise (minimum flux interference) begins with the acousto-magnetic EAS system 400 because the antenna loops of the system 400 are fixed in position (e.g., permanently attached) to the interior surface of the pedestal and cannot be moved for adjustments. In turning the system 400, the inductance/capacitance of a transmitter board of a control unit (detail below) is tuned (matched) to the inductance (i.e., resonant frequency) of the system 400 antenna coils. Thereafter, the anti-Faraday shield EAS system 300 is installed and signals from the acousto-magnetic EAS system 400 are transmitted from a transmitter pedestal to a receiver pedestal that includes the receiver antennas of the EAS system 300. The transmitted signal bursts from EAS system 400 are unrecognizable to EAS system 300 and therefore are seen or detected as mere signal noise, which are measured. Thereafter, while continuously measuring this "signal noise," the physical positions of the antennas of the EAS system 300 are gradually moved to a location with the least detected or measured signal noise. In the exemplary instances illustrated in the figures, this position for the EAS system 300 antennas is found to be along the straight sections of the antennas of the EAS system 400.

It should be noted that unlike the electromagnetic EAS system 200, the anti-Faraday shielding system 300 and the acousto-magnetic EAS system 400 are not passive and are capable of both a transmitting mode and a receiving mode of operations. Accordingly, the transmission signals of one system (e.g., anti-Faraday shielding system 300) may affect or influence the reception capability or quality of another system (e.g., acousto-magnetic EAS system 400). That is, the transmitted signal from one system (e.g., from anti-Faraday shielding system 300) is simply noise to the receiving counter part of another system (e.g., acousto-magnetic EAS system 400). As a non-limiting example, the anti-Faraday shielding system 300 within an exemplary transmitting pedestal 105 (FIG. 1C) may transmit a signal to a counter-part anti-Faraday shielding system 300 within a receiving pedestal 103 (FIG. 1B). However, the acousto-magnetic EAS system 400 within the receiving pedestal 103 (FIG. 1B) will also receive the same signal that is transmitted by the anti-Faraday shielding system 300, but this signal is simply noise to system 400, which may influence and affect the reception capability or quality of operation of the acousto-magnetic EAS system 400. The same is true when the acousto-magnetic EAS system 400 transmits its signal bursts from the exemplary transmitting pedestal 105, which is received by a corresponding receiving pedestal 103 that also includes an anti-Faraday shielding system 300, negatively effecting its receiving operations. The signal bursts transmitted from the acousto-magnetic EAS system 400 is simply noise to the anti-Faraday shielding system 300 within the receiving pedestal 103.

In addition to the considerations with respect to the physical position of the antennas in relation to one another to minimize flux interference and signal nose, the present invention also provides other mechanisms to further reduce signal interferences. The present invention provides attenuation schemes within each of the EAS systems to attenuate "foreign" signals (i.e., non-native or unrecognizable signals that are simply noise to a particular EAS system) that are transmitted from other EAS systems, and boosting schemes to enhance recognized "native" signals received from an appropriate corresponding transmitting EAS system. Non-limiting examples of attenuation schemes may include filtering circuit that filter signals based on a specific operational "carrier" frequency of a particular EAS system (e.g., about 58 KHz for acouso-magnetic EAS system 400 and another operational frequency for the EAS system 300) or amplifiers to boost signals that may be "native" to a particular EAS system used. The circuit topography and processing schemes for each EAS system for signal processing is discussed in details below.

Figure 2B:
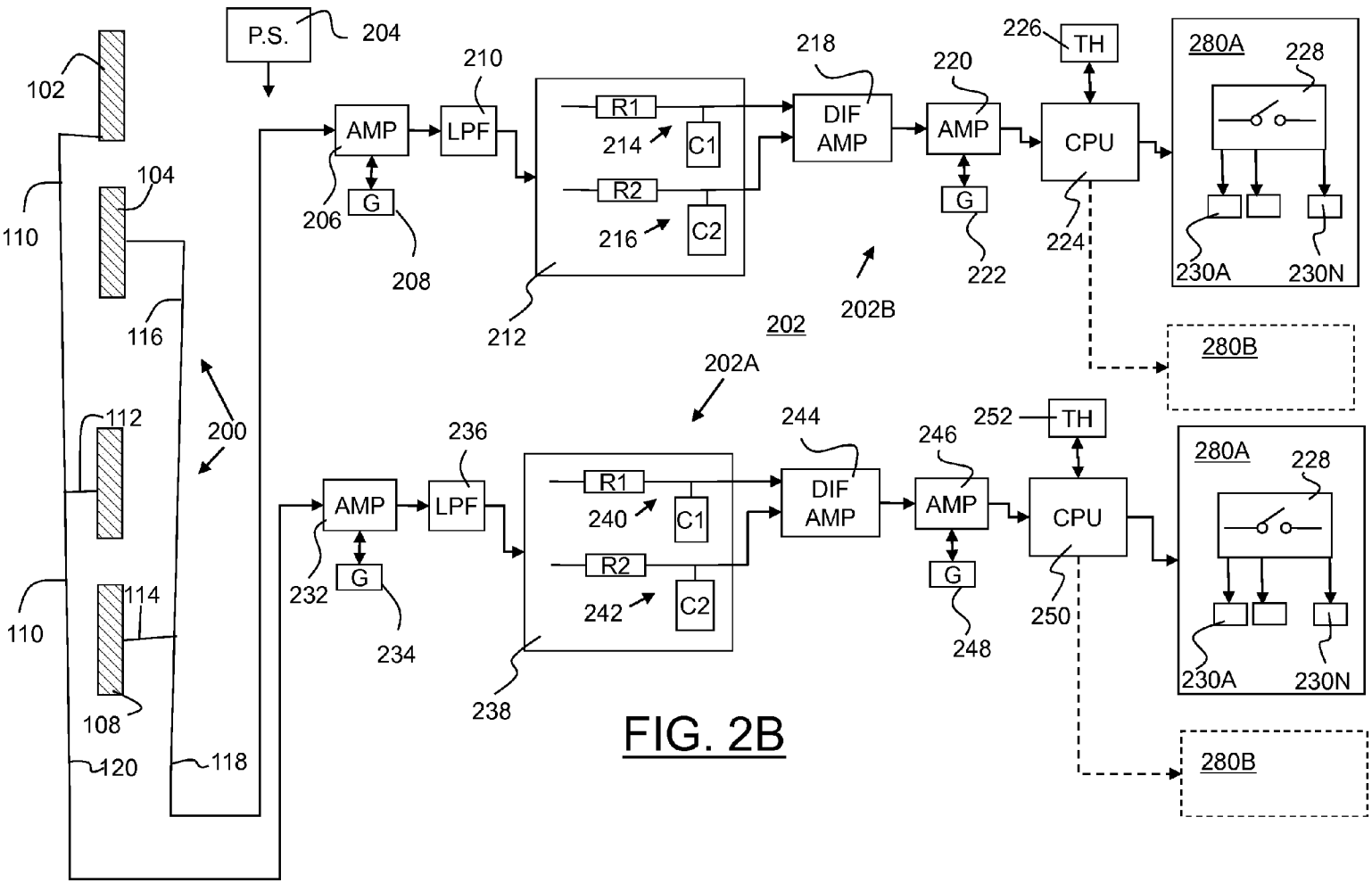
FIGS. 2B and 2C are exemplary schematic circuit diagrams for the processing of antenna signals from the electromagnetic EAS system antennas in accordance with the present invention.
Figure 2C:
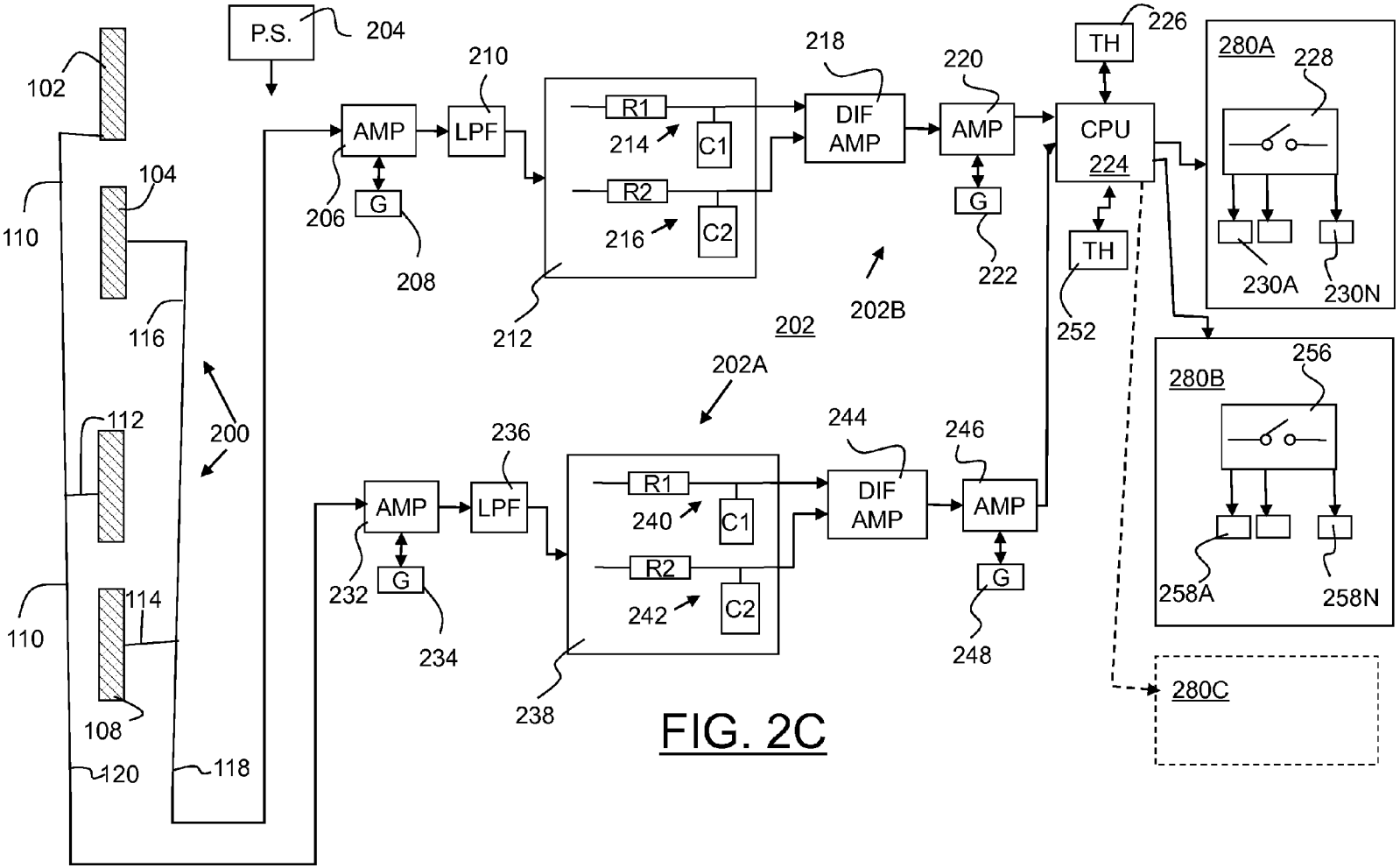
Figure 2D:
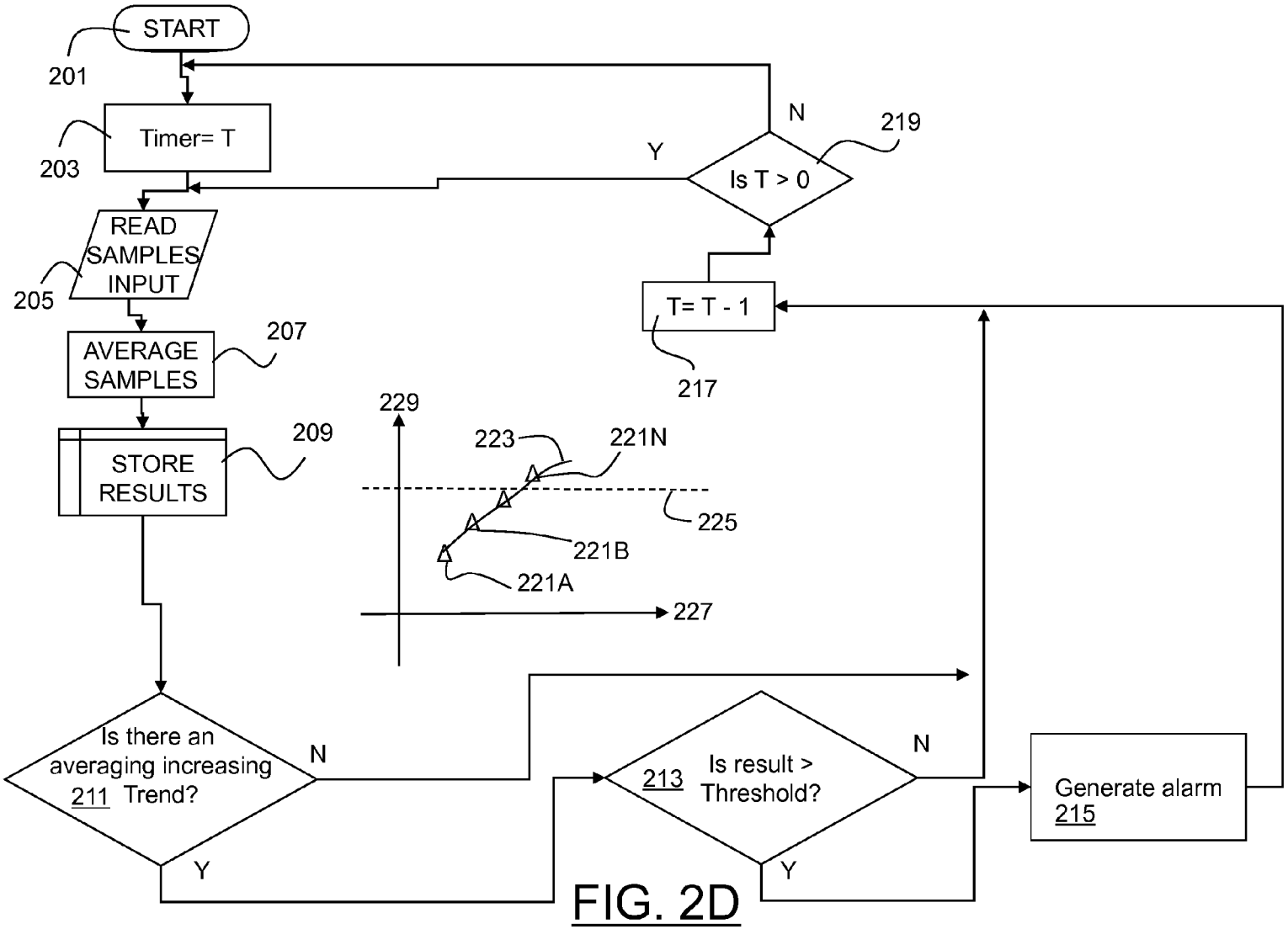
FIG. 2D is exemplary illustration of a flowchart diagram for the processing of antenna signals from an electromagnetic EAS system by a microprocessor in accordance with the present invention.

FIGS. 2B to 2D are exemplary schematic circuit and flow diagrams for the processing of antenna signals from the electromagnetic EAS system antennas 200A and 200B. FIGS. 2B and 2C are exemplary schematic circuit topographies used for the electromagnetic EAS system 200, with FIG. 2C showing the use of a single processor instead of the two shown in FIG. 2B. FIG. 2D is a flow diagram that illustrates the further processing of the antenna signals by a microprocessor(s).

As illustrated in FIG. 2B, the electromagnetic EAS signal processing circuit 202 is comprised of two identical circuits 202A and 202B, with the electromagnetic EAS signal processing circuit 202A coupled with the first electromagnetic EAS system antenna 200A via first signal line 120 and the second electromagnetic EAS signal processing circuit 202B coupled with the second electromagnetic EAS system antennas 200B via second signal line 118. Given that the first and second electromagnetic EAS signal processing circuits 202A and 202B are identical, the general description will be directed to the electromagnetic EAS signal processing circuit 202B for the sake of brevity, clarity, convenience, and to avoid duplication.

Referring to FIG. 2B, the electromagnetic EAS signal processing circuit 202B is comprised of a first amplifier 206 with a first amplification gain 208 that can be software based and is adjustable, with the amplifier 206 amplifying an incoming antenna signal (based on the gain factor), and outputting an amplified signal. As further illustrated, the electromagnetic EAS signal processing circuit 202B also includes a low-pass filter 210 for filtration of noise of the amplified signal and generation of a filtered signal. A differential amplifier 218 with a differential input stage 212 is also provided for determining a rate of change in the filtered signal for discriminating between an occurrence and noise, and generating a differential signal if the rate of change is fast. The differential input stage 212 has a first timer exemplarily comprised of a first RC circuit and a second timer exemplarily comprised of a second set of RC timer.

The outputted differential signal is further processed by a second amplifier 220 with its own second amplification gain 222 (that can also be software based and is adjustable) for amplifying the differential signal and outputting a second amplified signal. This second amplification stage is required to enable the microcomputer 224 to process the signal. The electromagnetic EAS signal processing circuit 202B also includes a microprocessor 224 for processing the second amplified signal, and based on a sensitivity threshold level 226 (which may be implemented as a variable resistor for adjustments or can be software based, and internal to the processor 224), determines if an alarm is to be generated. Although not illustrated, the second amplified signal from the second amplifier 220 is an analog signal that is converted to a digital signal by the microcomputer 226 for further processing. The conversion of analog signals to digital signals is well-known, and may also be accomplished outside the microprocessor by an analog-to-digital (A/D) converters.

The differential amplifier 218 includes the differential input stage 212 (which can be software based) that is comprised of the first RC timer 214 that generates a first time $\tau_1$ and a second RC timer 216 that generates a second time $\tau_2$, with $\tau_1 >> \tau_2$. The differential input stage 212 enables the same incoming signal to be analyzed at $\tau_1$ by the timer 214, and at $\tau_2$ by the timer 216 to determine if there is a significant change in the incoming antenna signal from time $\tau_1$ to time $\tau_2$. The differential input stage 212 provides both outputs to the respective first and second inputs of the differential amplifier 218. If differences do exist in the inputs of the differential amplifier 218 (the rate of change of signal is fast—based on the times at $\tau_1$ and at $\tau_2$), then the differential amplifier 218 outputs an amplified differential signal to be further processed; otherwise, no output is generated.

As further illustrated, the microcomputer 224 converts the second amplified signals (from the second amplifier 220), which are analog into digitized input signals using an internal A/D converter (not shown). As best illustrated in FIG. 2D, which exemplarily illustrates the flow of the operational acts of the microprocessor, the digitized input signals are read and sampled (about 10 samples per second) at the operational acts 205. An average of the sampled data is determined at the operational act 207, and stored as sampled averages at the operational act 209, which are illustrated "A" and referenced by reference numerals 221A, 221B . . . 221N in FIG. 2D. At operational act 211 a determination is made with respect to the slope or trend 223 of the averages referenced by numerals 221A, 221B, . . . 221N in FIG. 2D. If it is determined that there is an increasing trend (slope) 223 within a set time T in the averaged values referenced by the reference numerals 221A to 221N, and if the trend is increasing and the sampled averages are greater than a sensitivity threshold 225 (at operational act 213), the microcomputer generates an alarm (at operational act 215); otherwise, a timer is reset. The above scheme is performed to avoid false alarms. It should be noted that the generation of the alarm at the functional act 215 may be performed by the circuit 280A, 280B, . . . 280N where a variety of indicator 230A to 230N are actuated by various switching devices 228 (all of which may also be software based).

As stated above, FIG. 2C illustrates the use of a single processor 224 instead of the two processors 224 and 250 shown in FIG. 2B. That is, the electromagnetic EAS signal processing circuit 202A in FIG. 2B uses the microcomputer 250 to process signals from the electromagnetic EAS system 200A, whereas in FIG. 2C the electromagnetic EAS signal processing circuit 202A shares the processor 224 with the electromagnetic EAS signal processing circuit 202B.

Figure 3B:
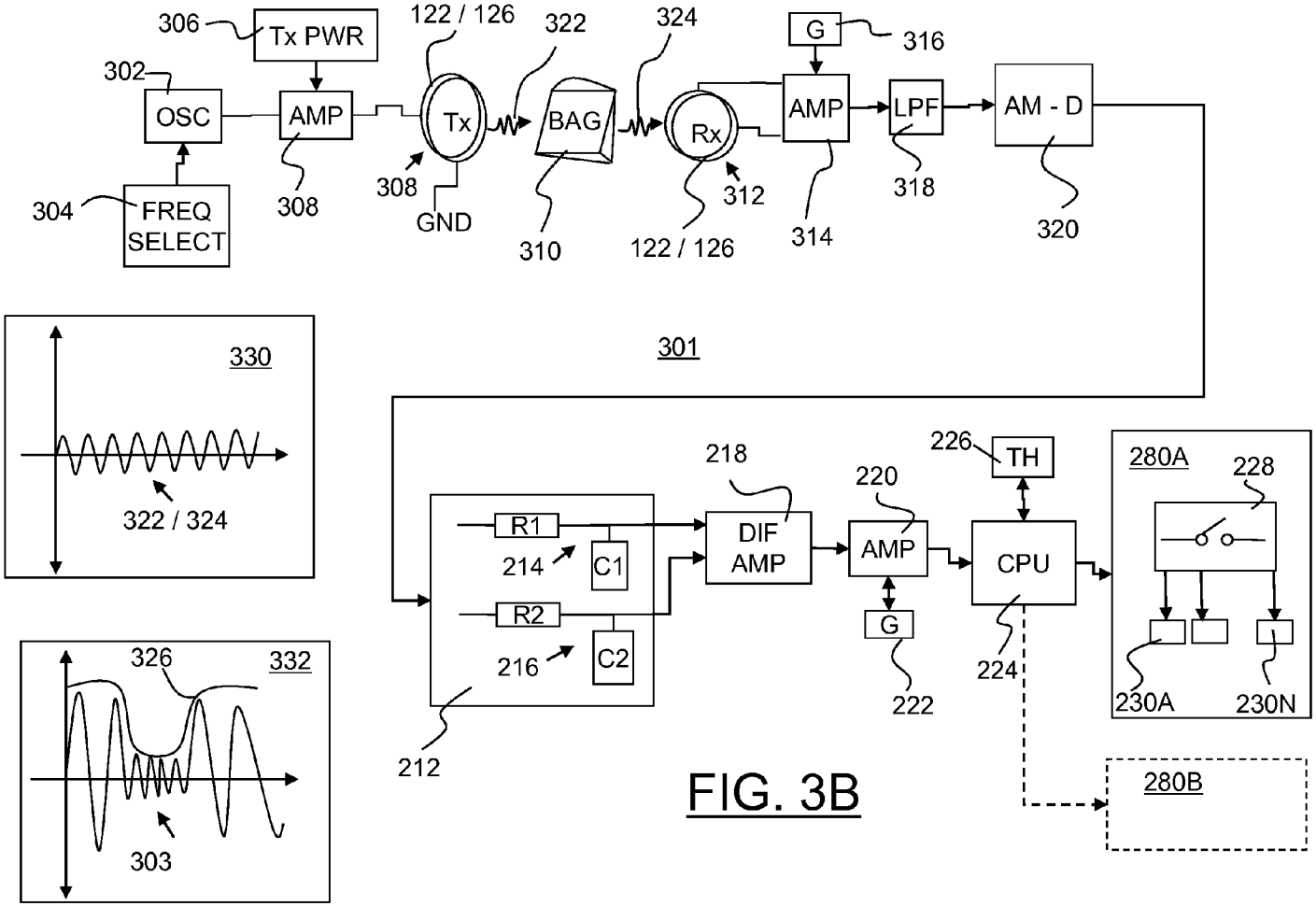
FIG. 3B is an exemplary schematic circuit diagram for the processing of antenna signals from an anti-Faraday shielding EAS system in accordance with the present invention.
Figure 3C:
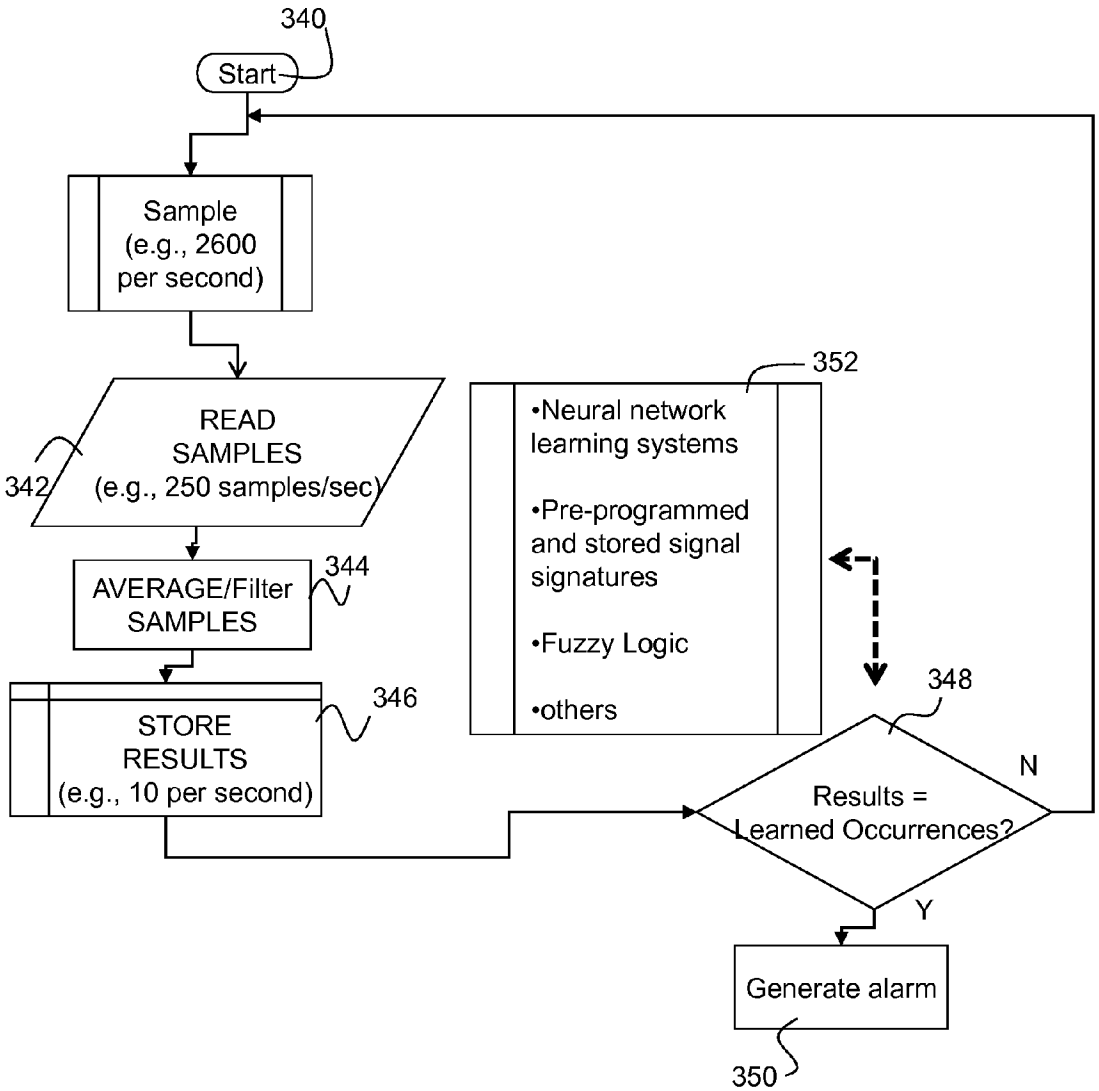
FIG. 3C is exemplary illustration of a flowchart diagram for the processing of antenna signals from an anti-Faraday shielding EAS system by a microprocessor in accordance with the present invention.

FIGS. 3B and 3C are exemplary schematic circuit and flow diagrams for the processing of antenna signals from the anti-Faraday shielding EAS system 300. The description of FIGS. 3B and 3C is provided using the illustrated first anti-Faraday shielding EAS system 300A having a first inductor coil 122 and a second anti-Faraday shielding EAS system 300B having a second inductor coil 126, with the first anti-Faraday EAS shielding system 300A coupled with the second anti-Faraday shielding EAS system 300B. However, it would be readily apparent to those skilled in the art that the description of FIGS. 3B and 3C also applies to the anti-Faraday shielding EAS system 300C. Nonetheless, these inductor coils (form systems 300A and 330B, or alternatively, 300C) are represented as the transmitter antenna 308 and the receiver antenna 312 in FIG. 3B. It should be noted that the transmitter antenna 308 and the receiver antenna 312 may be combined into a single transceiver antenna. The antennas in the transmitter pedestal send out a continuous signal, and the antennas in the receiver pedestal receive that continuous signal.

As illustrated in FIG. 3B, the anti-Faraday shielding EAS system 300 includes an anti-Faraday shielding EAS signal processing circuit 301 that is comprised of a signal generator 302 for generating a carrier signal at a predetermined frequency set by a frequency selector 304. The signal generator 302 may be an oscillator that generates a carrier sine wave, and the frequency selector 304 may be implemented as a software routine, which is well-known. Non-limiting example of the predetermined frequency for the operation of EAS system 300 may include an exemplary frequency range of about 20 KHz to about 30 KHz, depending on other system parameters. The anti-Faraday shielding EAS signal processing circuit 301 further includes a first amplifier 308 with a first amplification gain 306 (that is adjustable and may be software implemented) for amplifying the generated carrier signal and outputting an amplified signal to the antenna 308. The antenna 308 (which represents the inductor coils 122 and 126 in a transmitter pedestal) transmits the amplified signal as transmission signal 322. Further included is a receiving antenna 312 (which represents the inductor coils 122 and 126 in a receiver pedestal) for receiving the transmitted signal 322 from the transmitting antenna 308. A non-limiting exemplary shape of the transmitted signal 322 (for visual presentation and better understanding of the invention) without a Faraday shield (booster bag 310) within the surveillance zone of the anti-Faraday shielding EAS system 300 is illustrated as graph 330. If there is a Faraday shield (a booster bag 310) within the surveillance zone of the anti-Faraday shielding EAS system 300, the signal may be represented as signal 303 shown in graph 332. As with the signal figure in graph 330, the signal FIG. 303 is a non-limiting exemplary shape for visual presentation and better understanding of the invention.

As further illustrated, the anti-Faraday shielding EAS signal processing circuit 301 further includes a second amplifier 314 with a second amplification gain 316 (that can be software based and is adjustable) for amplifying the received signal and outputting a second amplified signal. A low-pass filter 318 is used for filtration of noise of the second amplified signal and generation of a filtered signal. An amplitude demodulator 320 is also used for demodulating the filtered signal to generate a demodulated signal. If there is no Faraday cage (no booster bag 310) within the surveillance zone of the anti-Faraday shielding EAS system antennas 308 and 312, the demodulated signal will be smooth. In general, demodulation is the act of removing the modulation from an analog signal (in this instance the carrier signal) to the original state of the base-band signal. Demodulating is necessary because the receiver system 312 receives a modulated carrier signal with specific characteristics, which must be returned to its base-band. If there is a Faraday cage (a booster bag 310) within the surveillance zone of the anti-Faraday shielding EAS system antennas 308 and 312, an exemplary signal 303 is received by the receiver system 312, which is then demodulated (the carrier is removed) by the demodulator to a signal referenced as 326, with a dip (shown in graph 332). This signal 326 exemplarily represents a response or "signature" of a Faraday shield (the booster bag 310). Again, all signals illustrated are mere visual representations or examples only. They are illustrated for better understanding of the invention, and should not be limiting.

The anti-Faraday shielding EAS signal processing circuit 301 further includes a differential amplifier 218 for determining a rate of change in the demodulated signal for discriminating between an occurrence and noise, and generating a differential signal if rate of change is fast. The differential amplifier 218 includes a differential input stage 212 (which can be software based) that is comprised of a first timer that generates a first time $\tau_1$ and a second timer that generates a second time $\tau_2$, with $\tau_1 >> \tau_2$. The circuit topography and function of the differential input stage 212 is identical to that, which is described above. As further illustrated, a third amplifier 220 with a third amplification gain 222 (that can also be software based and is adjustable) for amplifying the differential signal and outputting a third amplified signal. A microprocessor 224 is used for processing the third amplified signal (the signal is first converted by an analog to digital converter (A/D) within the processor), and based on a sensitivity threshold level determines if an alarm is to be generated. The sensitivity threshold level is an adjustable value implemented as an adjustable resistor, which can be software based, and be internal within the processor.

As best illustrated in FIG. 3C, which exemplarily illustrates the flow of the operational acts of the microprocessor 224, the digitized input signals are sampled at the operational act 341 and read at the operational acts 342. Non-limiting example of sample rate is approximately 2600 samples per second, with the microprocessor 224 (via the A/D converter) reading about 250 samples, which are then filtered and averaged. An average of the 250 readings of the sampled data is determined at the operational act 344, and stored as a sampled average at the operational act 346 in a memory of the microprocessor, such as a Random Access Memory (RAM) unit. The stored sampled averages (about 10 filtered and averaged samples per second) have sufficient data that is read and gathered by the microcomputer 224 to "construct" an image of the signal being transmitted and received by the antennas 308 and 312. The stored results at the operational act 346 are then compared with learned occurrences. That is, the microprocessor 224 compares the received stored sample averages 346 with a predetermined signal signature to determine if an alarm is to be generated. It should be noted that through well known methods such as neural network learning systems, pre-programmed algorithms, Fuzzy logic, or others (352), the microcomputer 224 is taught the signal signature of numerous Faraday shields as reference signal signatures, and pre-programmed and stored within the microcomputer 224. When a booster bag 310 is brought into the surveillance zone of the anti-Faraday Shield EAS system antennas 308 and 312, this generates a signal 303, which is read, sampled, and averaged by the microprocessor 224, and compared with references of learned signature signals to determine if an alarm should be generated. Accordingly, all signal characteristics that define a signal, and hence, digital signal signatures are learned and pre-stored in the microprocessor 224 for comparison. Sufficient sampling is stored at operational act 346 to enable clear match with the pre-stored signature so to avoid false alarm.

FIGS. 4B to 4F are exemplary schematic circuit, flowchart, and signal graph diagrams for the processing of antenna signals of the acousto-magnetic EAS system 400 with an antenna having two antenna coils (or loops). The acousto-magnetic EAS system 400 includes an antenna coupled with a control box, which may be physically located outside the illustrated pedestal system 101. The control box (FIG. 4B) includes a transceiver module that couples with the antenna of the EAS system 400, and includes a transceiver circuit coupled with the antenna that enables the antenna to function as both a transmitting and a receiving antenna.

The transceiver circuit within the transceiver module of the control box includes a transmitting board (TX board) 406 that may be coupled with one or more transmitter pedestals 410 and 412. Further, the transceiver circuit within the transceiver module of the control box includes a receiver board (RX board) 424 that may be coupled with one or more receiver pedestals 414, 411, 413, and 415, and the TX board 406. The coupling of the RX board 424 with the TX board 406 enables the entire transceiver module to share a single microprocessor 416 for processing EAS system 400 signals.

The transceiver module coupled with the EAS system 400 antenna enables generation and transmission of signals in a first mode of operation, defining a surveillance zone for a corresponding EAS tag. The generated and transmitted signal has a signal characteristic that is maintained during normal operations of the EAS system 400, with no substantial changes in signal phase. In the second mode of operation, the transceiver module receives signals from the surveillance zone using the EAS system 400 antenna in the receiver pedestals, with the microprocessor 416 processing the received signals and generating an alarm based on a predetermined condition.

As indicated above in relation to FIGS. 1A-1 to 1A-3, the acousto-magnetic EAS system 400 includes an antenna that is comprised of a first loop 132 and a second loop 134 or, alternatively, the antenna is only comprised of one single loop 137. Any combinations of one and or two loop antennas are contemplated within a pedestal system. For example, a transmitter pedestal may have one single loop antenna 137, but associated receiver pedestals include two antenna loops (e.g., first loop 132 and a second loop 134). If two loops are used for transmission (regardless of the number of loops used in associated receiver pedestals), then the generated transmitter signal will comprise of first and second magnetic fields with phase characteristics that are maintained during normal operations and have one of substantially in phase and substantially out of phase characteristics only, with no substantial signal phase variations during operation. The installer may select to choose the transmitting loop signals to be either in phase only (and maintained at all times of normal operation) or out of phase only (and maintained at all times of normal operation). Accordingly, during normal operation, the EAS acousto-magnetic antennas transmit signals that are one of in phase only or output phase only, with no phase variations or changes during operations. On the other hand, if only a single loop antenna 137 is used, then all signals transmitted will obviously be in-phase. It should be noted that as illustrated in FIGS. 4B and 4C, if two antenna loops are used, then the transceiver circuit is coupled with both the first and second loops 132 and 134 of the antenna located within each of the plurality of the transmitter and receiver pedestals.

Figure 4B:
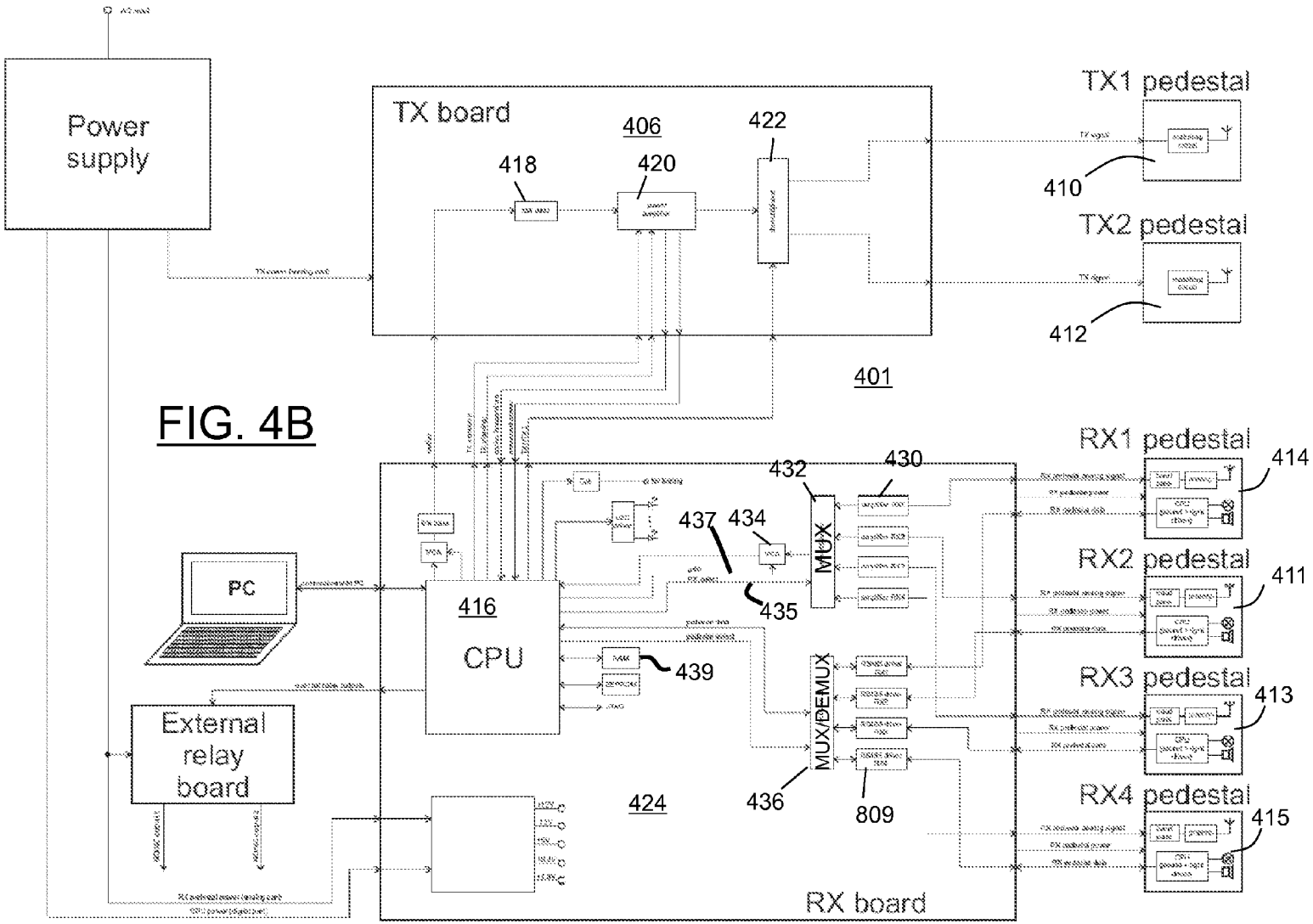
FIGS. 4B and 4C are exemplary schematic circuit diagrams for the processing of antenna signals from an acousto-magnetic EAS system in accordance with the present invention.
Figure 4C:
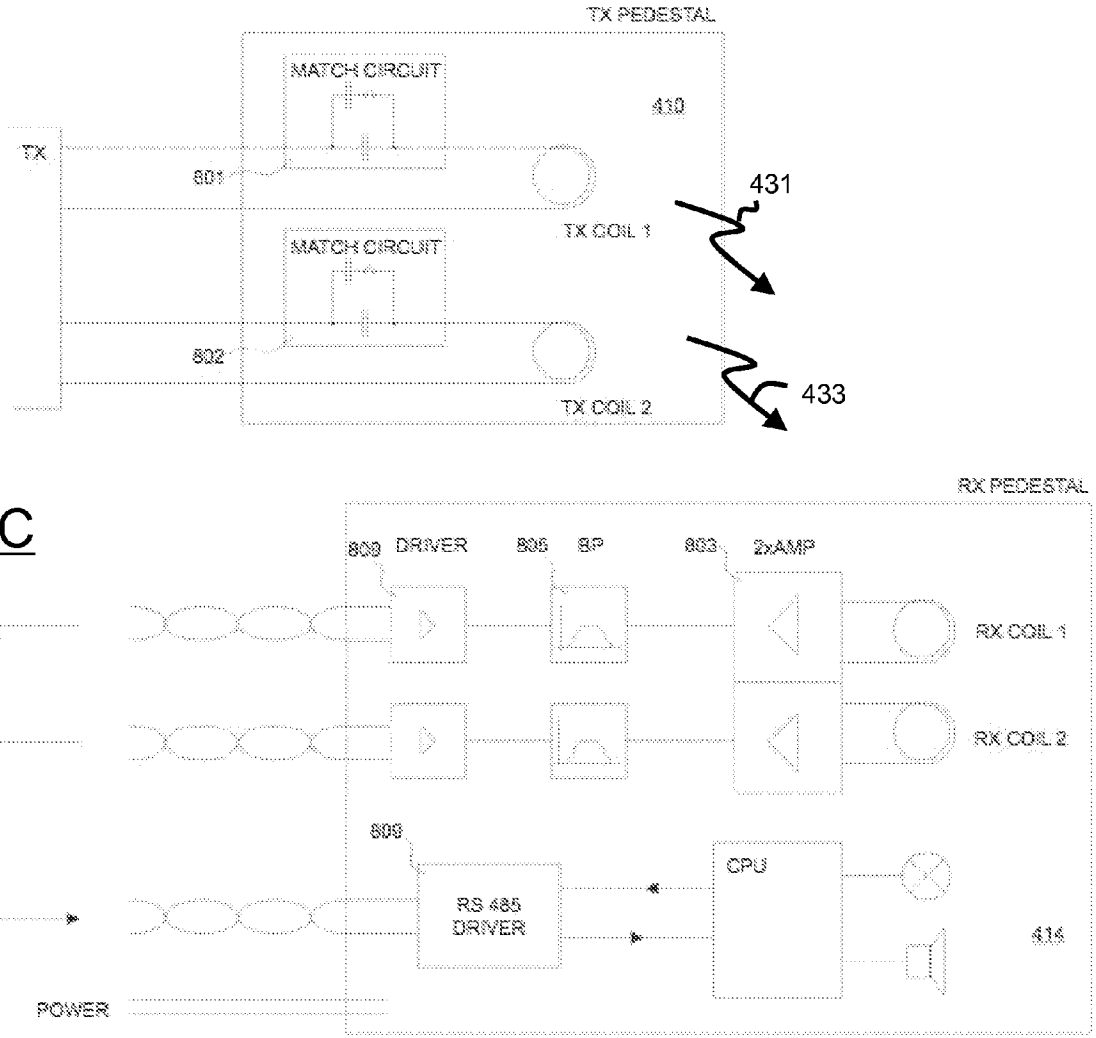

As further illustrated in FIGS. 4B and 4C, the acousto-magnetic EAS systems 400 includes an acousto-magnetic EAS signal processing circuit (or control box) 401 that includes an anti-jamming capability that can drive a plurality of transmitter and receiver pedestals. Only two transmitter pedestals TX1 and TX2 (410 and 412), and four receiver pedestals RX1, RX2, RX3, and RX4 (414, 411, 413, and 415) are illustrated. For clarity, convenience, and to avoid duplication, only a single transmitter pedestal TX1 410 with two antenna loops and a receiver pedestal RX1 414 with two antenna loops will be used for description. The CPU 416 on the receiver RX board 424 generates an exemplary 58 KHz frequency carrier signal, which is processed by a low pass filter 418 on the transmitter TX Board 406, amplified by an amplifier 420, and demultiplexed into individual signals (e.g., one signal per antenna loop of a pedestal) by the demultiplexer 422 ready to be transmitted by the plurality of transmitter pedestals (e.g., TX1 410). A matching circuit 801 (FIG. 4C) within the transmitting pedestal TX1 410 tunes the Tx antenna coil 1 to resonance. Several capacitors (banks of capacitors) are used to tune the Tx antenna coil 1 (e.g., loop 132) and Tx antenna coil 2 (e.g., loop 134) in the TX1 410 to resonant frequency.

As further illustrated in FIG. 4C, the signals 431 and 433 generated by the respective transmitter coils Tx coil 1 (loop 132) and Tx coil 2 (loop 134) are received by the receiver coils Rx coil 1 (loop 132 in the receiver pedestal), and Rx coil 2 (loop 134 in the receiver pedestal) of the receiver pedestal (e.g., RX1 414). All antennas and coils can function as transceivers but for clarity and ease of understanding they are described as functioning as a transmitting and receiving antennas. The received transmitted signals 431 and 433 are amplified by the amplifiers 803 (FIG. 4C), and filtered by the band pass filters 805, and fed to driver circuits 807 of the receiver coils Rx coil 1 (loop 132 in the receiver pedestal) and Rx coil 2 (loop 134 in the receiver pedestal) of the receiver pedestal (e.g., RX1 414). The drive signals from the driver circuits 807 are input to a dual input channel of RX1 amplifier 430 with an amplified signals output (via the dual channel output of the RX amplifier 430) to a multiplexer MUX 432, and input to dual input channel of a voltage control amplifiers 434. A MUX 432 selector line 435 enables selection and input of one of a plurality of RX amplifier outputs (in this exemplary instance, it is the RX1 amplifier 430) to be selected for input to the dual input channel of the voltage control amplifiers 434. The voltage control amplifier 434 controls the various voltages input from the various antennas and generates different voltage level signals (via its gain line 437) to correct for any environmental noise. The dual output channels of the voltage control amplifier 434 are input to the CPU 416 for processing the received transmitted signals. The microprocessor or CPU 416 processes the signals received from the voltage control amplifier 434 and based on the processing results forwards various indicator signals back to the receiver antennas for further processing by the receiver antenna CPU 433 (detailed below). It should be noted that the number of input/output channels for each component described is commensurate with the number of antenna loops per the receiver pedestal. For example, if the receiver pedestals RX1 414 included only a single antenna loop (e.g., antenna loop 137), then the components described would have one input and one output channel. As another example, if the receiver pedestal RX1 414 had four antenna loops instead of the two transmitter coils Rx coil 1 (loop 132) and Rx coil 2 (loop 134), then the components described would have four input/output channels.

Figure 4D:
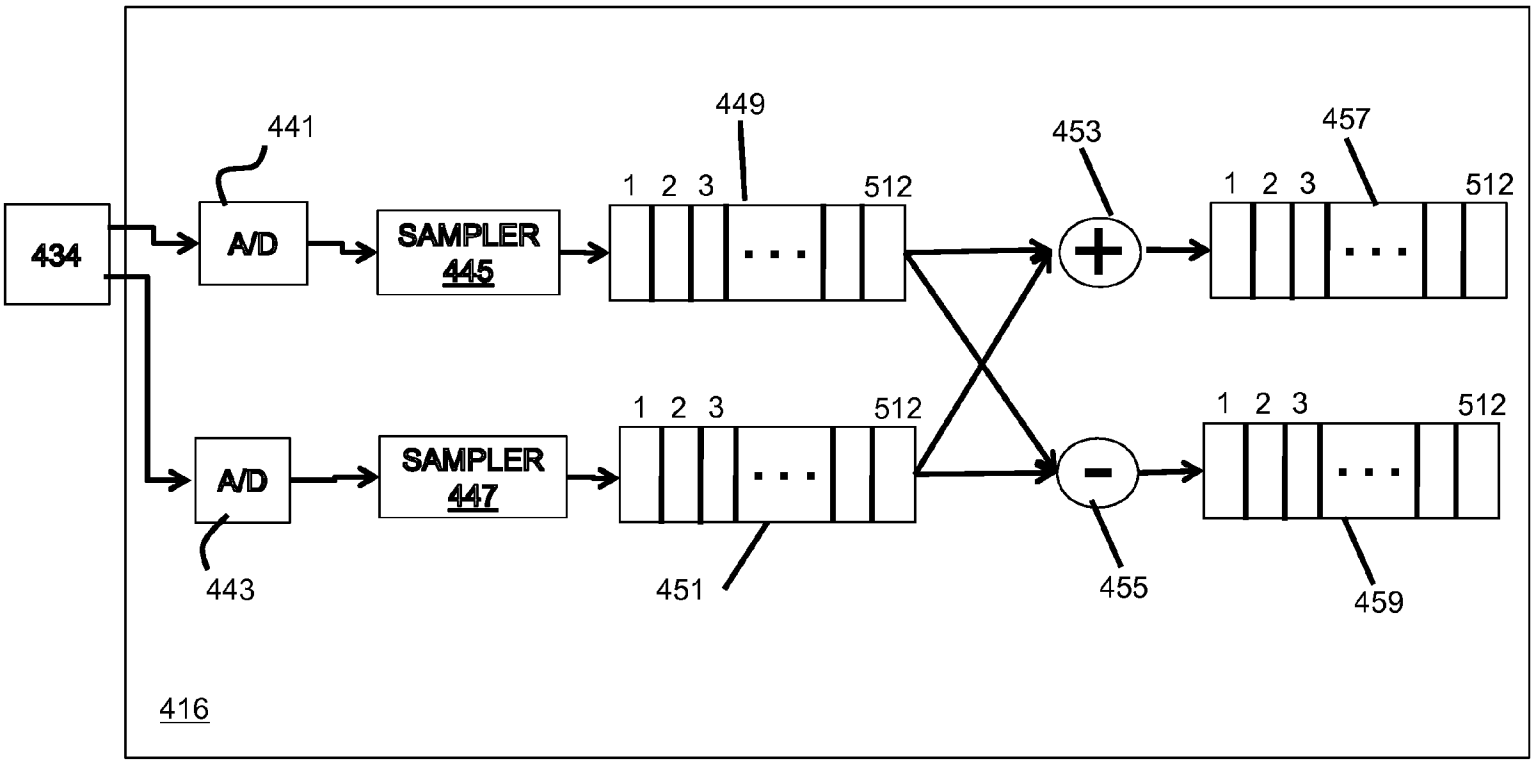
FIG. 4D is an exemplary illustration of the internal signal processing of received signals in accordance with the present invention.

FIG. 4D is an exemplary illustration of the signal processing of the received signals from the voltage control amplifier 434 by the CPU 416. As has been described above, the transmitter field phase relationship for the transmitting antennas of the acousto-magnetic EAS system 400 is selected during the installation process and maintained substantially constant thereafter during operation. As is well-known, at least theoretically, it is possible for a tag or a marker to pass through a surveillance zone that is generated as a result of transmitted signal with constant phase and not be detected due to the tag orientation within the surveillance zone. Therefore, theoretically, the possibility exists that a tag or marker may not be detected due to its orientation within a surveillance zone that is generated or created from a substantially constant phase signal and hence, resulting in "detection holes" within the surveillance zone. The signal processing by the CPU 416 illustrated in FIG. 4D obviates the possible occurrence of an undetected tag within the surveillance zone that is generated by a signal with a constant phase. The CPU 416 signal processing illustrated in FIG. 4D includes manipulation of digitized signal values input from the dual output channel of the voltage control amplifier 434 to compute in-phase and out of phase relationship between the received signals from the receiver antenna loops of a receiver pedestal to thereby detect any tag orientation and eliminate possible detection holes within the surveillance zone.

As illustrated FIG. 4D, the CPU 416 includes Analog-to-Digital (A/D) converts 441 and 443 that convert analog signals from the dual output channel of the voltage control amplifier 434 to digital signals for further signal processing. The digitized signals are then simultaneously sampled by respective sampler unit 445 for Rx coil 1 (loop 132) and sampler unit 447 for Rx coil 2 (loop 134). The sampling rate is at about N times the frequency of operation of the antennas per unit of time. For example, for most acousto-magnetic EAS systems the frequency of operation of transmitted signals is about 58 KHz. Therefore, in this exemplary non-limiting instance, the sample rate N would be 4×58 KHz or 232 Kilo-samples per second or 232,000 samples per second. The CPU 416 then stores M number of such samples into the respective antenna array samples 449 and 451. That is, M digitized sampled signals for Rx coil 1 (loop 132) from the sampler 445 are stored in the antenna array sample 449, and M digitized sampled signals for Rx coil 2 (loop 134) from the sampler 447 are stored in the antenna array sample 451. The selection of the number of samples M to be stored depends on the array size selected. That is, the numeric value of M is commensurate with the size of the array. In this non-limiting exemplary instance, the sizes of the arrays 449 and 451 are 512 units and hence, 512 samples are selected from each sampler, and stored in the respective antenna array samples 449 and 451. The CPU 416 then adds those M samples from the arrays 449 and 451 via an ADDER 453 to compute in phase signal values (the so-called "O" configuration) and stores values in the in-phase or "O" configuration array 457, and subtracts the same via a SUBTRACT function 455 to compute the out of phase signal values (the so-called "8" configuration) and stores the results in the out of phase or "8" configuration array 459. The computed in-phase and out of phase relationship between the received signals from the receiver antenna loops of a receiver pedestal are then used (analyzed) to determine a detection of a tag or marker (regardless of any tag orientation), eliminating any possible detection holes within the surveillance zone.

As will be apparent from the flowcharts illustrated in FIGS. 4F-1 and 4F-2 and the timing and signal analysis graphs of FIGS. 4G to 4L (all of which are described in detail below), the operational or functional acts of the CPU 416 to sample, store, and compute the "O" and "8" configurations on received data is performed twice at predetermined reserved time periods. That is, sampling, storage, and computing is performed at a first predetermined reserved time when CPU 416 is timed or clocked to receive data from the tag, which is exemplarily illustrated at the predetermined reserved time period t3 shown in FIG. 4G, with the actual operational functional act exemplarily shown in FIG. 4F-1 as the operational act 454. The second predetermined reserved time for the second sampling, storage, and computing is performed when the CPU 416 is timed or clocked to receive ambient or background noise (i.e., the CPU 416 is not expected to receive tag signal at this reserved time period), which is exemplarily illustrated at the predetermined reserved time period t5 shown in FIG. 4G, with the actual operational functional act exemplarily shown in FIG. 4F-1 as the operational act 460. Stated otherwise, the results of the operational act 454 are data for "O" and "8" configurations in the respective arrays 457 and 459 that relate to the data from a tag (timed to receive at t3), and the results of the operational act 460 are data for "O" and "8" configurations in the respective arrays 457 and 459 from environmental signal (timed to receive at t5). It should be noted that it is only for clarity and convince that only a limited number of arrays are illustrated. In fact, the present invention uses a large number of arrays (or a plurality of arrays) to store all signal information for the many cycles of the operational acts 456 and 462 (including operational acts 465 and 467) in FIG. 4F-1. In addition, as illustrated in FIG. 4B, the CPU 416 includes one or more internal and external memory to store further signaling and programming information. Non-limiting examples of such memory may include the illustrated Random Access Memory RAM 439 or Electrically Erasable Programmable Read-Only Memory EEPROM 441.

Referring back to FIG. 4B, based on the detections computed by the CPU 416, the processor 416 then communicates indicator signals via a bi-directional hybrid multiplexer/demultiplexer MUX/DEMUX 436 with the element 809, which drives the CPU 433 inside the receiver pedestals (e.g., RX1 414) to drive various indicator elements, non-limiting examples of which may include audio and visual alarm indicators. Element 809 is a well-known bidirectional interface, which enables receiving and forwarding of a clean signal without interference from outside environmental noise. Non-limiting example of element 809 may include the well-known RS485 Integrated Circuit (IC) interface.

Figures 1, 4E:
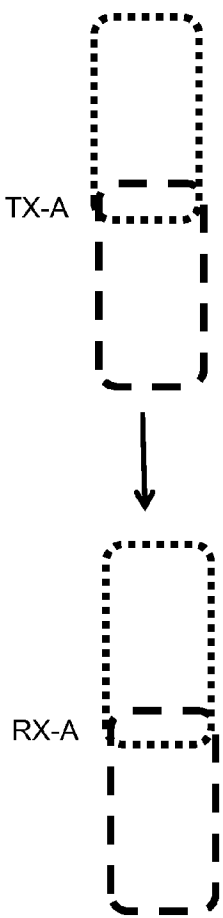
Figures 2, 4E:
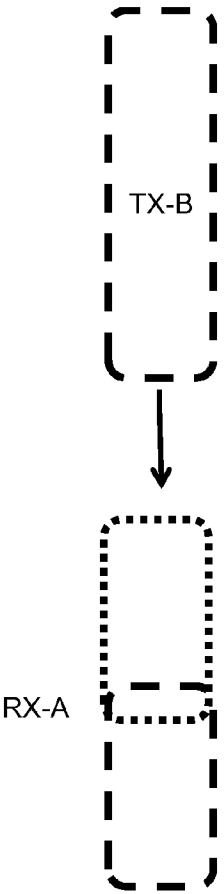
Figures 3, 4E:
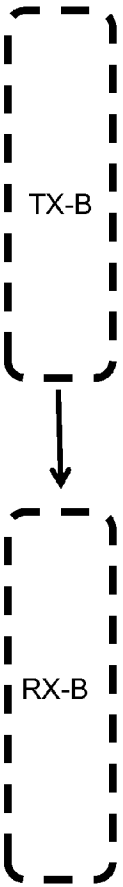
Figures 4, 4E:
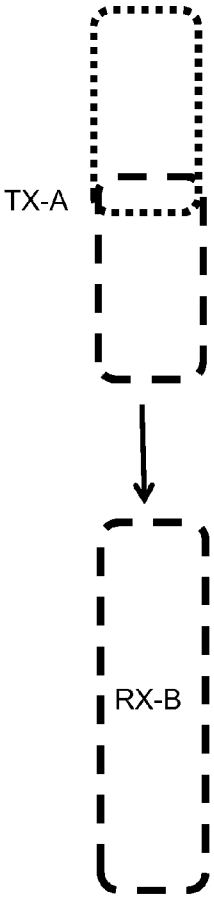

FIGS. 4E-1 and 4E-2 are exemplary illustrations of the various preferred antenna configurations that may be used in conjunction with the above signal processing of the CPU 416. In particular, the above-described signals processing by CPU 416 is applicable to antenna configurations illustrated in both FIGS. 4E-1 and 4E-2. FIG. 4E-1 illustrates one or more transmitter pedestals with two in-plane, overlapping transmitter antenna loops TX-A and one or more receiver pedestals with two in-plane, overlapping receiver antenna loops RX-A. FIG. 4E-2 illustrates one or more transmitter pedestals with one single transmitter antenna loop TX-B and one or more receiver pedestals with two in-plane, overlapping receiver antenna loops RX-A. In both instances (FIGS. 4E-1 and 4E-2), the receiver antenna configurations RX-A is identical to the two loop receiver antennas that are described above and illustrated in FIGS. 4B and 4C, with their respective signals processed and input to the CPU 416 for further processing in accordance with the above described FIG. 4D. Accordingly, referring to both FIGS. 4E-1 and 4E-2 together, the acousto-magnetic EAS system 400 of the present invention may include one or more transmitter pedestals with transmitter antenna having one or two loops (TX-A and/or TX-B) and one or more receiver pedestals with receiver antennas having two loops (RX-A). Alternatively, the acousto-magnetic EAS system 400 of the present invention may include one or more transceivers having a first mode of operation (to transmit) using only one of a two loops of the antenna TX-A (that would function like the single loop antenna TX-B) and in a second mode of operation (to receive) a transmitted signal using both loops (RX-A).

FIGS. 4E-3 and 4E-4 are exemplary illustrations of other antenna configurations that may also be used in conjunction with the above signal processing of the CPU 416. That is, if the receiver antenna RX-B (in both FIGS. 4E-3 and 4E-4) has only a single loop, the computations by the CPU 416 will result in only an "O" configuration, regardless of the number of loops in the transmitter antenna, single loop TX-B shown in FIG. 4E-3 or the double loop TX-A shown in FIG. 4E-4. However, the resulting detection of the surveillance zone from the "O" configuration only, may possibly include potential detection holes as described above.

Figures 1, 4F:
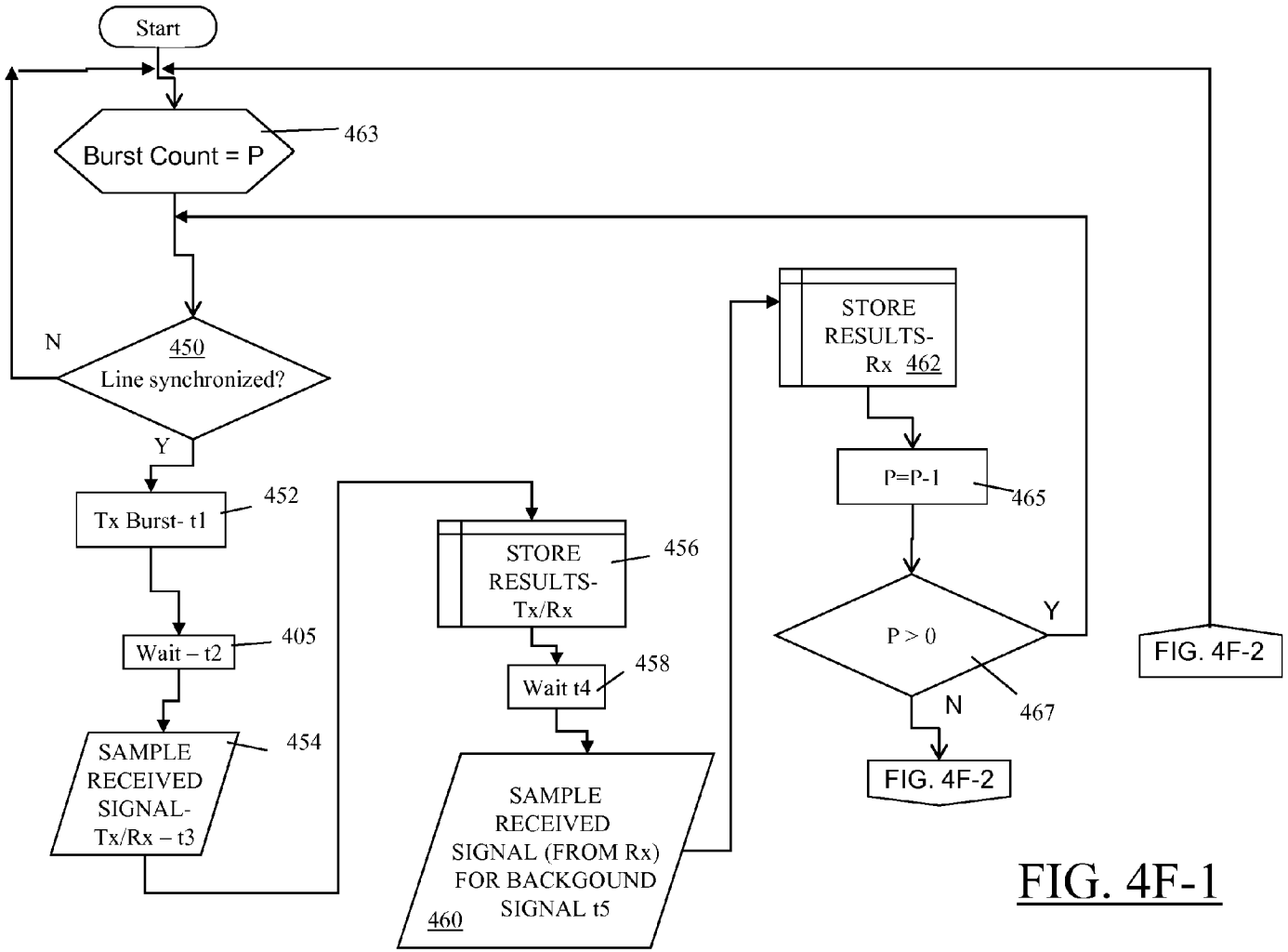
Figures 2, 4F:
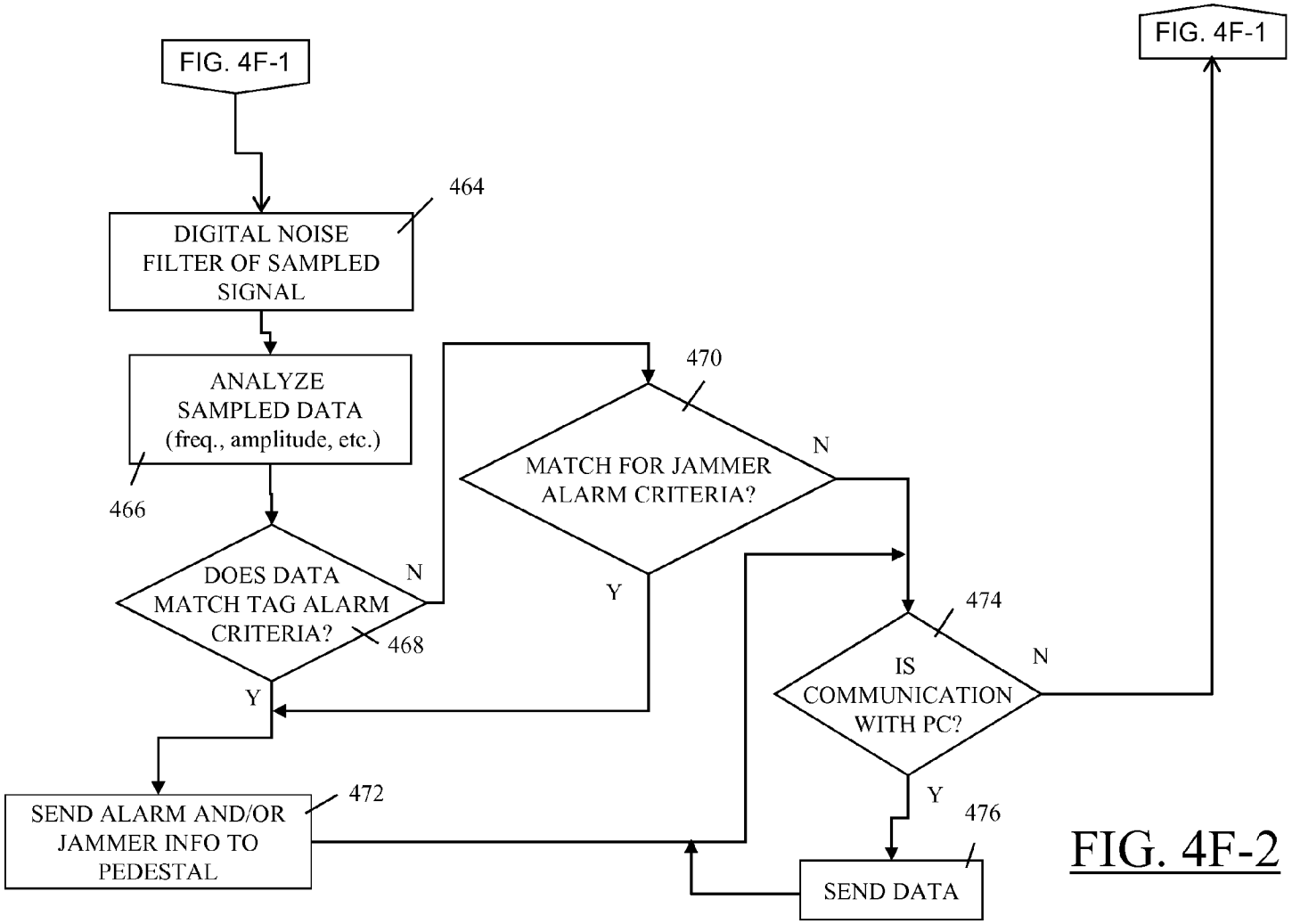

FIGS. 4F-1 and 4F-2 are exemplary illustrations of the flowcharts of the operational functional acts of the computer or CPU 416 in accordance with the present invention, and FIGS. 4G to 4L are exemplary illustrations of the timing and signal analysis graphs of the acousto-magnetic EAS system of the present invention. As is well known, in general, most acousto-magnetic EAS systems operate at a frequency of about 58.4 KHz, and transmit signals in bursts. Conventional acousto-magnetic EAS systems transmit signals at a normal rate but double the transmission rate (double the number of signal bursts) upon detection of a tag. The present invention transmits signals at a substantially constant burst rate "P." That is, the present invention transmits signals at "P" bursts per unit of time and maintains this transmission rate. Accordingly, as illustrated in FIG. 4F-1, at the operational act 463, the CPU 416 is prepared by setting the transmission signal burst count to some value "P." In this non-limiting exemplary instance, the Burst Count may be set to transmit signals at P=6 burst pulses, with each burst pulse having 1.6 millisecond (ms) duration, and with each burst pulse separated by 11.1 ms (if power supply frequency is at 60 Hz). In other words, in the non-limiting exemplary instance where Burst Count P is set to equal the numeric value 6 at the operational act 463, the operational acts 450 to 462 (including 465 and 467) are executed six times, prior to the commencement of the execution of the operational acts of 464 to 474 that are illustrated in FIG. 4F-2. After "P" execution cycles of operational acts 450 to 462 (including 465 and 467) shown in FIG. 4F-1, the operational acts 464 to 474 (shown in FIG. 4F-2) are then executed. In this non-limiting exemplary instance, the CPU 416 is allotted about 20 ms to execute the operational acts 464 to 474 (shown in FIG. 4F-2). Stated other wise, the CPU 416 of the system 400 of the present invention waits for about 20 ms before resetting the Bust Count P to a selected value. Accordingly, unlike the conventional acousto-magnetic systems that vary the rate of transmission signal bursts based upon the type of received signal, the present invention sets and maintains the rate of transmission signal bursts. As stated above, all data gathered throughout each of the "P" cycles are stored in a plurality of arrays (or memory), such as those illustrated in FIG. 4D (only two arrays are illustrated for clarity).

Figure 4G:
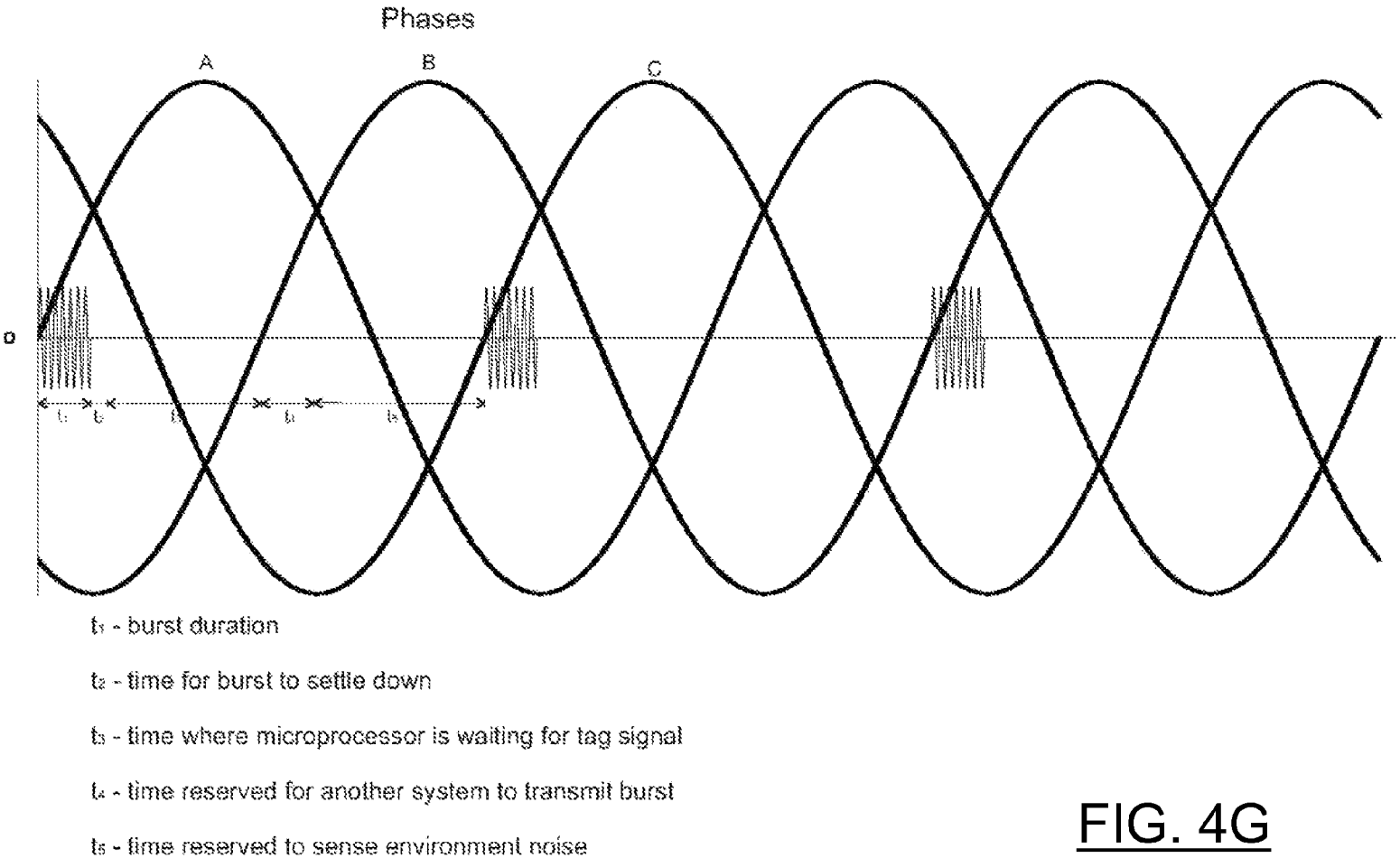
FIGS. 4G to 4L are exemplary schematic signal graphs of antenna signals of an acousto-magnetic EAS system, including signal analysis, timing, and illustration of ant-jamming method in accordance with the present invention.

As best illustrated in FIGS. 4F-1 and 4F-2, and 4G, at the operational act 450 the input lines at exemplary phase lines A, B, and C illustrated in FIG. 4G are synchronized, and as part of the synchronization, the transmission from the transmitter TX1 is performed at the exemplary zero-crossing of the phase lines. It should be noted that synchronization of the transmission signals are done so to not interfere with one another and for appropriate reading of tag and noise signals. For example, a first system in one physical location functioning on phase line A must be synchronized such that no other signal is transmitted simultaneously by a second, different system functioning (for example) on phase line C at another, nearby physical location. As a further example, the start of a transmission of the signal pulse is synchronized to start at a zero-crossing, for example, at the start of time T1 for the duration of t1 for phase line A, or end of time t5 (for another system on phase line C). Once all timings for all signals are synchronized, at the operational act 452 a first signal pulse burst Tx with duration of t1 is transmitted (FIGS. 4G and 4H) at time T1 via the transmitter pedestal TX1. It should be noted that for systems that require a further delay in synchronization, after the operational act 452, an optional delay of Δ1 can be interjected so that t1 does not commence at the exemplary start of the zero-crossing, but is shifted (delayed) by some time Δ1.

All times are described as follows in relation to FIGS. 4G to 4L. As best illustrated in FIG. 4G, t1 is the pulse duration (operational act 452 in FIG. 4F-1) and t2 is the settlement phase or period of the pulse (operational act 405 in FIG. 4F-1). The time period t3 is reserved for the microprocessor 416 to wait and listen and detect to receive signals from a tag that may be within a surveillance zone of the acousto-magnetic EAS system 400 (operational act 454 in FIG. 4F-1). Time duration t4 is reserved for another system such as that shown on phase C to send its own pulse (operational act 458 in FIG. 4F-1), and t5 is the time reserved for the microprocessor 416 to wait and listen and detect the environmental noise (operational act 460 in FIG. 4F-1).

Figure 4H:
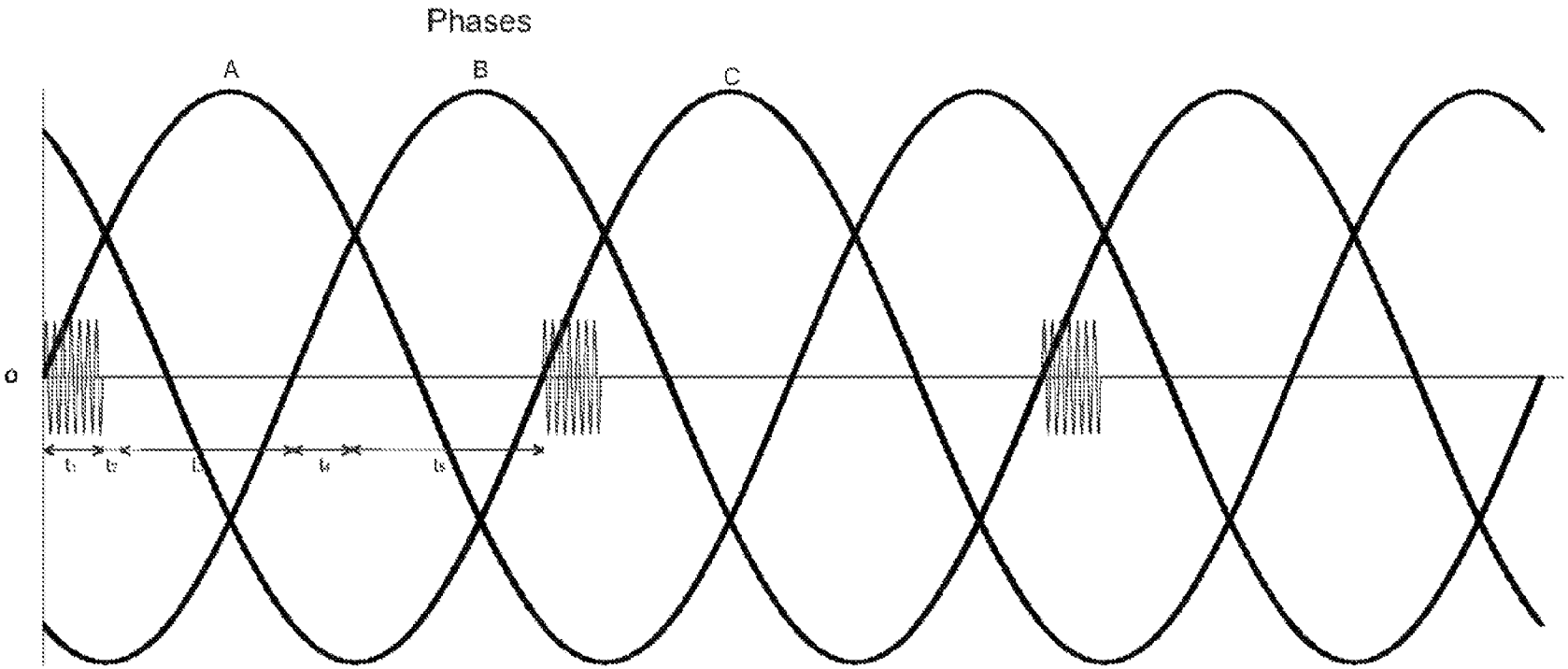
Figure 4I:
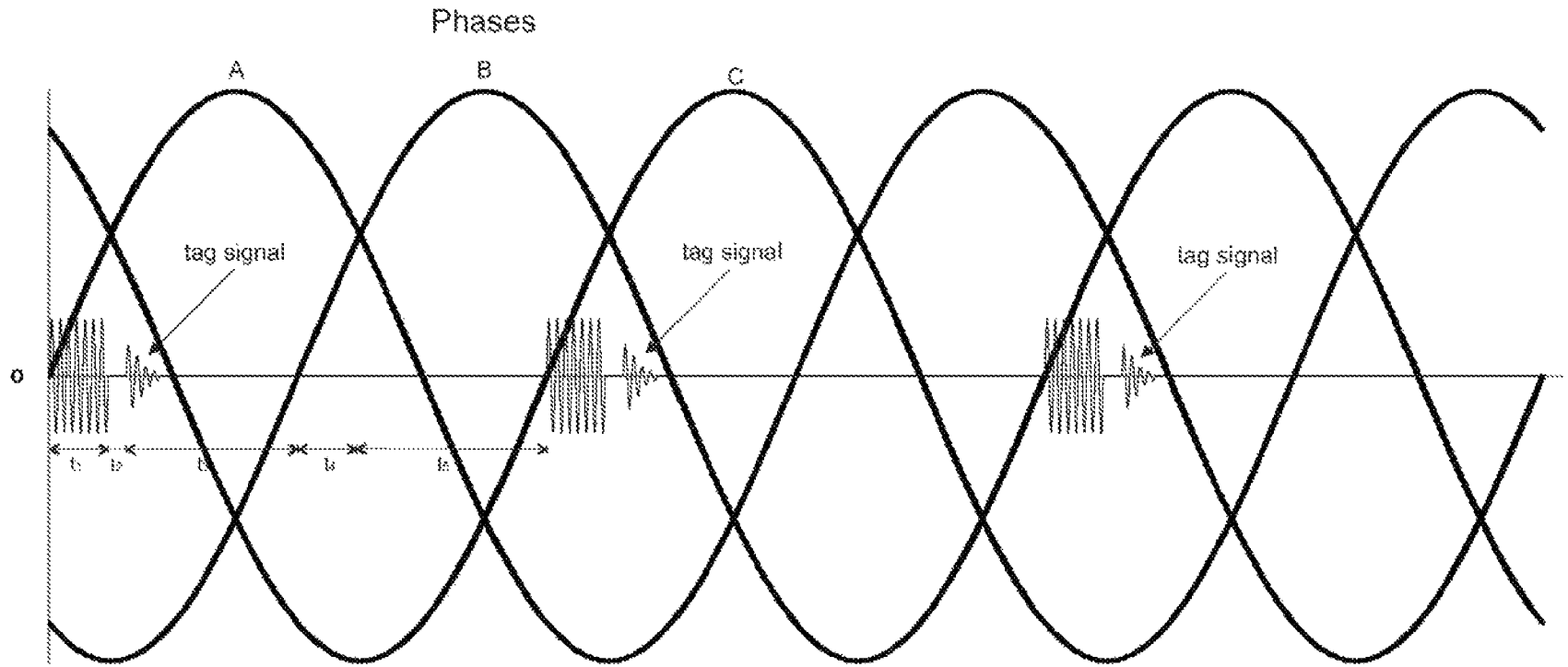
Figure 4J:
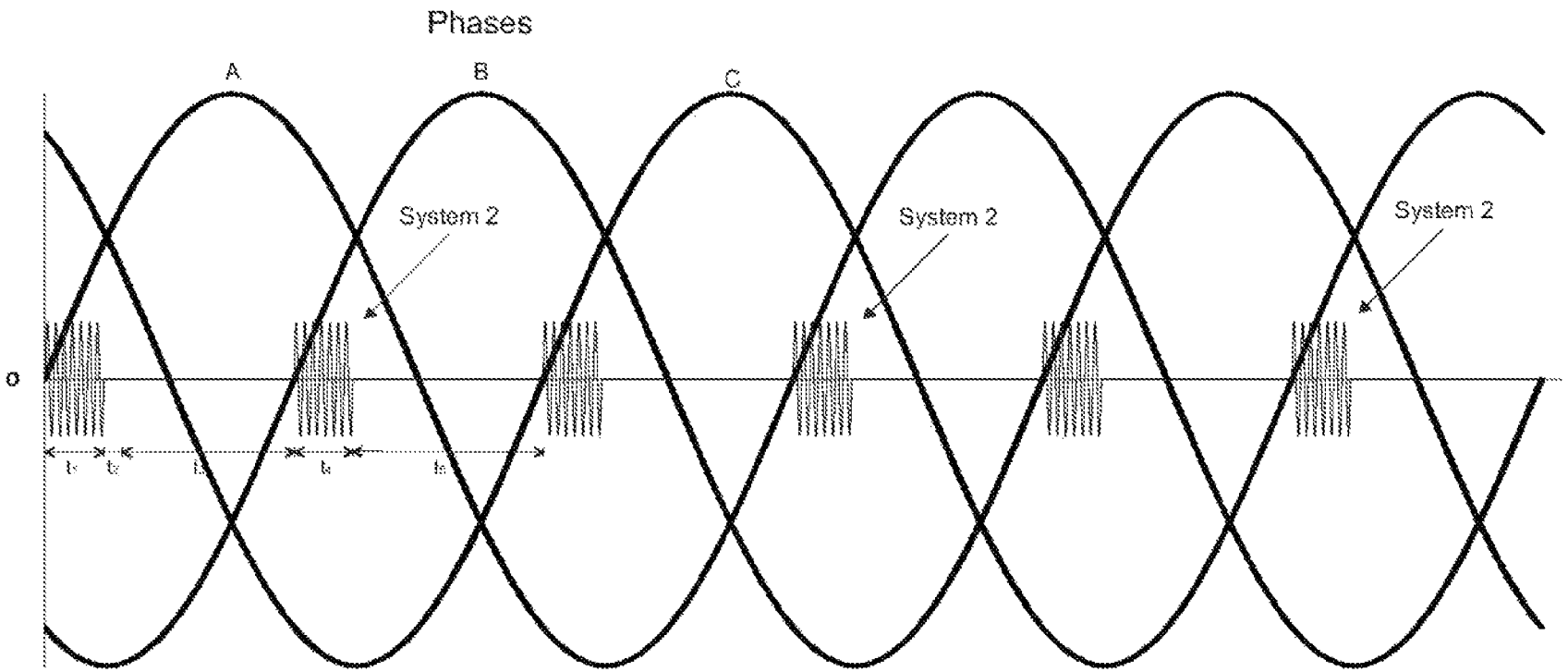
Figure 4K:
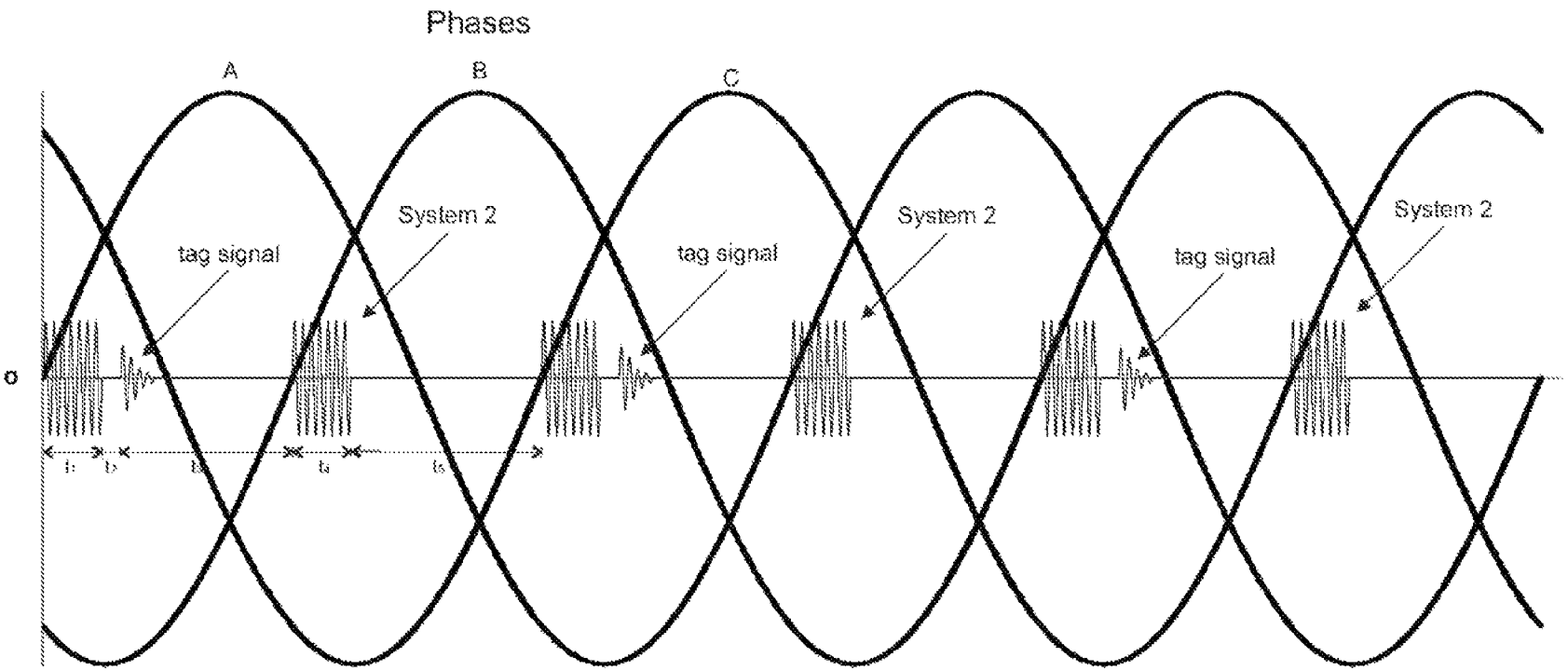
Figure 4L:
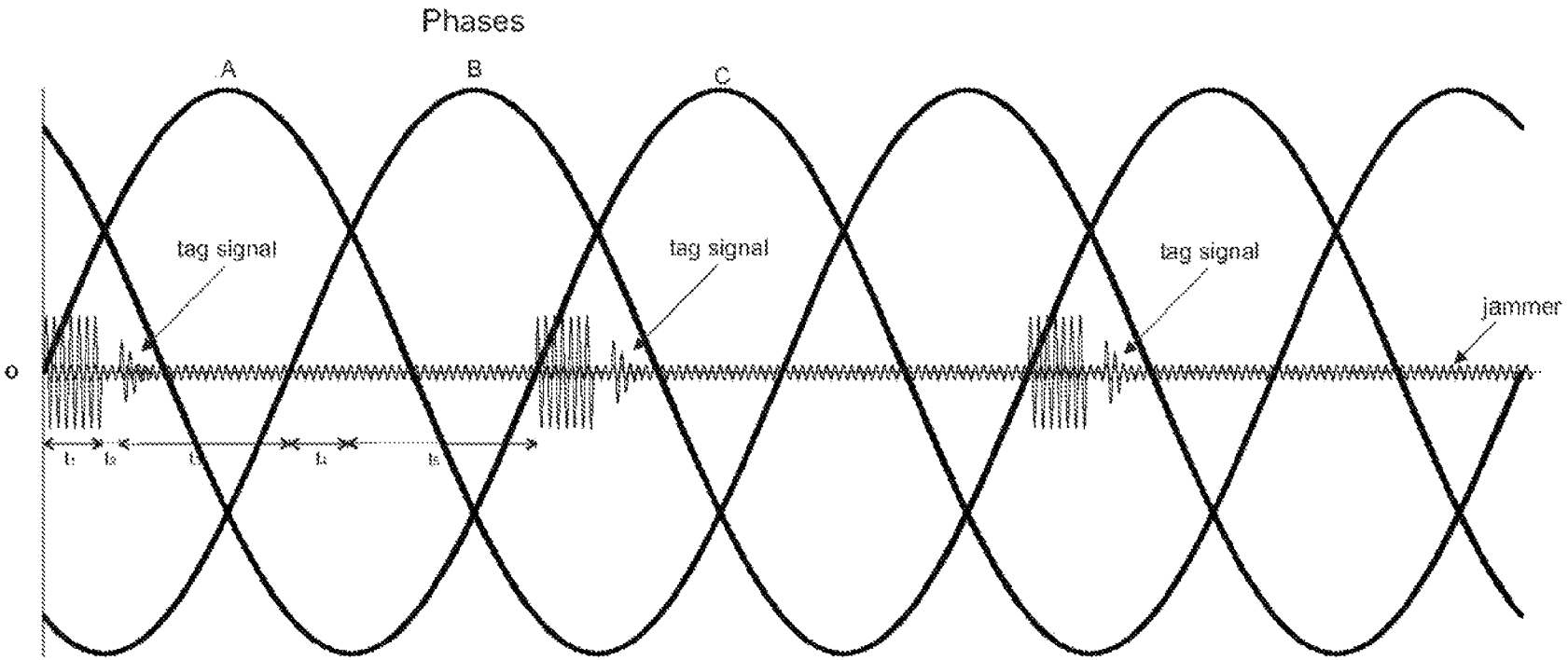

FIG. 4H illustrates the signaling for the acousto-magnetic EAS system with no tag signal transmission. As illustrated, there is no tag signal at t3. FIG. 4I illustrates the same, but includes a tag response, which is within the time period t3. FIG. 4J is an exemplary signaling illustration for two independent acousto-magnetic EAS systems 400, which due to synchronization, start sending out signals at zero-crossing and at times t1 and t4, with no tag transmission (no tag is present). FIG. 4K is an exemplary signaling illustration as shown in FIG. 4J, but includes a tag response from within system 1, at time period t3 on phase line A. Finally, FIG. 4L is an exemplary signaling illustration that shows system operating with a tag (tag output at time t3), which is also jammed by a jammer. As illustrated, the jammer signal is similar to that of a tag signal, but is continuous in time rather than in bursts. It should be noted that a jammer signal will (at the very least) be detected at time t3 (where the system is expecting a signal from the tag) and at time t5, which is reserved for detection of background or ambient signal only. Accordingly, the jammer signal is a continuous signal, is not in bursts, and is not synchronized with the timed sequence of events associated with the entire system, making it possible for its detection. It should be noted that all times t1, t2, t3, . . . tn are programmable and may be changed, this also applies to all signals and signal features or characteristics (e.g., start and end of pulses, number of pluses, pulse width, pulse strength, duration, amplitude, period, frequency, phase, repetition, etc.).

Referring back to FIG. 4D (and in combination with FIGS. 4G to 4L), after the operational act 452, at the operational act 405, the microcomputer 416 waits for a duration of t2 for the pulse that commenced at t1 to have time to settle. Thereafter, at the operational act 454 the received signals are sampled (described in detail in relation to FIGS. 4D and 4E-1 to 4E-4). That is, this is the duration t3 where the received signal may be a signal from a tag or a jammer unit. At the operational act 456, the microcomputer 416 stores the sampled results (tag or jammer signals), and waits at operational act 458. This wait is for a duration t4, which provides sufficient time for other system to transmit their respective pulses. At operational act 460, the microcomputer samples further data, but this time for noise (or possibly jammer signal) from the receiver antenna for a duration t5, and stores the received data at the operational act 462 (described in detail in relation to FIGS. 4D and 4E-1 to 4E-4). The above-described processing operational functions are repeated "P" times in accordance with an exemplary counter mechanism control 463, 465, and 467.

At operational act 464, all signals stored are filtered and at operational act 466 they are analyzed. At operational act 468, it is determined if a matching alarm tag criteria is met. That is, if a possible tag signal was picked up at time duration t3 at the operational act 454. If it is determined that no tag signal was received, then it is determined at the operational act 470 if a jammer signal was received. In other words, was a jammer signal picked up at the operational act 454 (duration t3) and/or the operational act 460 (duration t5). Stated otherwise, at the operational act 470 it is determined if a match for jammer alarm criteria exist. As described above in relation to FIG. 4L, this can be the detection of continuous signal at time t3 and time t5, where the system is expecting a signal burst from the tag at time t3 and at time t5, where the system is listening for noise. Accordingly, the operational act 472 is executed where an alarm is sound and the jammer information is forwarded to a computer (if the computer has requested such information, which is determined at operational act 474.) If it is determined that a tag signal was received (at operational act 468) or a jammer signal is detected (at the operational act 470), an alarm is triggered at operational act 472, and communicated with an outside computer.

FIGS. 5A to 5D are exemplary illustrations of pedestal systems with counters in accordance with the present invention. As illustrated, the present invention further provides counter mechanism that counts the number of individuals entering into and exiting out of the surveillance zone defined by the pedestal systems, which is later processed to determined the number of people entering and existing a secured area such as a retail store, an airport terminal, or others.

Figure 5B:
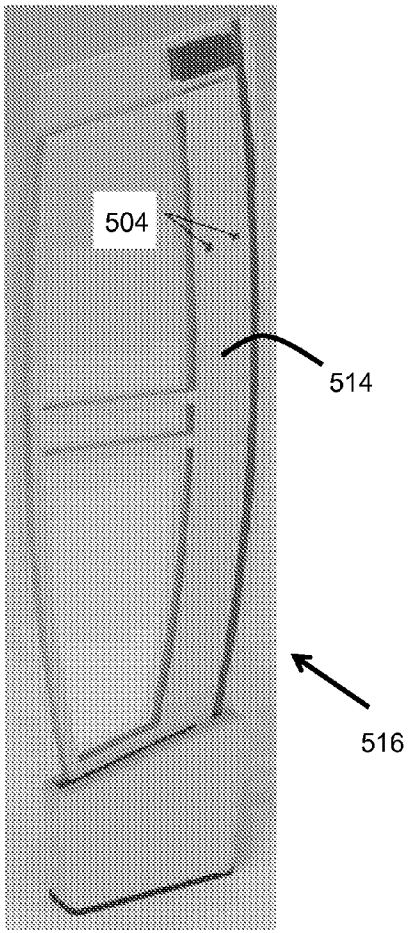
FIGS. 5A to 5D are exemplary illustrations of pedestal systems of the present invention with counters in accordance with the present invention.
Figure 5A:
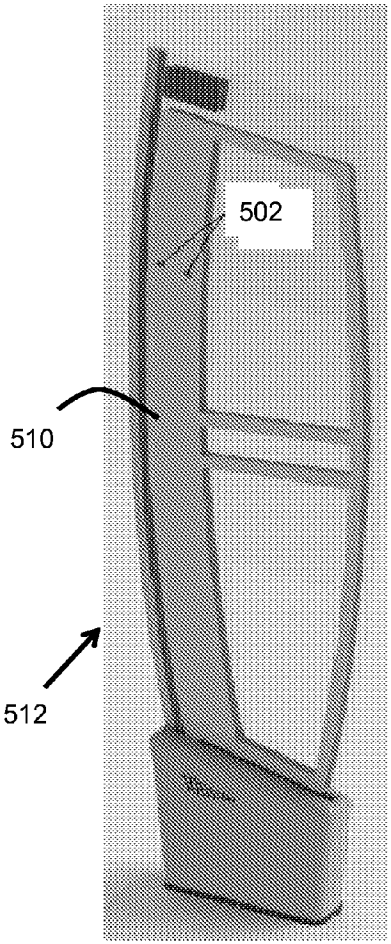
Figure 5C:
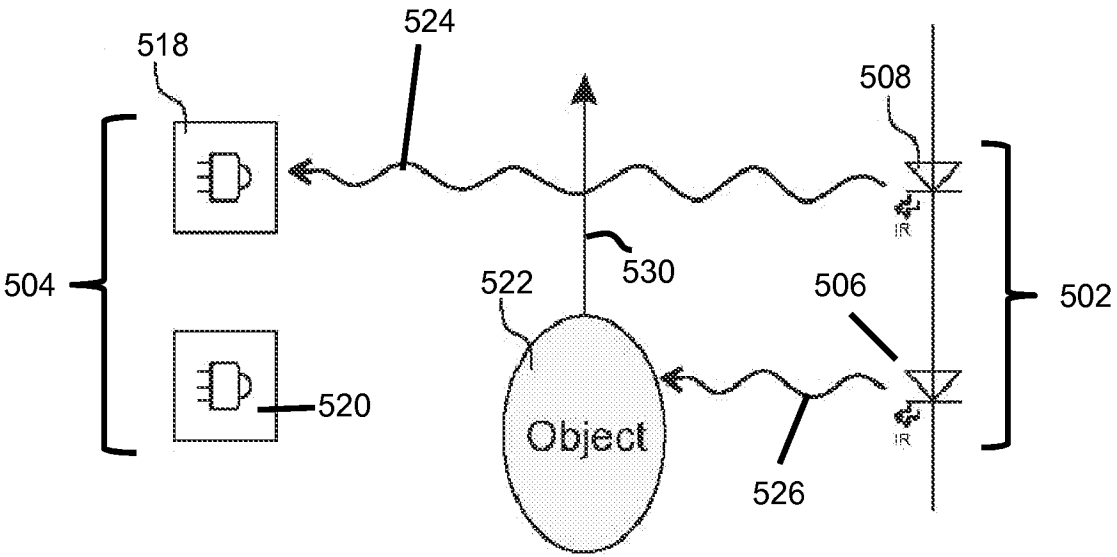

There are numerous ways to implement counters, one non-limiting example of which may include the use infrared gates, which if broken, result in a count. For example, as is illustrated in FIGS. 5A to 5D, the infrared gate may include a set of horizontally juxtaposed infrared emitters 502 comprised of a first infrared Light Emitter Diode (LED) 506 and a second a second infrared LED 508 that are positioned on a first side 510 of a first pedestal system 512. The exemplarily illustrated infrared gate may further include a commensurate set of horizontally juxtaposed infrared receivers 504 (shown in FIG. 5C and referenced as infrared receiver 518 and 520) that are positioned on a second side 514 of a second pedestal system 516 that faces the first side 510 of the first pedestal system 512. As illustrated in FIG. 5C, the infrared LED emitters 508 and 506 are respectively aligned horizontally within the line of sight of the set of horizontally juxtaposed infrared receivers 518 and 520, where a first and second infrared lights 524 and 526 are transmitted from the infrared emitters 502 and received by the infrared receivers 504. When an object 522 is moving in the direction 530 and is passed through in-between the pedestals and enters the line of sight of the infrared receivers 518 and 520, the object 522 blocks the reception of one of the emitted infrared lights (e.g., infrared light 526) from reaching a corresponding infrared receiver (e.g., 520) to thereby break the infrared gate. If the object 522 is moving in a first direction 530 illustrated, then the second infrared light 526 will break first and then the first infrared light 524 will break as the object continues to move in the same direction 530. Therefore, the sequence of interruption of the infrared gates (the infrared emitted lights 524 and 526) will determine the moving direction of the object (exiting or entering) a secured area through the surveillance zone. The information would then be processed by a CPU 416 to determine the number of people entering and existing the secured area.

Figure 5D:
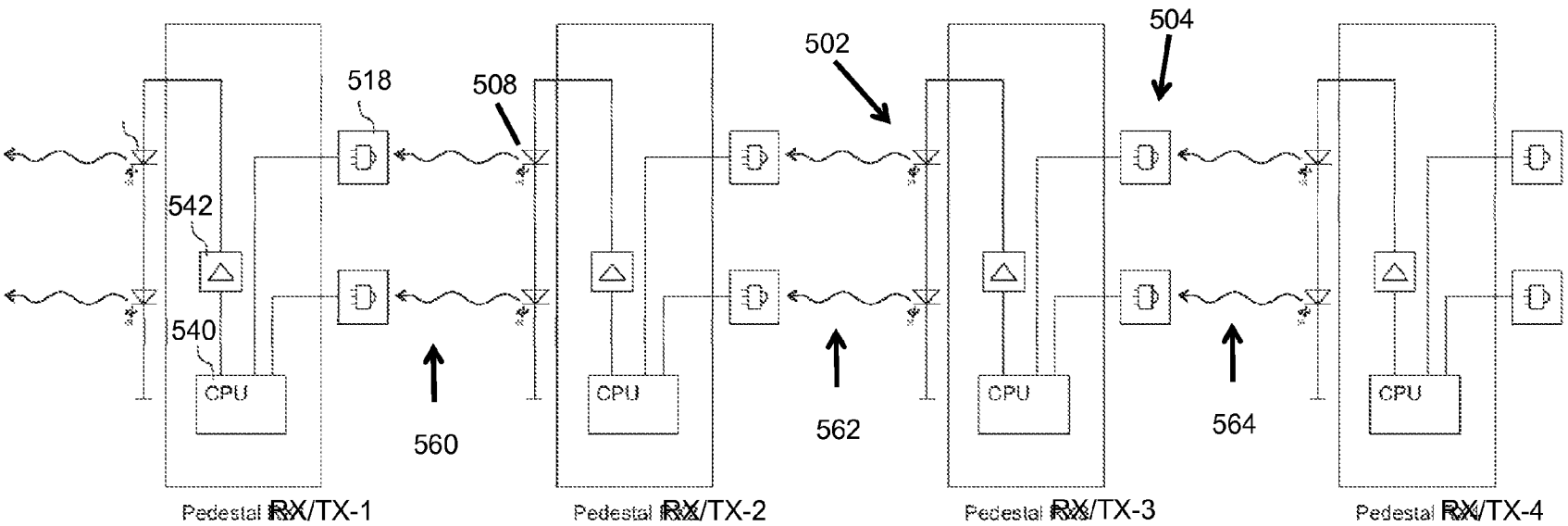

FIG. 5D is an exemplary illustration of a plurality of pedestals with daisy chained or cascading counter mechanisms. As illustrated, a first and a second pedestal systems RX/TX-1 and RX/TX-2 of the plurality of pedestals form a first infrared gate 560, with the second and a third pedestals RX/TX-2 and RX/TX-3 forming a second infrared gate 562. The third and final (fourth) pedestals RX/TX-3 and RX/TX-4 form the third infrared gate 564. As further illustrated, inside each pedestal system may include a CPU 540 that is coupled with the set of infrared emitters 502 and infrared receivers 504, with simple amplifiers 542 coupled between the CPU 540 and the infrared emitters 502 to drive the set of infrared emitters 502. When object 522 moves within any of the infrared gates 560, 562, 564, the input to the CPU 540 is pulled to a high (e.g., "1") for a count and directional movement of the object (as described above), which information is then fed to CPU 416 for further processing.

Another non limiting example of a well known counter that may be used in conjunction with EAS pedestal systems of the present invention is a digital video recorder (DVR) with software analytics wherein images of a specified sized objects crossing the protected area are counted and stored into the DVR's internal memory. These data can then be extracted or exported into the Article Surveillance System of the present invention to be further processed by CPU 416. The use of counter significantly increases the reliability of the system alarms by validating the alarm if a person indeed has crossed the protected area, and if it is determined that a person crossed the protected area, the Article Surveillance System of the present invention allows CPU 416 to enable the generation or transmission of alarms. If it is determined that no person has crossed the protected area, then alarms may be programmed to be allowed or disabled depending on operator preference.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the magnetic sensors 102, 104, 106, and 108 may be replaced by other well-known types of magnetic detectors. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An electronic article surveillance (EAS) system, comprising:

a combined plurality of independent surveillance systems physically located within pedestal systems, comprising:

a first EAS system configured as a magnetic EAS system that detects magnetic material, including magnetic EAS tags and magnetic detachers;

a second EAS system configured as an anti-Faraday shielding EAS system that detects Faraday shields;

a third EAS system configured as an acousto-magnetic EAS systems that detects an acousto-magnetic EAS tag; and an anti-jamming detection system.

2. The EAS system as set forth in claim 1, wherein:

the pedestal systems is comprised of a plurality of pedestals, with:

a first pedestal of the plurality of pedestals accommodating at least one of a transmitting and receiving antennas of at least one of the respective first, second, and third EAS systems; and a second pedestal of the plurality of pedestals accommodating at least one of the receiving and transmitting antennas of at least another of the respective first, second, and third EAS systems.

3. The EAS system as set forth in claim 1, wherein:

the pedestal systems is comprised of at least one transceiver pedestal.

4. The EAS system as set forth in claim 1, wherein:

the magnetic EAS system includes a plurality of electromagnetic systems.

5. The EAS system as set forth in claim 4, wherein:

the plurality of electromagnetic systems include a plurality of magnetic sensors.

6. The EAS system as set forth in claim 5, wherein:

the plurality of magnetic sensors are comprised of a core having ferromagnetic material with high magnetic permeability, and a conductor wound around the core.

7. The EAS system as set forth in claim 6, wherein:

a first magnetic sensor of the plurality of magnetic sensors is coupled with a second magnetic sensor of the plurality of magnetic sensors to form a first electromagnetic system;

a third magnetic sensor of the plurality of magnetic sensors is coupled with a fourth magnetic sensor of the plurality of magnetic sensors to form a second electromagnetic system;

with a first and second electromagnetic systems functioning independently.

8. The EAS system as set forth in claim 7, wherein:

the first magnetic sensor generating a first signal and the second magnetic sensor generating a second signal that is equal but opposite to the first signal for suppression and prevention of false alarm when one of an EAS magnetic tag and a detacher is detected substantially equally distanced from both the first and second magnetic sensors;

the third magnetic sensor generating a third signal and the fourth magnetic sensor generating a fourth signal that is equal but opposite to the third signal for suppression and prevention of false alarm when one of an EAS magnetic tag and a detacher is detected substantially equally distanced from both the third and fourth magnetic sensors;

with the first electromagnetic system generating a first surveillance zone and the second electromagnetic system generating a second surveillance zone that is different from the first surveillance zone, with an area of the first surveillance zone and the second surveillance zone overlapping to fully cover a complete surveillance zone of the EAS system.

9. The EAS system as set forth in claim 8, wherein:

a wire is wound about the core along an entire longitudinal axial length of the core.

10. The EAS system as set forth in claim 1, wherein:

the anti-Faraday shielding EAS system is comprised of a first anti-Faraday shielding EAS system having a first inductor coil;

a second anti-Faraday shielding EAS system having a second inductor coil; with the first anti-Faraday shielding EAS system coupled with the second anti-Faraday shielding EAS system.

11. The EAS system as set forth in claim 10, wherein:

the first inductor coil has a first air-core with a first width, a first axial length, and a first axial center, with the first inductor coil wound around the first air-core along an entire first longitudinally axis of the first air-core;

the second inductor coil has a second air-core with a second width, a second axial length, and a second axial center, with the second inductor coil wound around the second air-core along an entire second longitudinally axis of the second air-core; and the first air-core is located above the second air-core, with the first axial center aligned parallel the second axial center.

12. The EAS system as set forth in claim 11, wherein:

a first straight section of a first winding of the acousto-magnetic EAS system is passed through the first axial center, and a second straight section of a second winding of the acousto-magnetic EAS system is passed through the second axial center.

13. The EAS system as set forth in claim 1, wherein:

the acousto-magnetic EAS system includes a first upper coil and a second lower coil, with a bottom of the first upper coil overlapping a top section of the second lower coil; the corners of the first upper coil and the second lower coil have a substantially rectangular curved corners.

14. The EAS system as set forth in claim 1, wherein:

the magnetic EAS system includes:

a first amplifier with a first amplification gain for amplifying an incoming antenna signal and outputting an amplified signal, a low-pass filter for filtration of noise of the amplified signal and generation of a filtered signal;

a differential amplifier for determining a rate of change in the filtered signal for discriminating between an occurrence and noise, and generating a differential signal if rate of change is fast;

a second amplifier with a second amplification gain for amplifying the differential signal and outputting a second amplified signal;

a microprocessor for processing the second amplified signal, and based on a sensitivity threshold level, determines if an alarm is to be generated.

15. The EAS system as set forth in claim 14, wherein:

differential amplifier includes a differential input stage that is comprised of a first timer that generates a first time $\tau_1$ and a second timer that generates a second time $\tau_2$, with $\tau_1 >> \tau_2$;

the first timer is comprised of a first set of RC circuit and the second timer comprised of a second set of RC timer.

16. The EAS system as set forth in claim 14, wherein:

the microcomputer converts the second amplified signals from analog into digitized input signals using an A/D converter;

the digitized input signals are sampled, read, and stored as sampled averages, and determined if there is an increasing trend in average value of the sampled averages within a set time T, and if there is an increasing trend and the sampled averages are greater than a sensitivity threshold, the microcomputer generates an alarm.

17. The EAS system as set forth in claim 1, wherein:

the anti-Faraday shielding EAS system includes an anti-Faraday shielding EAS signal processing circuit that is comprised of:

a signal generator for generating a carrier signal at a predetermined frequency set by a frequency selector;

a first amplifier with a first amplification gain for amplifying the generated carrier signal and outputting an amplified signal to an antenna for transmission of signal;

a receiving antenna for receiving the transmitted signal from the transmitting antenna;

a second amplifier with a second amplification gain for amplifying the received signal and outputting a second amplified signal;

a low-pass filter for filtration of noise of the second amplified signal and generation of a filtered signal;

an amplitude demodulator for demodulating the filtered signal to generate a demodulated signal;

a differential amplifier for determining a rate of change in the demodulated signal for discriminating between an occurrence and noise, and generating a differential signal if rate of change is fast;

a third amplifier with a third amplification gain for amplifying the differential signal and outputting a third amplified signal;

a microprocessor for processing the third amplified signal, and based on a sensitivity threshold level, determines if an alarm is to be generated.

18. The EAS system as set forth in claim 17, wherein:

the microcomputer converts the third amplified signals from analog into digitized input signals using an A/D converter;

the digitized input signals are read and sampled, and stored as sampled averages;

the microprocessor compares the received stored sample averages with a predetermined signature signal to determine if an alarm is to be generated.

19. The EAS system as set forth in claim 1, wherein:

the acousto-magnetic EAS system includes:

an antenna comprising a first coil and a second coil;

a transceiver module coupled with the first and the second coils for generating and transmitting a respective first signal and a second signal in a first mode of operation, defining a surveillance zone for an EAS tag;

the first and the second signals having respective first and second signal phase characteristics that are maintained during normal operations, with no substantial changes in respective signal phases;

the transceiver module in a second mode of operation receives signals from the surveillance zone from the first and second coils; and a microprocessor for processing the received signals from the transceiver module and generating an alarm based on a predetermined condition.

20. The EAS system as set forth in claim 19, wherein:

the first coil and the second coil partially overlap and are positioned within a common plane.

21. The EAS system as set forth in claim 20, wherein:

the generated first and second signals are respective first and second magnetic fields that are substantially in phase, only.

22. The EAS system as set forth in claim 20, wherein:

the generated first and second signals are respective first and second magnetic fields that are substantially out of phase, only.

23. The EAS system as set forth in claim 20, wherein:

the generated first and second signals are respective first and second magnetic fields with phase characteristics that are maintained during normal operations and have one of substantially in phase and substantially out of phase characteristics only, with no substantial signal phase variations during operation.

24. The EAS system as set forth in claim 20, wherein:

the transceiver module is comprised of a transceiver circuit coupled with the first and second coils of the antenna.

25. An electronic article surveillance (EAS) system, comprising:

a plurality of independent surveillance systems physically located within pedestal systems, comprising:

a first EAS system; and a second EAS system that is independent of and autonomous from the first EAS system.

26. The EAS system as set forth in claim 25, wherein:

the first EAS system operates at a first frequency; and the second EAS system functions at a second frequency, which is different from that of the first frequency.

27. The EAS system as set forth in claim 26, wherein:

an acousto-magnetic EAS system that includes:

an antenna;

a control unit coupled with the antenna for generating and transmitting a signal, defining a surveillance zone for an EAS tag; and for receiving signals from the surveillance zone;

with the transmitted signal has a signal phase characteristic that is maintained during normal operations, with no substantial changes in respective signal phase; and with the control unit processing the received signals from the surveillance zone and generating an alarm based on a predetermined condition, and without effecting generation and transmission of signal that defines the surveillance zone.

28. The EAS system as set forth in claim 27, wherein:

the antenna is comprised of a single coil.

29. The EAS system as set forth in claim 27, wherein:

the transmitted signal is a magnetic field with a substantially constant phase.

30. The EAS system as set forth in claim 27, wherein:

the control unit includes a transceiver module that is comprised of a transceiver circuit coupled with the antenna.

31. The EAS system as set forth in claim 30, wherein:

the antenna is a plurality of transceiver antennas, with a transceiver antenna of the plurality of transceiver antennas comprised of a coil.

32. The EAS system as set forth in claim 31, wherein:

the plurality of antennas are comprised of a plurality of transmitter antennas and a plurality of receiver antennas, with an antennas of plurality of transmitter and receiver antennas comprised of a coil.

33. The EAS system as set forth in claim 31, wherein:

the received signals are fetched by a multiplexer from the plurality of receiver antennas, with a received signal from a receiver antenna individually processed by a microprocessor of the control unit.

34. The EAS system as set forth in claim 25, wherein:

the first EAS system is comprised of:

a magnetic EAS system for detection of magnetic material, including magnets, magnetic objects, a magnetic EAS tag, and magnetic detacher; and an anti-Faraday shielding EAS system that functions independent of and autonomous from the magnetic EAS system for detection of Faraday shields.

35. The EAS system as set forth in claim 25, wherein:

the second EAS system is comprised of an acousto-magnetic EAS system that includes:

a plurality of antennas;

a control unit coupled with the plurality of antennas for generating and transmitting signals, defining a surveillance zone for an EAS tag; and for receiving signals from the surveillance zone;

with the transmitted signals having signal phase characteristics that are maintained during normal operations, with no substantial changes in respective signal phases; and with the control unit processing the received signals from the surveillance zone and generating an alarm based on a predetermined condition, and without effecting generation and transmission of signals that define the surveillance zone.

36. The EAS system as set forth in claim 35, wherein:

an antenna of the plurality of antennas is comprised of a first coil and a second coil.

37. The EAS system as set forth in claim 36, wherein:

the first coil and the second coil partially overlap and are positioned within a common plane.

38. The EAS system as set forth in claim 36, wherein:

the transmitted signals are magnetic fields that are substantially in phase, only.

39. The EAS system as set forth in claim 36, wherein:

the transmitted signals are magnetic fields that are substantially out of phase, only.

40. The EAS system as set forth in claim 36, wherein:

the transmitted signals magnetic fields with phase characteristics that are maintained during normal operations and have one of substantially in phase and substantially out of phase characteristics only, with no substantial signal phase variations during operation.

41. The EAS system as set forth in claim 36, wherein:

the control unit includes a transceiver module that is comprised of a transceiver circuit coupled with the plurality of antennas.

42. The EAS system as set forth in claim 41, wherein:

the plurality of antennas are a plurality of transceiver antennas, with a transceiver antenna of the plurality of transceiver antennas comprised of a first coil and a second coil.

43. The EAS system as set forth in claim 41, wherein:

the plurality of antennas are comprised of a plurality of transmitter antennas and a plurality of receiver antennas, with an antennas of plurality of transmitter and receiver antennas comprised of a first coil and a second coil.

44. The EAS system as set forth in claim 43, wherein:

the received signals are fetched by a multiplexer from the plurality of receiver antennas, with a received signal from a receiver antenna individually processed by a microprocessor of the control unit.

45. The EAS system as set forth in claim 25, wherein:

the first EAS system is comprised of a magnetic EAS system for detection of magnetic material, including magnetic objects, and a magnetic EAS tag; and the second EAS system is comprised of an anti-Faraday shielding EAS system that functions independent of and autonomous from the magnetic EAS system for detection of Faraday shields.

46. The EAS system as set forth in claim 45, wherein:

the magnetic EAS system includes a plurality of electromagnetic systems.

47. The EAS system as set forth in claim 46, wherein:

the plurality of electromagnetic systems include a plurality of magnetic sensors.

48. The EAS system as set forth in claim 47, wherein:

the plurality of magnetic sensors are comprised of a core having ferromagnetic material with high magnetic permeability, and a conductor wound around the core.

49. The EAS system as set forth in claim 48, wherein:

a first magnetic sensor of the plurality of magnetic sensors is coupled with a second magnetic sensor of the plurality of magnetic sensors to form a first electromagnetic system;

a third magnetic sensor of the plurality of magnetic sensors is coupled with a fourth magnetic sensor of the plurality of magnetic sensors to form a second electromagnetic system;

with a first and second electromagnetic systems functioning independently.

50. The EAS system as set forth in claim 49, wherein:

the first magnetic sensor generating a first signal and the second magnetic sensor generating a second signal that is equal but opposite to the first signal for suppression and prevention of false alarm when one of an EAS magnetic tag and a magnetic detacher is detected substantially equally distanced from both the first and second magnetic sensors;

the third magnetic sensor generating a third signal and the fourth magnetic sensor generating a fourth signal that is equal but opposite to the third signal for suppression and prevention of false alarm when one of an EAS magnetic tag and a magnetic detacher is detected substantially equally distanced from both the third and fourth magnetic sensors;

with the first electromagnetic system generating a first surveillance zone and the second electromagnetic system generating a second surveillance zone that is different from the first surveillance zone, with an area of the first surveillance zone and the second surveillance zone overlapping to fully cover a complete surveillance zone of the EAS system.

51. The EAS system as set forth in claim 50, wherein:

a wire is wound about the core along an entire longitudinal axial length of the core.

52. The EAS system as set forth in claim 45, wherein:

the anti-Faraday shielding EAS system is comprised of a first anti-Faraday shielding EAS system having a first inductor coil;

a second anti-Faraday shielding EAS system having a second inductor coil; with the first anti-Faraday shielding EAS system coupled with the second anti-Faraday shielding EAS system.

53. The EAS system as set forth in claim 52, wherein:

the first inductor coil has a first air-core with a first width, a first axial length, and a first axial center, with the first inductor coil wound around the first air-core along an entire first longitudinally axis of the first air-core;

the second inductor coil has a second air-core with a second width, a second axial length, and a second axial center, with the second inductor coil wound around the second air-core along an entire second longitudinally axis of the second air-core; and the first air-core is located above the second air-core, with the first axial center aligned parallel the second axial center.

54. The EAS system as set forth in claim 45, wherein:

the anti-Faraday shielding EAS system is comprised of a single inductor coil.

55. The EAS system as set forth in claim 54, wherein:

the inductor coil has an air-core with a width, an axial length, and an axial center, with the inductor coil wound around the air-core along an entire longitudinally axis of the first air-core.

56. The EAS system as set forth in claim 25, wherein:

the first EAS system is comprised of only one of a magnetic EAS system for detection of magnetic material, including magnetic objects, and a magnetic EAS tag and an anti-Faraday shielding EAS system that detects of Faraday shields; and the second EAS system is comprised of one or more acousto-magnetic EAS systems that detect an acousto-magnetic EAS tag.

57. The EAS system as set forth in claim 56, wherein:

the acousto-magnetic EAS system includes:

an antennas comprised of a single coil;

a control unit coupled with the antenna for generating and transmitting a signal, defining a surveillance zone for an EAS tag; and for receiving signals from the surveillance zone;

with the transmitted signal has a signal phase characteristic that is maintained during normal operations, with no substantial changes in the signal phase; and with the control unit processing the received signals from the surveillance zone and generating an alarm based on a predetermined condition, and without effecting generation and transmission of signal that defines the surveillance zone.

58. The EAS system as set forth in claim 56, wherein:

the acousto-magnetic EAS system includes:

an antenna comprising a first coil and a second coil;

a transceiver module coupled with the first and the second coils for generating and transmitting a respective first signal and a second signal in a first mode of operation, defining a surveillance zone for an EAS tag;

the first and the second signals having respective first and second signal phase characteristics that are maintained during normal operations, with no substantial changes in respective signal phases;

the transceiver module in a second mode of operation receives signals from the surveillance zone from the first and second coils; and a microprocessor for processing the received signals from the transceiver module and generating an alarm based on a predetermined condition.

59. The EAS system as set forth in claim 25, wherein:

the second EAS system is comprised of an acousto-magnetic EAS system that includes:

a plurality of antennas that are comprised of one or more transmitter antenna loops and a first and a second receiver antenna loops;

the first receiver antenna loop and the second receiver antenna loop partially overlap and are positioned within a common plane;

a control unit coupled with the one or more transmitter antenna loops for generating and transmitting signals, defining a surveillance zone for an EAS tag; and for receiving a first and a second receiver signals from the surveillance zone;

with the transmitted signals having signal phase characteristics that are maintained during normal operations, with no substantial changes in respective signal phases; and with the control unit processing the first and the second receiver signals from the surveillance zone and generating an alarm based on a predetermined condition, and without effecting generation and transmission of signals that define the surveillance zone;

the control unit includes:

a processor that has a first and a second analog to digital (A/D) converters that convert the first and the second received signals from the respective first and second receiver antenna loops into first and second digital signals;

a first and second samplers that simultaneously sample the respective first and the second digital signals twice at two different predetermined times;

a computing mechanism that manipulates both the first and the second sampled digital signals from the first and second receiver antenna loops and compares the resulting manipulations with a predetermined criteria.

60. The EAS system as set forth in claim 25, further including:

a count mechanism for counting entities moving into and out of a secured area.

61. The EAS system as set forth in claim 60, wherein:

the count mechanism is comprised of one or more infrared gates.

62. The EAS system as set forth in claim 60, wherein:

the count mechanism is comprised of a digital video recorder.

63. The EAS system as set forth in claim 60, wherein:

the count mechanism is used for validation of legitimate alarm, and determination of a false alarm.

* * * * *